US010323822B2

(12) United States Patent
Hierzer

(10) Patent No.: US 10,323,822 B2
(45) Date of Patent: Jun. 18, 2019

(54) LIGHTING ARRANGEMENT, CONSTRUCTION KIT FOR A LIGHTING ARRANGEMENT, AND METHOD FOR CONSTRUCTING A LIGHTING ARRANGEMENT

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 0 days.

(21) Appl. No.: 15/730,354

(22) Filed: Oct. 11, 2017

(65) Prior Publication Data

US 2018/0100634 A1 Apr. 12, 2018

(30) Foreign Application Priority Data

Oct. 11, 2016 (DE) ..... 10 2016 219 697

(51) Int. Cl.
*F21V 23/06* (2006.01)
*F21V 5/04* (2006.01)
(Continued)

(52) U.S. Cl.
CPC ..... *F21V 5/043* (2013.01); *F21K 9/237* (2016.08); *F21K 9/238* (2016.08); *F21S 2/00* (2013.01);
(Continued)

(58) Field of Classification Search
CPC ..... F21V 5/043; F21V 7/043; F21V 21/005; F21V 21/025; F21V 21/096;
(Continued)

(56) References Cited

U.S. PATENT DOCUMENTS 684,264 A 10/1901 Kemmerer et al.
2,279,383 A 4/1942 Von Gehr
(Continued)

FOREIGN PATENT DOCUMENTS

CN 104428580 A 3/2015
DE 8409006 U1 6/1984
(Continued)

OTHER PUBLICATIONS

European Search Report for EP17195983 dated Jan. 12, 2018.
(Continued)

*Primary Examiner* — Karl D Frech
(74) *Attorney, Agent, or Firm* — Millen, White, Zelano & Branigan, P.C.; William Nixon

(57) ABSTRACT

A lighting arrangement comprises a channel having an interior and a light exit region, and at least one light providing device. The light providing device is designed for arrangement thereof within the interior for the directional emission of light during operation through the light exit region toward the outside. Furthermore, the lighting arrangement comprises at least one busbar designed for the supply of the light providing device in the interior of the channel, wherein the light providing device is electrically coupleable to the busbar. The light providing device, for the holding thereof, is coupleable to the channel and is freely positionable at least within a region of the interior. A construction kit for such a lighting arrangement and a method for constructing such a lighting arrangement are furthermore disclosed.

25 Claims, 22 Drawing Sheets

(51) Int. Cl.

| | |
|---|---|
| ***F21K 9/238*** | (2016.01) |
| ***F21K 9/237*** | (2016.01) |
| ***F21V 7/04*** | (2006.01) |
| ***F21S 2/00*** | (2016.01) |
| ***F21S 8/02*** | (2006.01) |
| ***F21V 21/005*** | (2006.01) |
| ***F21V 21/02*** | (2006.01) |
| ***F21V 21/096*** | (2006.01) |
| *F21V 7/00* | (2006.01) |
| *F21V 21/30* | (2006.01) |
| *F21S 4/28* | (2016.01) |
| *F21Y 115/10* | (2016.01) |
| *F21Y 113/00* | (2016.01) |
| *F21K 9/20* | (2016.01) |

(52) U.S. Cl.
CPC ..... *F21S 8/026* (2013.01); *F21V 7/043* (2013.01); *F21V 21/005* (2013.01); *F21V 21/025* (2013.01); *F21V 21/096* (2013.01); *F21K 9/20* (2016.08); *F21S 4/28* (2016.01); *F21V 7/0008* (2013.01); *F21V 21/30* (2013.01); *F21Y 2113/00* (2013.01); *F21Y 2115/10* (2016.08)

(58) Field of Classification Search
CPC ..... F21V 7/0008; F21K 9/238; F21K 9/237; F21K 9/20; F21S 2/00; F21S 8/026; F21S 4/28; F21Y 2115/10; F21Y 2113/00
USPC ..... 362/147
See application file for complete search history.

(56) References Cited

U.S. PATENT DOCUMENTS

| | | | | |
|---|---|---|---|---|
| 3,917,940 | A | 11/1975 | Duddy et al. | |
| 8,227,813 | B2 | 7/2012 | Ward | |
| 8,979,305 | B2 | 3/2015 | Sachsenweger | |
| 9,765,954 | B2 | 9/2017 | Zaderej et al. | |
| 2003/0103347 | A1* | 6/2003 | Friend | F21V 21/002 362/225 |
| 2006/0138293 | A1 | 6/2006 | Clement | |
| 2009/0086478 | A1 | 4/2009 | Sanroma et al. | |
| 2010/0165464 | A1 | 7/2010 | Russo et al. | |
| 2012/0068621 | A1 | 3/2012 | Ward et al. | |
| 2013/0182437 | A1 | 7/2013 | Sachsenweger | |
| 2015/0300612 | A1 | 10/2015 | Stathes et al. | |
| 2015/0300613 | A1 | 10/2015 | Zaderej et al. | |

FOREIGN PATENT DOCUMENTS

| | | | |
|---|---|---|---|
| DE | 29509696 | U1 | 8/1995 |
| DE | 29515221 | U1 | 11/1995 |
| DE | 20017551 | U1 | 1/2001 |
| DE | 102010040892 | A1 | 3/2012 |
| DE | 202012008828 | U1 | 10/2012 |
| DE | 202014104473 | U1 | 12/2015 |
| EP | 2657590 | A1 | 10/2013 |
| WO | 12040016 | A1 | 3/2012 |
| WO | 2014081842 | A1 | 5/2014 |
| WO | 2015096036 | A1 | 7/2015 |

OTHER PUBLICATIONS

English Abstract of EP2657590, Publication Date: Oct. 30, 2013.
English Abstract of WO2015096036, Publication Date: Jul. 2, 2015.
Rare Earth Solutions, https://www.cableorganizer.com/images/magnetic-cable-clips/cable-holder-specifications.pdf, Aug. 3, 2011.
English Abstract of DE202014104473, Publication Date: Dec. 22, 2015.
English Abstract of CN104428580, Publication Date: Mar. 18, 2015.
European Search Report Corresponding to EP 17 19 5983—dated Jan. 12, 2018.
European Search Report Corresponding to EP 16 20 5038—dated Mar. 2, 2017.
German Search Report Corresponding to DE 10 2015 226 625.7—dated Jan. 10, 2017.
German Search Report Corresponding to DE 10 2016 219 697.9—dated Jul. 19, 2017.
Austrian Search Report Corresponding to AT 50021—dated May 9, 2018.
English Abstract of DE-29515221, Publication Date: Jan. 11, 1996.
English Abstract of DE-29509696, Publication Date: Sep. 28, 1995.
Office Action for Related German Application No. 10 2016 219 697.9 dated Jul. 10, 2017.
English Abstract of DE202012008828, Publication Date: Oct. 17, 2012.
Office Action for related European Patent Application No. 17195983.6 dated Sep. 5, 2018.
Office Action in corresponding AT application 51047/2016-1 dated Feb. 1, 2019 (pp. 1-3).

* cited by examiner

LIGHTING ARRANGEMENT, CONSTRUCTION KIT FOR A LIGHTING ARRANGEMENT, AND METHOD FOR CONSTRUCTING A LIGHTING ARRANGEMENT

CROSS-REFERENCE TO RELATED APPLICATION

This application claims the benefit of German patent application No. 10 2016 219 697.9, filed Oct. 11, 2016, the entire disclosure of which is herein incorporated by reference.

FIELD OF THE INVENTION

The invention relates to a lighting arrangement, a construction kit for a lighting arrangement, and a method for constructing a lighting arrangement.

TECHNICAL BACKGROUND

In offices, private living spaces, exhibition spaces, retail spaces, and many other spatial areas, endeavors are often made to illuminate in a targeted manner one specific spatial region, or a plurality of specific spatial regions, articles situated in the space, objects suspended from a wall of the space or architectural features of the space. For this purpose, in a conventional manner, emitters secured at a ceiling of the space, for example, are often used, said emitters being aligned with the desired spatial region or the desired object. However, depending on the viewing direction, an observer situated in the space may be dazzled by such conventional emitters or at least perceive the directly visible light source as unattractive or disturbing.

An improved lighting arrangement is to be proposed which at least largely avoids such disadvantages.

SUMMARY OF THE INVENTION

Against this background, an idea of the invention is to specify a lighting arrangement which has expedient glare reducing properties and offers the user high flexibility in the endeavored lighting of objects and/or spatial regions. Moreover, it is an aspect of the invention to specify a construction kit for a lighting arrangement improved in this way, and an improved method for constructing a lighting arrangement.

Accordingly, a lighting arrangement is proposed which comprises a channel having an interior and a light exit region. The lighting arrangement furthermore comprises at least one light providing device, wherein the light providing device is designed for arrangement thereof within the interior for the directional emission of light during operation through the light exit region toward the outside. According to the invention, the lighting arrangement comprises at least one busbar designed for the supply of the light providing device in the interior of the channel, wherein the light providing device is electrically coupleable to the busbar. According to the invention, it is proposed that the light providing device, for the holding thereof, is coupleable to the channel and is freely positionable at least within a region of the interior.

Furthermore, a construction kit for such a lighting arrangement is proposed. The construction kit comprises components for forming a channel having an interior and a light exit region and also at least one light providing device. In this case, the light providing device is designed for arrangement thereof within the interior for the directional emission of light during operation through the light exit region toward the outside and is furthermore configured in such a way that the light providing device, for the holding thereof, is coupleable to the channel formed and is freely positionable at least within a region of the interior. According to the invention, in this case, the construction kit comprises at least one busbar designed for the supply of the light providing device and situated in the interior of the channel after the formation of the channel, or sections of such a busbar, wherein the busbar or the sections is or are in each case provided as a constituent of one of the components or as a component part secured or securable at one of the components.

Furthermore, a method for constructing a lighting arrangement according to the invention is proposed, wherein the method comprises the following steps:

- providing a channel having an interior and a light exit region, and providing at least one light providing device;
- introducing the light providing device into the interior and coupling the light providing device to the channel in order to hold the light providing device within the interior; and
- positioning the light providing device in such a way that the light providing device, if necessary after additional alignment thereof, can emit light during operation through the light exit region toward the outside.

One concept of the present invention consists in combining the arrangement of the light providing device within the interior of the channel and outward illumination or outward radiation using directional emission of light through the light exit region toward the outside with a free positionability of the light providing device within the interior, or at least within a region of the interior, and at the same time utilizing the great latitude afforded by the interior of the channel with regard to a flexible positioning of the light providing device not only in a transverse direction of the channel, but also along a longitudinal extent of the channel, by providing a busbar for supplying the light providing device in a simple and effective manner. Moreover, the length and shape of the channel can advantageously be adapted very flexibly to the lighting requirements and/or the spatial size.

The free positionability of the light providing device makes it possible to allow the light providing device to effect outward illumination through the light exit region precisely in the desired manner sought, for instance, for aesthetic reasons. This may also be advantageous if, within a spatial area, the arrangement of the objects to be illuminated changes for example after some time. By virtue of a busbar being provided, the light providing device can be positioned flexibly and freely even over long channel lengths.

The invention affords a highly flexible lighting possibility which additionally has advantageous glare reducing properties, as a result of the arrangement of the light providing device in the interior and the outward illumination through the light exit region.

Advantageous embodiments and developments are evident from the dependent claims and also from the description with reference to the figures of the drawing.

In accordance with one embodiment of the invention, the busbar is not visible from outside the interior. By way of example, a particularly simple and discreet appearance of the lighting arrangement can be achieved in this way.

In particular, in one development, the busbar can be arranged laterally with respect to the light exit region. This makes it easier to avoid a visibility of the busbar from outside.

In one embodiment, it is provided that for securing the light providing device at the channel at different locations within the interior the light providing device is coupleable to a constituent of the channel using magnetic force. The securing of the light providing device is thus achieved in a simple and reliable manner.

In particular, in one embodiment, the light providing device, for the coupling to the channel, can be securable in a magnetically adhering fashion at at least one inner surface region of the channel. In this way, a particularly simple, effective and flexible securing of the light providing device within the interior is accomplished in such a way that the light providing device can be positioned freely.

In one embodiment, the light providing device comprises at least one magnet, in particular a permanent magnet, by which the coupling of the light providing device to the channel is made possible.

In one embodiment, the light exit region is designed to be narrowed relative to the interior of the channel. This facilitates the reduction of glare and the "concealment" of the light providing device(s) in the channel.

In one embodiment, the light exit region is designed as a slotted opening and the light providing device arranged within the interior can emit light directionally toward the outside only through the light exit region. This contributes to advantageous glare reducing properties of the lighting device and to a discreet and simple lighting solution.

In one embodiment, the channel is designed with at least one integral or multipartite housing component having cover and wall sections and also having an open side. In this case, the light exit region transversely with respect to a longitudinal direction of the channel is designed to be smaller than the open side of the housing component. In this way, the light providing device or a plurality of light providing devices can be "concealed" particularly discreetly in the interior, a targeted, directional emission of light through the light exit region nevertheless being maintained.

In one development, the light providing device is coupleable to the housing component by magnetic force. In this case, the housing component may be formed with a material that enables such a coupling.

In one embodiment, the housing component can be designed with a quadrilateral, in particular rectangular, cross section, or with a quadrilateral, in particular rectangular, cross section having one or more rounded corners. Such a housing component enables the light providing devices to be accommodated in the interior in a simple manner.

In one embodiment, the wall and/or cover sections of the housing component, and in particular the inner surface regions of the housing component in the region of the wall and/or cover sections thereof, are substantially planar. Such a configuration facilitates the holding of the at least one light providing device by a magnetic force.

In particular, in one embodiment, the housing component can be designed as a sheet-metal part, for example composed of steel sheet, or with one or more sheet-metal parts, for example composed of steel sheet.

In one embodiment, the channel furthermore comprises profiled components coupled to the housing component in the region of the open side of the housing component, wherein the profiled components delimit the light exit region. By utilizing separately provided profiled components, it is possible to provide more complex geometries that are desired in the region of the delimitation of the light exit region, if appropriate, in a relatively simple manner.

In one development, the profiled components of the channel are configured to be arranged at a plate element in each case in sections on a side of the plate element that faces away from a visible side, in a manner engaging over an edge of the plate element. In this way, the channel can be hidden behind a suspended ceiling in a manner largely invisible from outside, wherein only the light exit region can be seen from the outer side, that is to say that side of the ceiling which faces a spatial area. A discreet and aesthetic lighting solution becomes possible as a result. The flexibility for the user with regard to the articles or spatial regions to be illuminated is fully maintained, however, even if the channel is permanently installed behind the ceiling and is covered by filler, for example, on the visible side, for instance laterally with respect to the light exit region.

The plate element is designed to be light-nontransmissive, in particular, and can be embodied for example as a plasterboard panel, for example for an intermediate ceiling or a wall covering.

In one embodiment, the profiled components are designed as metal profiles, wherein the profiled components are manufactured in particular from aluminum or an aluminum alloy material. The metal profiles can be extruded, for example, whereby even profiled components of complicated cross-sectional geometry are producible economically.

In one embodiment, the busbar is arranged in or at one of the profiled components or is formed in or at the profiled component in such a way that the busbar is accessible from the interior. In this way, accessibility for the supply of the light providing device is ensured, while at the same time the busbar can be hidden well in the interior, in such a manner that it cannot be seen from the visible side of the ceiling.

In particular, at least one of the profiled components or both profiled components can be designed in each case with a receptacle region for receiving the busbar.

In accordance with an embodiment of the invention, the busbar is designed as a two-phase busbar. In this configuration, the busbar is thus constructed relatively simply.

In one development, the busbar is configured for supplying the light providing device(s) with electric current at a voltage of 48 volts.

In particular, the busbar can run substantially parallel to the light exit region. In this way, a supply of current for the light providing device(s) can always be made possible reliably along the light exit region.

In one embodiment, the lighting arrangement comprises a line, in particular a cable, provided for supplying the light providing device, and also a connection adapter, which is electrically coupleable to the busbar. In this case, the line electrically couples the connection adapter to the light providing device. A flexible positioning of the light providing device relative to the connection adapter coupled to the busbar is possible in this way. The line may be designed to be pliable and flexible in this case.

In one advantageous development, provision can be made for arranging, on both longitudinal sides of the light exit region, in each case at least one busbar for the supply of the light providing device in the interior of the channel. Consequently, the length of the line which is to be arranged within the channel can be kept short, and the supply of current for the light providing device is accomplished even more simply and flexibly.

In one development, the connection adapter is equipped with one or more latching device(s), which enables or enable a latching coupling, which coupling may be re-releasable, of the connection adapter to one of the profiled components. Consequently, the connection adapter can be mechanically held in a simple manner at the profiled component equipped with the busbar.

In accordance with one embodiment of the invention, the line is designed in such a way that it can be magnetically coupled to a constituent of the channel and thereby be held and/or guided within the interior. This configuration, too, in combination with the busbar, in turn makes it possible to contribute to the flexible, free positionability of the light providing device, since, as a result of the magnetic coupling of the line to the channel and the line guidance obtained thereby, said line, depending on the positioning of the light providing device, can be arranged and held precisely where it results in the least disturbance. In particular, the line is prevented from hanging down into the light cone or light beam provided by the light providing device. This also considerably facilitates the arrangement of a plurality of light providing devices within the interior and the positioning thereof.

The line for the supply of the light providing device can be in particular a cable for supplying the light providing device with electric current. In the case of a plurality of light providing devices, each of them may have a dedicated supply line of this type.

In one embodiment, the line for the magnetic coupling to the constituent of the channel can be provided with a sheath containing one or more magnetic components, or the line can be provided with one or more magnetic holding elements along the longitudinal extent.

In accordance with an embodiment, the connection adapter or the light providing device comprises a device which makes it possible to wirelessly receive control signals for switching and/or controlling the light emission of the light providing device. By way of example, the device can be configured to receive and process further such control signals in accordance with the Zig Bee specification.

In one development, the lighting arrangement comprises a plurality of light providing devices, wherein each of the light providing devices is freely positionable at least within a region of the interior. In particular, the lighting arrangement can comprise for example two, three or four or even significantly more light providing devices. In this way, by way of example, a plurality of objects at different locations in a space can be illuminated simultaneously using the lighting arrangement. For this purpose, the plurality of light providing devices may be arranged within the interior in such a way that they can in each case emit light during operation through the light exit region toward the outside. The lighting of a plurality of articles or spatial regions is thus accomplished in a flexible and moreover discreet manner. However, it is likewise conceivable for exactly one light providing device to be arranged within the interior in the lighting arrangement, even though channels in particular of longer length are suitable for accommodating a multiplicity of light providing devices.

The plurality of light providing devices can be coupleable to the channel in particular in the same way. In a further embodiment, the plurality of light providing devices can be designed in particular in the same way in each case.

In a further embodiment, the lighting arrangement comprises differently designed light providing devices. In particular, in this case, each of the light providing devices is freely positionable at least within a region of the interior. Consequently, the diversity of lighting effects that can be achieved using the lighting arrangement can additionally be increased.

In particular, in one embodiment, it is conceivable to provide light providing devices that are designed differently, but are coupleable to the channel in the same way.

In accordance with one embodiment, the light providing device comprises a soft component, which makes contact with the channel when the light providing device is coupled to the channel. In particular, the soft component can be designed as a felt element. The soft component contributes to reduction of noise upon the coupling of the light providing device to the channel, and can also contribute to protecting the inner surfaces of the channel against superficial damage, for example as a result of scratching. Moreover, it also becomes possible to carry out positioning and variation of the positioning without damage and with low noise.

In one development, in addition to the free positionability of the light providing device the light providing device is furthermore alignable and/or adjustable as necessary for altering an emission direction of the light providing device. In this way, the flexibility with regard to the lighting of a wide variety of objects or the attainment of desired aesthetic lighting effects can be improved even further. For this purpose, the light providing device can comprise for example a pivotable functional section.

In one embodiment, the light providing device, for the directional emission of light, comprises a light source having a moderately narrow emission angle or, for example, a narrow emission angle. By way of example, the emission angle of the light source can be up to approximately 25 degrees inclusive, wherein the emission angle can be for example between approximately 6 degrees and approximately 25 degrees. In one variant, it would be conceivable for the light source to have an emission angle of a maximum of 15 degrees. The use of light sources with narrow emission, in particular, enables a targeted emission of light through the light exit region toward the outside in order to illuminate a spatial region or article there in a targeted manner. An undesired illumination of the channel interior by the light providing device is avoided.

In one embodiment, the light providing device comprises a cross-sectionally round functional section. In this case, provision is made, in particular, for a diameter of the functional section to be smaller than a width of the light exit region. Such a functional section is often maneuverable and space-saving.

In an alternative embodiment, the light providing device is formed with a linearly elongated shape or comprises a functional section formed with a linearly elongated shape. In this case, the linearly elongated shape can be designed in particular in a parallelepipedal fashion. In particular, moreover, a longitudinal extent of the linearly elongated shape can exceed a width of the light exit region. With this configuration of the invention, it is possible to accomplish for example the lighting of relatively large spatial or area regions or objects using one light providing device with at the same time good reduction of glare.

By way of example, in one advantageous development, the linearly elongated shape can extend parallel to the light exit region.

In one embodiment of the invention, the lighting arrangement comprises at least one additional light providing device which is designed for arrangement thereof at least in sections within the interior and is electrically coupleable to the busbar and is coupleable to the channel for the holding of the additional light providing device. In this case, the additional light providing device is formed with a linearly elongated shape or comprises a functional section formed with a linearly elongated shape. In this way, it is possible to achieve further, additional lighting effects, for example the lighting of relatively large area or spatial regions.

The linearly elongated shape of the additional light providing device can be parallelepipedal, in particular.

In particular, in one development, provision can be made for the additional light providing device to be arrangeable in the interior in such a way that it is flush with the plate elements on the visible side of the plate elements. With this development it becomes possible to provide further lighting effects in a flexible manner and advantageously to supplement the light effects made possible with the aid of the light providing device in the interior.

In developments of the invention, in a state coupled to the channel, the additional light providing device can substantially completely or only partly fill the light exit region in a direction transversely with respect to the longitudinal direction of the channel.

In a further embodiment, in a state coupled to the channel, the additional light providing device can project from the interior through the light exit region toward the outside in such a way that the additional light providing device emits light outside the interior. By way of example, the additional light providing device can be designed as a "wall washer" for irradiating a wall or can be equipped with an opalescent light emission region situated outside the interior in the state in which the additional light providing device is coupled to the channel. Consequently, with this configuration, too, in a flexible and diverse manner further lighting effects can be created and the light effects made possible by the light providing device in the interior can be supplemented in an advantageous manner.

In further embodiments, a plurality of additional light providing devices can be provided, wherein the latter can be designed identically or differently.

In one advantageous embodiment, the lighting arrangement furthermore comprises at least one additional light source which is arranged and designed to emit light into the interior and thereby to illuminate the channel. In this way, a particularly interesting aesthetic effect can be achieved in that not just the irradiation for instance of objects situated in the space through the light exit region is made possible, rather the interior also itself gives the impression of being luminous. With a light exit region of slotlike design, it is possible to achieve the impression of an indirectly luminous, slotted light exit hole ("glowing").

In one embodiment, at least one of the profiled components or both profiled components is or are designed in each case with a receptacle region for receiving the additional light source. Consequently, the additional light source can be expediently accommodated.

In particular, in one development, the additional light source can be arranged in a manner facing the interior in a groove of the profiled component, as a result of which a body section of the profiled component is situated between the light exit region and the additional light source. Consequently, the additional light source cannot be seen from the visible side, which additionally improves the aesthetic effect of backlighting or of "glowing".

In one embodiment, the additional light source can be formed with at least one LED or an LED arrangement. The channel can thereby be illuminated in a space-saving and energy-efficient manner.

Furthermore, in one development, the additional light source can comprise a light-transmissive covering, in particular an opalescent covering. The opalescent covering can be formed for example with a plastics material, for example PMMA. This can contribute to an even more uniform illumination of the channel.

In one embodiment, an additional light source is arranged in each case on both longitudinal sides of the light exit region. By way of example, an even more homogeneous indirect backlighting of the channel can be made possible in this way.

In one embodiment, the lighting arrangement is formed with two or more units along the longitudinal direction of the channel, wherein respectively adjacent units are coupled using one connecting component or a plurality of connecting components. The units here comprise in particular in each case a channel section with sections of the profiled components and the housing component, and also at least one busbar section, and may for example comprise at least one additional light source or a section thereof.

In one embodiment, the units extend rectilinearly in each case and respectively adjacent units are coupled to one another rectilinearly or angularly by the connecting component or the connecting components.

By way of example, in embodiments of the invention, the units can be coupled to one another in a manner angled relative to one another by substantially 90 degrees, wherein other angles are conceivable in other embodiments.

In one embodiment, two or more units extend rectilinearly in each case and, furthermore, a further unit designed as a corner piece is provided and the rectilinear units are coupled to the unit designed as a corner piece in each case using the connecting component or connecting components. Consequently, in this configuration, the rectilinear units can be coupled to one another in an angular manner via the corner piece. In this embodiment, the unit designed as a corner piece comprises in particular a channel corner section. Corner pieces for a coupling of rectilinear units at an angle of substantially 90 degrees or in a manner angled by other angles are conceivable.

In particular, provision can be made of at least one connecting component for electrically coupling busbar sections of adjacent units, wherein the connecting component is equipped with latching devices that enable a latching coupling, which coupling may be re-releasable, of the connecting component to two sections of a profiled component which meet at a connecting location between adjacent units. Consequently, the connecting component can also be held in a simple manner at the profiled components equipped with the busbar sections to be coupled.

In a further embodiment, the channel is closed at end faces in each case by an end terminating piece. Consequently, light cannot emerge in an undesired manner at end faces of the channel.

In a further embodiment, the lighting arrangement comprises a feed-in line designed for feeding electric current into the busbar, in particular a cable, and also a feed-in component that is electrically coupleable to the busbar. In this case, the feed-in line electrically couples the feed-in component to a current source outside the interior. In this way, current can be fed into the busbar in a flexible manner. In particular, the feed-in line can advantageously be led through a passage opening in the end terminating piece.

In one development, the feed-in component is equipped with one or a plurality of latching device(s) which enables or enable a latching coupling, which coupling may be re-releasable, of the feed-in component to one of the profiled components. Consequently, the feed-in component can also be mechanically held in a simple manner at the profiled component equipped with the busbar.

In one embodiment, the channel is provided with at least one holding device, and may be provided with a plurality of holding devices, which is/are configured for securing the channel at a load-bearing constituent of a building structure, in particular at a bare ceiling or solid ceiling. In this case, in particular, further additional securing elements can furthermore be used if necessary, for example screws, rods, tapes, hooks, chains and/or ropes, in order to secure the channel at the load-bearing constituent of the building structure using the holding device(s). The securing can be effected in particular in a suspended manner. This configuration advantageously makes it possible to hold the channel's own weight and the weight of components of the lighting arrangement that are coupled to the channel wholly or at least partly at the load-bearing constituent of the building structure, in particular a load-bearing ceiling. In this way, it is possible for example to relieve the burden on plate elements of an intermediate ceiling.

In one development, the holding device(s) is/are designed in each case as an angular piece secured at the channel.

In one embodiment of the method, the light providing device is coupled to a constituent of the channel by magnetic force. The advantages of the coupling by magnetic force have already been mentioned above.

In one embodiment, the method furthermore comprises adjusting the light providing device by sliding displacement and/or rotation of the light providing device at the channel. As a result, the adjusting can be carried out in a particularly simple and flexible manner.

In one development of the method, the introduction of the light providing device into the interior, the coupling of said light providing device to the channel, and the positioning of the light providing device are carried out through a slotted opening that forms or comprises the light exit region, in particular after the channel has been mounted in the region of a ceiling and/or wall. This is advantageous since, during the installation of the channel, it is not yet necessary to stipulate how many light providing devices are intended to be received in the interior and how they are intended to be aligned. A highly flexible construction of the lighting arrangement becomes possible in this way.

In one embodiment, the method furthermore comprises coupling a connection adapter to the busbar in the interior of the channel, arranging a line provided for supplying the light providing device, which line electrically couples the connection adapter to the light providing device, within the interior and magnetically coupling the line to a constituent of the channel in order to hold the line within the channel. The advantages of such a magnetic coupling have likewise already been mentioned above.

In a further embodiment of the method, at least one additional light providing device is provided, which is designed for arrangement thereof at least in sections within the interior and is electrically coupleable to the busbar and is coupleable to the channel for the holding of the additional light providing device, wherein the additional light providing device is formed with a linearly elongated shape or comprises a functional section formed with a linearly elongated shape. The additional light providing device is introduced at least in sections into the interior and coupled to the channel in order to hold the additional light providing device.

In a further embodiment, the method can furthermore comprise adjusting the additional light providing device by sliding displacement and/or rotation of the additional light providing device at the channel.

In one development of the method, the introduction of the additional light providing device into the interior, the coupling of said additional light providing device to the channel, and a positioning of the additional light providing device are carried out through a slotted opening that forms or comprises the light exit region, in particular after the channel has been mounted in the region of a ceiling and/or wall. This in turn enables a very flexible construction of the lighting arrangement.

In one embodiment of the construction kit, the components for forming the channel comprise channel sections, or the components for forming the channel comprise the housing component and also the profiled components, or the components for forming the channel comprise sections of the housing component and also sections of the profiled components for forming channel sections. Moreover, in developments, the construction kit can comprise the connecting components required for the channel shape to be created and/or the holding devices for the channel.

In one embodiment of the construction kit, the construction kit furthermore comprises the at least one additional light source or sections of such an additional light source, wherein the additional light source or the sections thereof is or are provided in each case as a constituent of one of the components or as a component part secured or securable at one of the components.

In one development of the construction kit, the busbar or the sections thereof is or are secured or securable in each case at at least one of the profiled components or the sections thereof.

In a further development of the construction kit, the additional light source or the sections thereof is or are secured or securable in each case at at least one of the profiled components or the sections thereof.

In one embodiment of the construction kit, the latter can comprise the units for forming the lighting arrangement, wherein the units in each case comprise a section or sections of the housing component, of the profiled components, of the busbar(s) and, if desired, of the additional light source(s) and the units are preassembled. The units can comprise rectilinear units and in particular furthermore at least one unit designed as a corner piece.

Furthermore, in further embodiments, the construction kit can comprise a line and a connection adapter for each of the light providing devices.

Furthermore, in yet another embodiment, the construction kit can comprise at least one feed-in line and at least one feed-in component for the busbar.

In yet another development, the construction kit can contain at least one end terminating piece.

Furthermore, in a further embodiment, the construction kit can comprise at least one additional light providing device, which is designed for arrangement thereof at least in sections within the interior and is coupleable to the channel for the holding of the additional light providing device, wherein the additional light providing device is formed with a linearly elongated shape or comprises a functional section formed with a linearly elongated shape.

It should be mentioned that, in developments of the invention, the above-described embodiments concerning the coupling of the light providing device to the channel, in particular to the housing component, concerning the electrical supply of the light providing device, in particular via the line and the connection adapter provided in accordance with the embodiments explained above, and also concerning the control and/or switching of the light providing device can analogously be applied to the additional light providing device(s). The corresponding configurations of the method can also be analogously applied to the additional light providing device(s).

It should be pointed out that the abovementioned embodiments and developments of the invention can be applied to the lighting arrangement and also to the construction kit and the method according to the invention.

The above embodiments and developments can be combined with one another in any desired manner, provided that this is expedient. Further possible configurations, developments and implementations of the invention also encompass not explicitly mentioned combinations of features of the invention described above or below with regard to the exemplary embodiments. In particular, here the person skilled in the art will also add individual aspects as improvements or supplementations to the respective basic form of the present invention.

BRIEF DESCRIPTION OF THE DRAWINGS

The invention is explained in greater detail below on the basis of the exemplary embodiments indicated in the figures of the drawings, in which.

Figure 1:
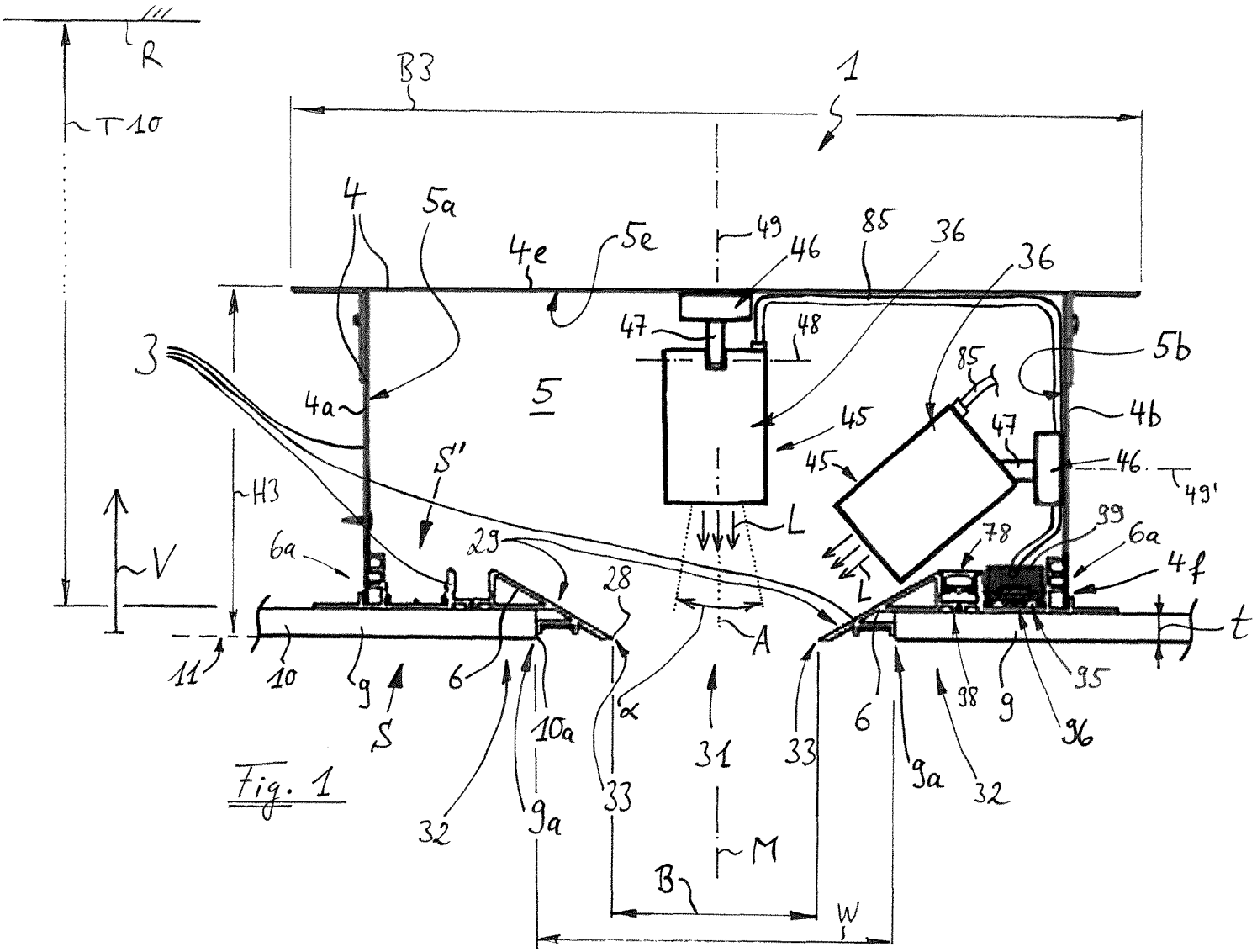
FIG. 1 shows a lighting arrangement in accordance with a first exemplary embodiment of the invention, in a cross-sectional view, comprising two light providing devices of identical type.

The accompanying figures are intended to convey a further understanding of the embodiments of the invention. They illustrate embodiments and in association with the description they serve to clarify principles and concepts of the invention. Other embodiments and many of the advantages mentioned are evident in view of the drawings. The elements of the drawings are not necessarily shown in a manner true to scale with respect to one another.

In the figures of the drawing, identical, functionally identical and identically acting elements, features and components—unless explained otherwise—are provided in each case with the same reference signs.

DETAILED DESCRIPTION OF EXEMPLARY EMBODIMENTS

FIG. 1 shows a lighting arrangement 1 in accordance with a first exemplary embodiment of the invention. The lighting arrangement 1 comprises a channel 3, which is illustrated in cross section in FIG. 1 and which is formed with a housing component 4, constructed from a plurality of parts, and two profiled components 6. The housing component 4 comprises wall sections 4*a* and 4*b* parallel to one another, and a cover section 4*e*. As a result, the housing component 4 is substantially closed at three sides, specifically by the wall sections 4*a*, 4*b* at the opposite longitudinal sides, which are aligned vertically in FIG. 1, and also by the cover section 4*e* at the top side, which is aligned horizontally in FIG. 1. In the region of the underside, the bottom side of the housing component 4 in FIG. 1, said underside being situated opposite the top side, the housing component 4 is open, that is to say has an open side 4*f*. The underside of the housing component 4 is terminated by the profiled components 6, which are arranged in the region of the open side 4*f* and are coupled to the housing component 4. For this purpose, the profiled components 6 and the housing part 4 can be secured to one another in connecting regions 6*a* in a suitable manner.

The housing component 4 is designed with a plurality of sheet-metal parts for forming the wall and cover sections 4*a*, 4*b*, 4*e*, for example composed of steel sheet. By contrast, the profiled components 6 are manufactured as elongated profiles composed of a metal material, in particular aluminum or an aluminum alloy material, e.g. by extrusion.

The channel 3 is provided for being arranged and secured behind an appropriately dimensioned slot 10*a* having a width W in a suspended intermediate ceiling 10, in particular a plaster ceiling, between the bare ceiling R and the suspended ceiling 10. The slot 10*a* can be cut into a plate element 9 of the ceiling 10 and, see FIG. 1, be delimited by edges 9*a* of the plate element 9. Alternatively, the slot 10*a* could be formed by plate elements 9 spaced apart from one another by the width W of the slot 10*a* and be delimited by respectively an edge 9*a* of one of the plate elements 9. The thickness t of the plate elements 9 can be 12.5 mm, for example, wherein modifications of the exemplary embodiment can be adapted to other plate thicknesses t.

In order to fix the channel 3 to the ceiling 10, the lighting arrangement 1 can comprise in particular suitable holding means, not illustrated in FIG. 1, which enable for example a securing of the channel 3 at intervals along the longitudinal direction 3*a* thereof. FIG. 1 also shows a visible side S of the intermediate ceiling 10 and a side S' of the intermediate ceiling 10, and thus of the plate elements 9, which faces away from the visible side S.

The profiled components 6 are configured, see FIG. 1, to be arranged in each case in sections on the side S' on the plate elements 9 and for this purpose to be placed onto the plate elements 9 from the side S', wherein in the finished state, see FIG. 1, each of the profiled components 6 engages over the edge 9*a* of the plate element 9 on which the profiled component 6 bears. After the installation of the channel 3 behind the ceiling 10, application of filler can be carried out on the visible side S for instance in the context of dry construction work.

FIG. 1 furthermore shows that the two profiled components 6, which are designed and arranged symmetrically with respect to a center axis M of the channel 3, do not touch one another at their facing edges, rather a slotted opening 28 is provided between the profiled components 6, said slotted opening forming a passage from the visible side S to an interior 5 of the channel 3. The opening 28 serves as a light exit region 31 of the channel 3. With the exception of the opening 28, the open side 4*f* of the housing component 4 is closed. In a direction transversely with respect to the longitudinal direction 3*a* (see e.g. FIG. 2) of the channel 3, the light exit region 31 is smaller than the open side 4*f* of the housing component 4. To put it another way, the light exit region 31 is narrowed in comparison with the interior 5 of the channel 3. In FIG. 1, the width of the light exit region 31, taken perpendicularly to the longitudinal direction 3*a* of the channel 3, is designated by the reference sign B. The profiled components 6 thus delimit the light exit region 31.

The lighting arrangement 1 in accordance with the first exemplary embodiment furthermore comprises two light providing devices 36 of identical type, which are shown in FIG. 1. The light providing devices 36 are dimensioned and designed in each case in a suitable manner in order to be arranged within the interior 5 of the channel 3. In the illustration in FIG. 1, both light providing devices 36 are arranged in the interior 5. The two light providing devices 36 here are situated in each case completely within the interior 5. In the first exemplary embodiment, the light providing devices 36 are designed as emitters with narrow emission or "spots". The light providing devices 36 will be explained in even greater detail below with reference to FIGS. 7-15.

The light providing devices 36 are provided in each case to emit light L during operation through the light exit region 31 directionally toward the outside, that is to say to be luminous from the interior 5 in a targeted manner through the light exit region 31. Since the plate elements 9, the profiled components 6 and the housing component 4 are light-nontransmissive in the first exemplary embodiment, the light providing devices 36 can radiate light directionally toward the outside only through the light exit region 31. What is accomplished in this way is that an object, or a spatial region, situated outside the interior 5 within the spatial area having the suspended ceiling 10 is illuminated in a targeted manner through the light exit region 31 and at the same time a particularly expedient glare reducing behavior is attained. The light providing devices 36 are virtually imperceptible to an observer situated in the illuminated spatial area, but nevertheless enable a targeted illumination of selected spatial regions, architectural features or articles situated in the spatial area. This is accomplished by virtue of the fact that the light providing devices 36, as seen from outside the interior 5, are arranged and thus "concealed" behind the profiled components 6 and the edge sections of the plate elements 9, on which the profiled components 6 bear, in the interior 5, that is to say that the light providing devices 36 are situated in a manner set back behind the ceiling 10 relative to a plane 11 forming an outer side of the ceiling 10.

A light providing device 36 such as is used in the first exemplary embodiment in FIG. 1 is illustrated in greater detail in FIGS. 7-15. The light providing device 36 comprises a cross-sectionally round functional section 45 having a substantially cylindrical basic shape and also a base section 46, wherein the base section 46 is connected to the functional section 45 via a rod 47. Via a pivoting axis 48, the functional section 45 can be pivoted relative to the base section 46, for example by 90 degrees. A diameter D of the functional section 45 is smaller than the width B of the light exit region 31, see FIGS. 1 and 10.

The light providing device 36 is designed as an emitter or "spot" and comprises a light source having a narrow emission angle $\alpha$ (see FIG. 1). In the first exemplary embodiment, the emission angle $\alpha$ is a maximum of 25 degrees. The emission angle $\alpha$ can be for example between 6 degrees and 25 degrees. By virtue of the fact that the light providing device 36 comprises a light source with narrow emission, despite the light providing device 36 being set back behind the plane 11 into the interior 5, an object outside the interior 5 can be illuminated in a targeted manner through the light exit region 31, without excessive losses occurring as a result of the illumination of the interior 5.

Each of the light providing devices 36 is coupleable to the channel 3 via the base section 46 in order to hold the light providing device 36 at the channel 3. For this purpose, the base section 46 comprises a permanent magnet 55, which is designed as a ring magnet in the exemplary embodiment shown. As described above, the housing component 4 is designed with sheet-metal parts, wherein in the first exemplary embodiment for the housing component 4 a metal sheet is chosen on which a permanent magnet can exert an attractive force. By way of example, the housing component 4 is formed with steel sheet. In the case of the cross-sectionally rectangular design of the housing component 4 having planar wall and cover sections 4*a*, 4*b*, 4*e*, wall regions 5*a* and 5*b* and also an inner cover region 5*e* of the inner surface of the housing component 4 are embodied in a planar fashion.

Using the permanent magnet 55 arranged in the base section 46, each of the light providing devices 36 can be coupled to the housing component 4 of the channel 3 by magnetic force. For this purpose, the respective light providing device 36 is secured by its base section 46 in a manner adhering magnetically at one of the inner surface regions 5*a*-5*e*. The magnet 55 can thus hold the light providing device 36 in a magnetically adhering manner both at one of the walls of the housing component 4 in the wall regions 5*a*, 5*b* and at the cover of the housing component 4 in the cover region 5*e*. This is facilitated by the planar configuration of the wall and cover regions 5*a*, 5*b*, 5*e*, which enable simple bearing of the base section 46. Each of the light providing devices 36 is thus freely positionable within the interior 5 in such a way that the respective base section 46 can be coupled in a manner adhering magnetically at an arbitrary free location of the inner surface regions 5*a*, 5*b*, 5*e*, as necessary (see FIG. 1). A free positionability of the light providing devices 36 is thus achieved in the longitudinal direction 3*a* of the channel 3; moreover, however, a free positionability is also attained in the interior 5 transversely with respect to the longitudinal direction 3*a*. This is accomplished with the aid of the magnetic coupling to the inner surface regions 5*a*, 5*b*, 5*e*, of which the inner surface region 5*e*, in the exemplary embodiment depicted schematically, extends substantially parallel to the plate elements 9 and the inner surface regions 5*a*, 5*b* extend substantially perpendicularly to the plate elements 9. It goes without saying that collisions between two light providing devices 36 can be avoided by suitable arrangement thereof in the interior 5.

The light providing devices 36 can thus be positioned freely at the channel 3 within the interior 5, or at least one region thereof. In FIG. 1, one of the light providing devices 36 is coupled to the housing component 4 by way of example in the cover region 5*e*, while the other light providing device is coupled to the channel 3 in the wall region 5*b*.

On account of the securing using the magnetic coupling to the housing component 4, the light providing devices 36 can be slidingly displaced and rotated at the housing component 4, without the position of a light providing device 36 within the interior 5 being restricted to one or more discrete positions. Rather, the positions of the light providing devices 36 are continuously variable. Consequently, a diversity of different arrangements of a plurality of light providing devices 36 becomes possible.

An edge of each of the profiled components 6 forms a boundary 33 for the light exit region 31 along a respective longitudinal side 32 thereof. Adjacent to the boundary 33 of the light exit region 31, each of the profiled components 6 is designed in a beveled fashion, as a result of which, in the completed lighting arrangement 1, see FIG. 1, a region 29 is formed which widens proceeding from the opening 28, and thus proceeding from the visible side S, inward, that is to say toward the interior 5. In the first exemplary embodiment, the boundaries 33 run parallel to one another, as a result of which the region 29 widens inward in the same way at every point as seen over the length of the channel 3. This prevents the emission of light by the light providing devices 36 from being impeded by the profiled components 6 if the light providing devices 36 are positioned relative to the opening 28 in a laterally offset manner behind partial regions of the profiled components 6, for instance in the vicinity of one of the wall sections 4*a* or 4*b*.

In FIG. 1, the functional section 45 and also the base section 46 and the rod 47 are situated completely within the interior 5. The light providing devices 36 in FIG. 1 are freely positionable in each case as a whole within the interior 5, and magnetically securable at a chosen location within the interior 5, and the light providing device 36 is moreover alignable within the interior 5, for example by the pivoting of the functional section 45 about the pivoting axis 48. By pivoting of the functional section 45, a light providing device 36 coupled to the cover section 4*e* can be luminous out of the light exit region 31 for example at an inclination with respect to a vertical direction V. By way of example, a pivoting of the functional section 45 is illustrated in FIG. 1 for the light providing device 36 magnetically coupled to the wall section 4*b*. A further alignment can be effected by rotation about a surface-normal axis 49 by the sliding of the base section 46 on the cover region 5*e* of the inner surface or about a surface-normal axis 49' by sliding on the wall region 5*b*. By such adjustment of the functional section 45, the emission direction A of the light providing device 36 can thus be altered flexibly as required, in addition to the free positionability of the light providing device 36.

The light providing devices 36 in FIG. 1 are thus freely and arbitrarily positionable within the interior 5 of the channel 3, rotatable about the axis 49 or 49' and pivotable about the axis 48, such that light L can be emitted directionally through the opening 28 toward the outside.

The base section 46 is, see FIGS. 7 to 15, of substantially cylindrical outer basic shape, wherein the base section 46 comprises a soft component 64 on a planar end side facing away from the functional section 45, wherein said soft component may be designed as a circular felt disk in the exemplary embodiment in FIGS. 7-15. Upon the coupling of the light providing device 36 to the channel 3 using the permanent magnet 35, the soft component 64 makes contact with the cover region 5*e* or one of the wall regions 5*a*, 5*b* of the inner surface of the housing component 4. Noises when the light providing device 36 is inserted into the interior 5 and when said light providing device is coupled to the channel 3, and also noises and damage at the inner surface regions 5*a*, 5*b*, 5*e* of the housing component 4 during the displacement or rotation of the base section 46 in the state magnetically coupled to the housing component 4 can be avoided by the soft component 64.

Figure 14:
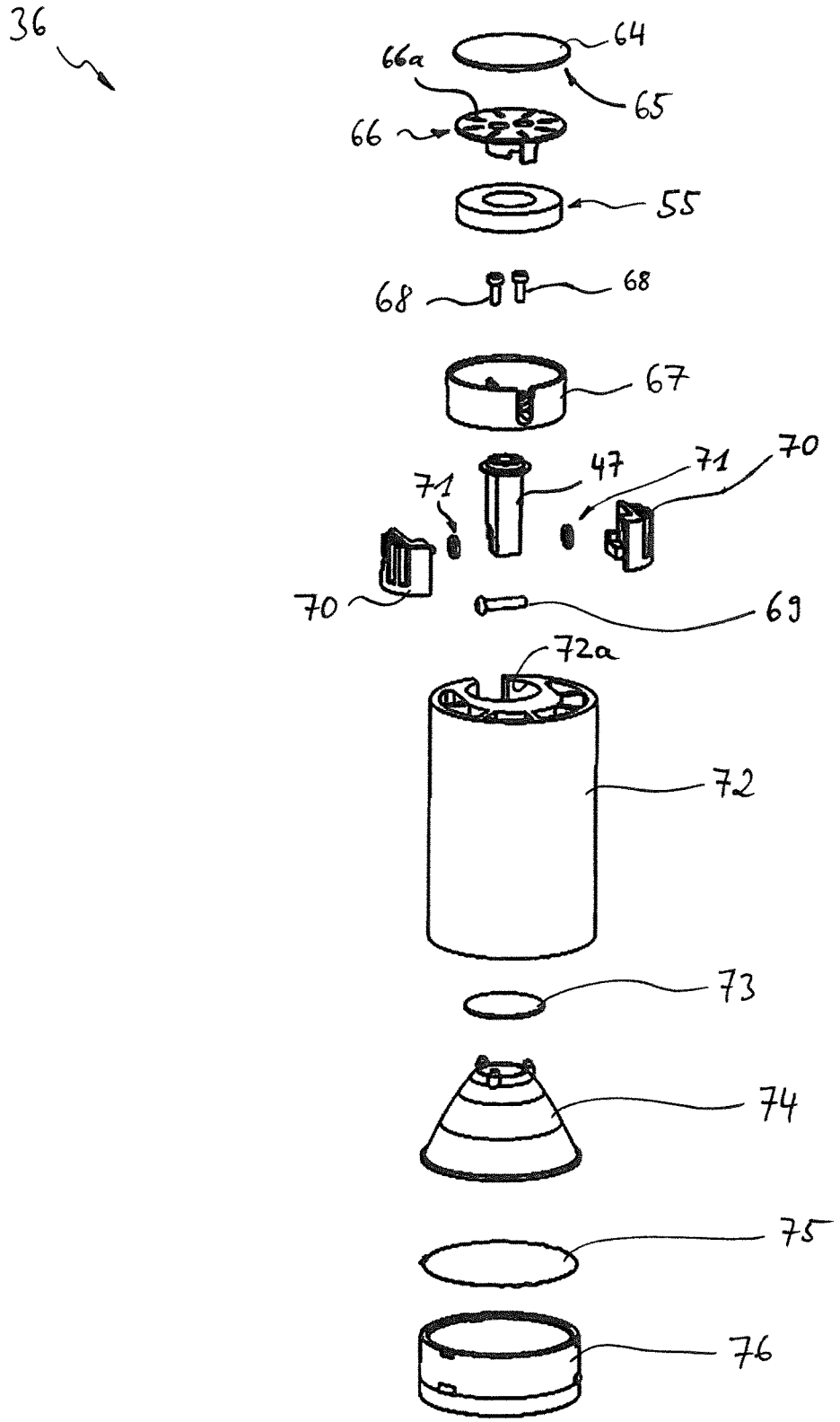
FIG. 14 shows an exploded view of the light providing device from FIG. 7.
Figure 15:
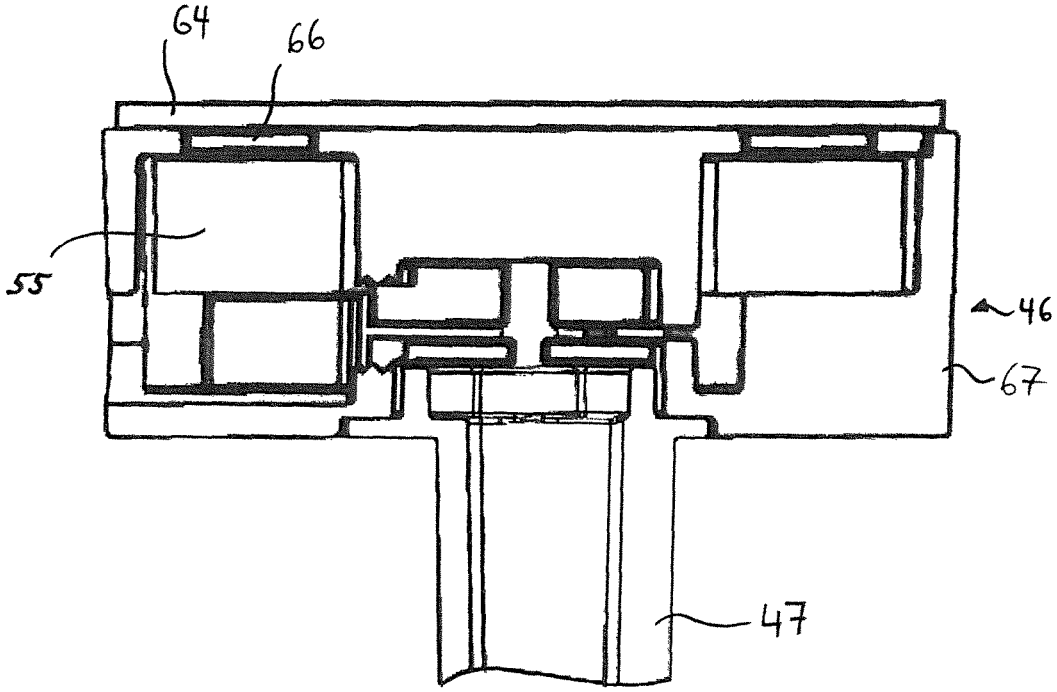
FIG. 15 shows an enlarged view of a base section of the light providing device from FIG. 7.

The view in FIG. 14 shows individual parts of a light providing device 36 from FIGS. 7-13 and 15. The base section 46 is formed with a round base housing component 67, which receives the permanent magnet 55 embodied as a ring magnet. The ring magnet 55 is clamped in the base housing component 67 in FIG. 14 from above by a part 66 that is disklike in sections and is provided with perforations or holes 66*a*, wherein the part 66, the magnet 55, the base housing component 67 and the rod 47 are held together by screws 68. The part 66 can moreover snap in place at the base housing part 67. The soft felt element 64, which enables easy, damage-free and low-noise sliding, is adhesively bonded at its underside 65 to the disklike section of the perforated part 66. The part 66 can be manufactured from plastic, for example, and the base housing part 67, the rod 47 and the shell parts 70 can be manufactured for example from metal, for instance aluminum. The perforations or holes 66*a* improve the attained magnetic holding effect of the magnet 55.

The functional section 45 is formed with a heat sink 72, an LED module 73 for generating light, an optical unit 74 comprising, for instance, a lens and/or a reflector, a film 75 for the purpose of optical enhancement, and furthermore a glare reducing ring 76. In order to connect the functional section 45 to the base section 46 using the rod 47, the shell parts 70 are held with frictional engagement in a cutout of the heat sink 72, wherein the shell parts 70 are connected to the rod 47 using a screw 69 and washers 71. Moreover, the pivoting axis 48 is realized by the screw 69. The narrow emission angle $\alpha$ of the light providing device 36, as already mentioned, is made possible with the aid of the optical unit 74.

The number of light providing devices 36 arranged within the interior 5 can vary for example depending on the lighting requirement and/or depending on the installed length of the channel 3. A varying number of light providing devices 36 can be arranged within the interior 5. In the case of a channel 3 extending transversely through a space in the cover region and thus in the case of an elongated slotlike light exit region 31, a multiplicity of light providing devices 36 can be accommodated in the interior 5 in such a way that they can emit light L directionally toward the outside.

Moreover, electrical lines 85, in particular cables, which serve in each case to supply current to one of the light providing devices 36, are depicted schematically in FIG. 1. Each of the lines 85 is situated within the interior 5.

The lighting arrangement 1 in FIG. 1 furthermore comprises, in the interior 5 of the channel 3, a busbar 95 designed for the supply of the light providing devices 36, to which busbar each of the light providing devices 36 can be electrically coupled separately by themselves and at a position chosen individually in each case according to the positioning of the light providing device 36.

The busbar 95 is arranged at one of the profiled components 6 in such a way that the busbar 95 is accessible from the interior 5 in order to be able to supply the light providing device 36 with current. It is also evident from FIG. 1 that the busbar 95 is arranged laterally with respect to the slotlike opening 28, and thus laterally with respect to the light exit region 31. In this way, with the aid of the arrangement of the busbar 95 and the shaping of the profiled component 6, what is achieved is that the busbar 95 cannot be seen by an observer from the visible side S. This is particularly advantageous from an aesthetic standpoint and enables a simple, discreet appearance of the lighting arrangement 1.

The busbar 95 may be designed in a two-phase fashion, is configured to supply the light providing devices 36 with electric current at a DC voltage of 48 volts, and is received in a suitable groovelike receptacle region 96 formed at the profiled component 6. In this case, the busbar 95 runs parallel to the light exit region 31 and to the boundaries 33 thereof. The busbar 95 can be connected to an electrical grid for example via a transformer, not shown in the figures.

Each of the two light providing devices 36 in FIG. 1 is electrically connected, via an assigned one of the electrical lines 85, to a connection adapter 99 respectively assigned to the light providing device 36. This is depicted schematically only for one of the light providing devices 36 in FIG. 1. In this case, the connection adapter 99 serves as a tapping device, which is electrically coupleable to the busbar 95, in order to tap off electric current from the busbar 95.

In order to be able to supply each of the light providing devices 36 with electric current, a line 85 is provided for each of the light providing devices 36. The supply line 85 is designed in each case in such a way that it can be coupled magnetically to the channel 3, namely to the ferromagnetic housing component 4, whereby the line 85 is guided and held at the inner side of the housing component 4 on its way from the connection adapter 99 to the light providing device 36, a sagging of the supply line 85 is avoided, and, as a result, the supply line 85 is also prevented from hanging down undesirably into the light beam or cone respectively generated by the light providing devices 36. FIG. 1 shows how, by way of example, a supply line 85 is magnetically guided along the inner surface regions 5*b*, 5*e*. It goes without saying that supply lines 85 for further light providing devices 36 can be arranged in a similar manner.

Figure 16:
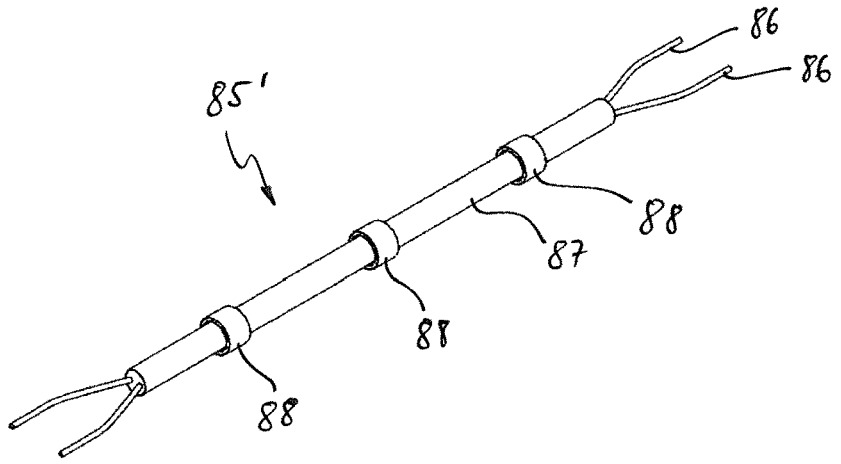
FIG. 16 shows a line which is magnetically coupleable to a constituent of the channel, said line being embodied as a cable.
Figure 17:
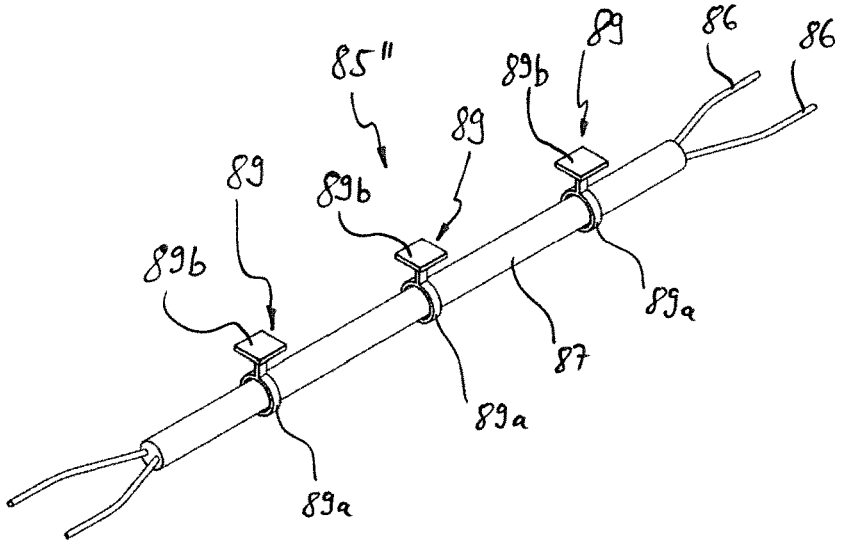
FIG. 17 shows a line which is magnetically coupleable to a constituent of the channel, said line being embodied as a cable, in accordance with one variant.
Figure 18:
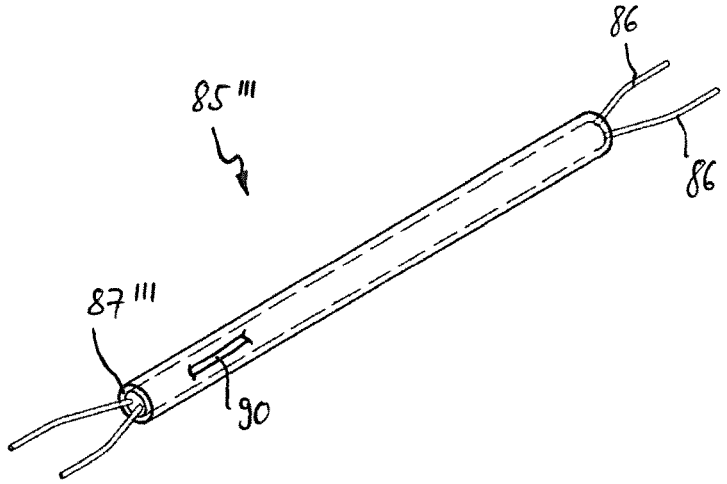
FIG. 18 shows a line which is magnetically coupleable to a constituent of the channel, said line being embodied as a cable, in accordance with yet another variant.

FIGS. 16, 17 and 18 show different variants as to how the supply line 85 can be magnetically coupled to the housing component 4, on the basis of exemplary sections of lines 85', 85", 85". The supply line 85' in FIG. 16 comprises conductors 86, a sheath 87 and also ringlike holding elements 88 surrounding the sheath 87 on the outer side thereof and secured at the sheath 87, said holding elements for their part being magnetic or a permanent magnet being embedded in each case into said holding elements. In the case of the supply line 85" in FIG. 17, clips 89 having a ringlike holding section 89*a* and a magnetic adhesion section 89*b* are formed instead of the ringlike holding elements. The adhesion section 89*b* can be a permanent magnet or a permanent magnet can be embedded into the adhesion section 89*b*. In the case of the variant in FIG. 18, the supply line 85" is provided with a sheath 87", wherein magnetic components, in the form of small individual magnets, magnetized tapes or magnetic fabrics, can be embedded into the sheath 87". Only a section of a magnetized tape 90 is illustrated by way of example in FIG. 18.

The lighting arrangement 1 in FIG. 1 furthermore comprises an additional light source 78, which, in the first exemplary embodiment, is provided only on one of the longitudinal sides 32 of the light exit region 31 and is received in a receptacle region 98 in the profiled component 6. During operation, the additional light source 78, facing the interior 5, emits light into the interior 5, as a result of which the channel 3 itself is illuminated ("glowing"). With the light providing devices 36 implementing directional emission directly through the light exit region 31, an interesting aesthetic effect thus arises wherein, in a very discreet manner, an emitter or spot emits from a slot that is itself indirectly luminous.

In the case of the lighting arrangement 1 in accordance with FIG. 1, the inner surface regions 5*a-e* and, for example, at least also the surface of the profiled component 6 in the widening region 29 are colored brightly, for example colored white, whereby the effect of "glowing" is manifested particularly well.

In a variant of the first exemplary embodiment in which additional light sources 78 are omitted and no backlighting of the interior 5 and hence no "glowing" are sought, the inner surface regions 5*a-e* and, for example, at least also the surface of the profiled component 6 in the widening region 29 can be colored dark, for example black. In the case of such a variant, it is possible to obtain the impression that the light providing device 36 is emitting from a dark hole. It is possible to achieve a different aesthetic effect, therefore, wherein the light providing device 36 appears to hover in a dark hole.

In the first exemplary embodiment, the additional light source 78 can be designed in the same way as will be explained in even greater detail further below, in particular with reference to FIGS. 33-35, in relation to the second exemplary embodiment.

Figure 2:
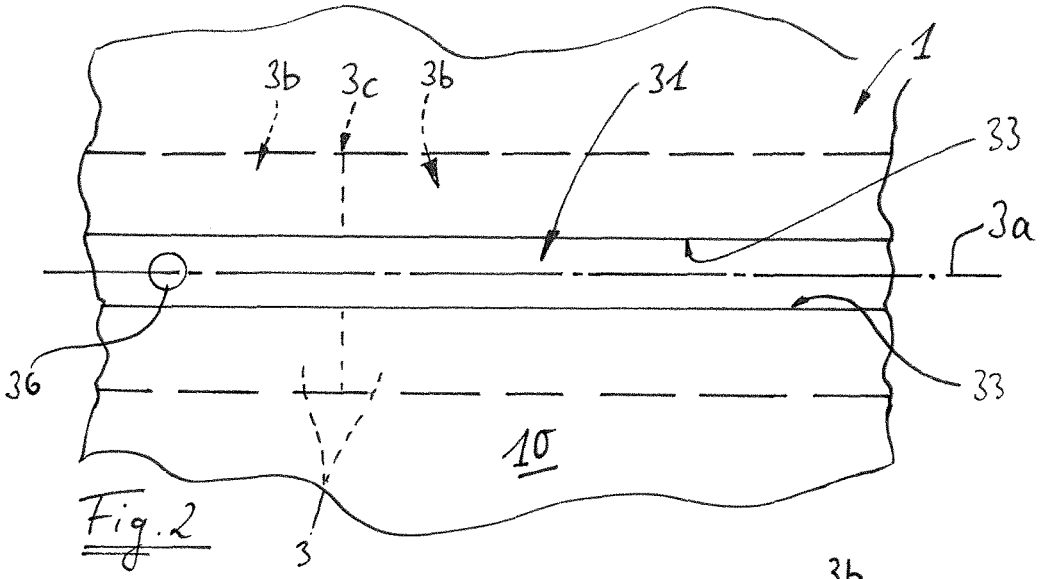
FIG. 2 shows one rectilinear section of the lighting arrangement from FIG. 1, as seen from a visible side of an intermediate ceiling.
Figure 3:
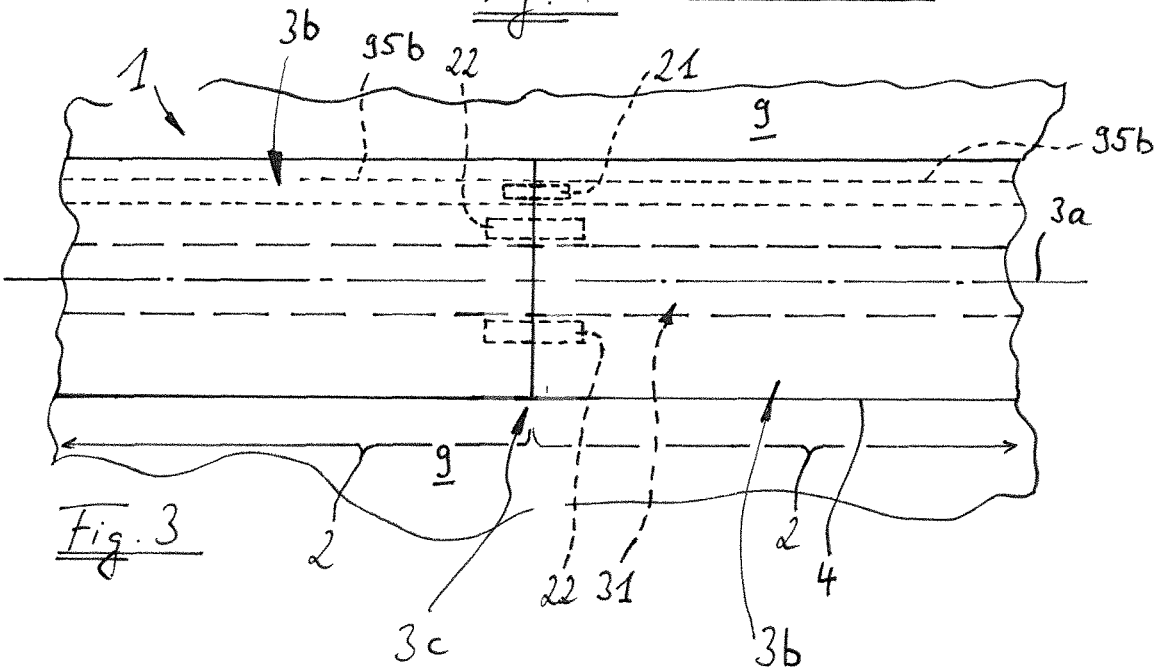
FIG. 3 shows another rectilinear section of the lighting arrangement from FIG. 1 in the region of a connecting location between two units, as seen from a rear side of the intermediate ceiling opposite to the visible side thereof.

FIG. 2 illustrates a rectilinearly running section of the channel 3 of the lighting arrangement 1 in accordance with FIG. 1 as seen from the visible side S of the intermediate ceiling 10. From the visible side S, essentially the light exit region 31 of the channel 3 is visible as an elongated slot, laterally delimited by the profiled components 6. Moreover, FIG. 2 shows by way of example a light providing device 36 that emits centrally directly through the light exit region 31. Along its longitudinal direction 3*a*, the channel 3 is constructed with a plurality of channel sections 3*b* extending rectilinearly in each case. The channel sections 3*b* are constructed in each case with a section of the housing component 4 and sections of the profiled components 6 and form, with busbar sections 95*b* and additional light sources 78 arranged therein, rectilinear units 2 which are connected to one another rectilinearly along the longitudinal direction 3*a* of the channel 3 at connecting locations 3*c*, one of which is shown by way of example in FIG. 3. The channel sections 3*b*, additional light sources 78 or sections thereof and the busbar sections 95*b* can in this case be of substantially identical length. In this way, the units can be combined to form an overall arrangement of any desired length. In order to produce the connection of adjacent units 2, connecting components 21 and 22 configured for the rectilinear connection are provided in the case of the exemplary embodiment in FIG. 3. The connecting components 21 are configured to enable the electrical coupling of adjacent busbar sections 95*b*, while the connecting components 22 serve for mechanically coupling the channel sections 3*b* adjoining one another. The number of units 2 can vary depending on the desired overall length of the channel 3, wherein the length of a unit 2 can be chosen suitably in order that the units 2 can be handled well.

Figure 4:
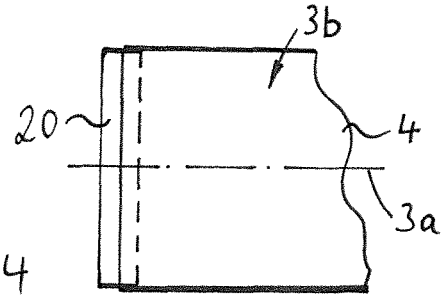
FIG. 4 shows a section of the lighting arrangement from FIG. 1 in the region of an end face of a channel, as seen in sections from an opposite side of the intermediate ceiling relative to the visible side thereof.

At end faces the channel 3 is closed by an end terminating piece 20 in each case. This is illustrated schematically and by way of example in FIG. 4.

Figure 5:
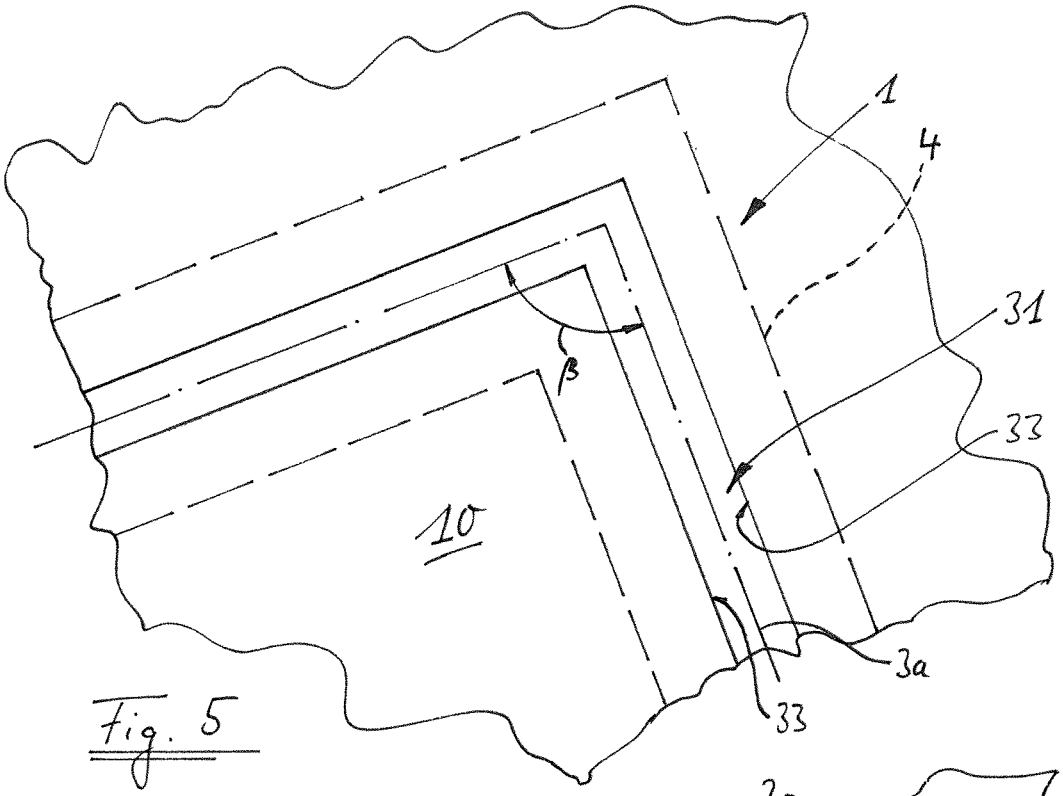
FIG. 5 shows an angled section of the lighting arrangement from FIG. 1, as seen from the visible side of the intermediate ceiling.

However, the invention enables not just lighting arrangements 1 comprising a rectilinear channel 3. Instead, individual units 2, see FIGS. 5 and 6, can be connected to one another at a connecting location 3*c* in a manner angled relative to one another, for example at right angles. As a result, a slot running in a manner angled by an angle β of 90 degrees, for example, said slot forming the light exit region 31, is obtained on the visible side S. In order to achieve such a course of the channel 3, in FIGS. 5, 6 adjacent units 2, which are in each case rectilinear but trimmed obliquely with rectilinear channel sections 3*b* are coupled at the connecting location 3*c* using suitable connecting components 21', 22', wherein the connecting components 21' are designed for the electrical coupling of busbar sections 95*b* at an angle of β=90 degrees and the connecting components 22' are designed for the mechanical coupling of the channel sections 3*b* at an angle of β=90 degrees. Correspondingly designed connecting components 21', 22' are schematically depicted by way of example in FIG. 6. In this case, the longitudinal direction 3*a* of the channel 3 as a whole thus runs in a manner angled by 90 degrees at the location 3*c*. Connections of adjacent units 2 in a manner angled by other angles β, for example by 30 degrees, 45 degrees, 60 degrees, 120 degrees, 135 degrees of 150 degrees relative to one another, are conceivable, however.

A lighting arrangement 101 in accordance with a second exemplary embodiment of the invention is described in greater detail below with reference to FIGS. 19-35. Apart from the differences described in detail below, the above explanations concerning the first exemplary embodiment also apply to the second exemplary embodiment, such that in this regard reference is made to the above explanations concerning the first exemplary embodiment.

The lighting arrangement 101 once again comprises a channel 3 formed with a housing component 104 and two profiled components 106. The profiled components 106 are manufactured, e.g. extruded, as elongated profiles composed of a metal material, in particular aluminum or an aluminum alloy material. In the case of the second exemplary embodiment, however, the housing component 104 is formed as a sheet-metal part, in the transverse direction in one piece comprising wall and cover sections 4*a*, 4*b*, 4*e*, wherein the housing component 104 is manufactured from steel sheet, for example. The cross section of the housing component 104 is rectangular with planar wall and cover sections 4*a*, 4*b*, 4*e* and also rounded corners at the transitions from the cover section 4*e* into the wall section 4*a* and 4*b*. As in the case of the first exemplary embodiment, the housing component 104, too, is substantially closed by wall sections 4*a*, 4*b* at the longitudinal sides, which run vertically in FIGS. 19 and 20, and by a cover section 4*e* on the top side, which is aligned horizontally in FIG. 20, and has an open side 4*f* in the region of the underside situated opposite the top side. The underside of the housing component 104 is terminated by the profiled components 106, which are secured at the housing component 104 in connecting regions 106*a*.

The lighting arrangement 101 comprises two differently designed light providing devices 36 and 136 by way of example in FIGS. 19, 20, 21, 22. Both the light providing devices 36 and the light providing devices 136 are dimensioned and designed in each case in a suitable manner in order to be arranged within the interior 5 of the channel 3. In the case of the second exemplary embodiment, too, both light providing devices 36, 136 are designed as emitters with narrow emission or "spots".

The light providing device 36, illustrated in FIGS. 19, 20, 21, 22, has already been explained in greater detail above with reference to FIGS. 7-15 and is designed as in the case of the first exemplary embodiment. The light providing device 136 is illustrated in greater detail in FIGS. 26-29, but differs from the light providing device 36 essentially in that the light providing device 136 comprises a cross-sectionally round functional section 145 having a diameter D that is designed to be longer than in the case of the light providing device 36. The electrical power of the light providing device 136 can correspond to that of the light providing device 36 or be different therefrom as necessary, e.g. can be greater than the power of the light providing device 36. The diameter D of the functional section 145 is smaller than a width B of the light exit region 31, see also FIG. 20. In the case of the second exemplary embodiment, therefore, light providing devices 36, 136 are provided which differ in their size in particular in their length in the example shown, and moreover can have different electrical powers. The diameters D of the light providing devices 36, 136 can be identical or different.

In the same way as described above for the light providing device 36 with respect to the first exemplary embodiment, the light providing devices 36 and 136 are magnetically coupleable to the housing component 104 and also positionable and alignable in order to emit in the desired direction through the light exit region 31.

The profiled components 106 each have a groove 8*a* in the connection region 106*a*, in which groove, in the assembled state of the channel 3, an edge of the housing component 104 becomes located in the region of the open side 4*f*. In this respect, see in particular FIGS. 19, 20 and 20A. Using screws 14 that are led through suitable holes in the housing component 104 and are screwed into a further groove 8*b* of the profiled component 106, said groove facing the edge of the housing component 104, the housing component 104 can be screwed to the profiled component 106 and thus be secured at the latter in the connection region 106*a*.

Furthermore, each of the profiled components 106 is equipped with channel-like grooves 8*c* and 8*d*, which in each case face the interior 5 and thus face away from that side of the profiled component 106 which becomes located on the plate element 9 in the installed state.

Figure 20A:
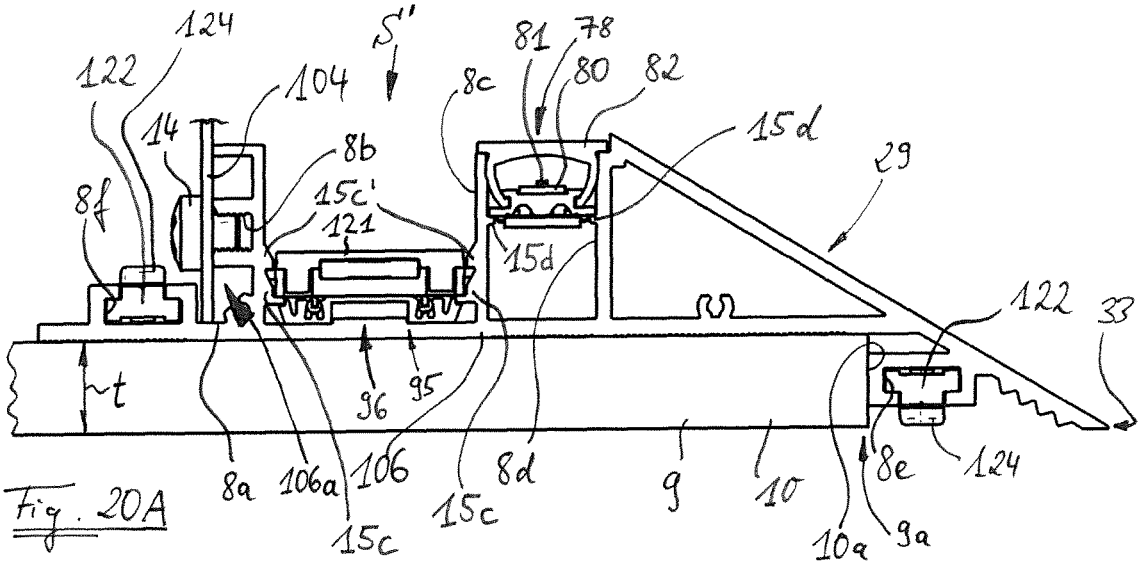
FIG. 20A shows an enlarged portion from FIG. 20 in the region of a profiled component.
Figure 23:
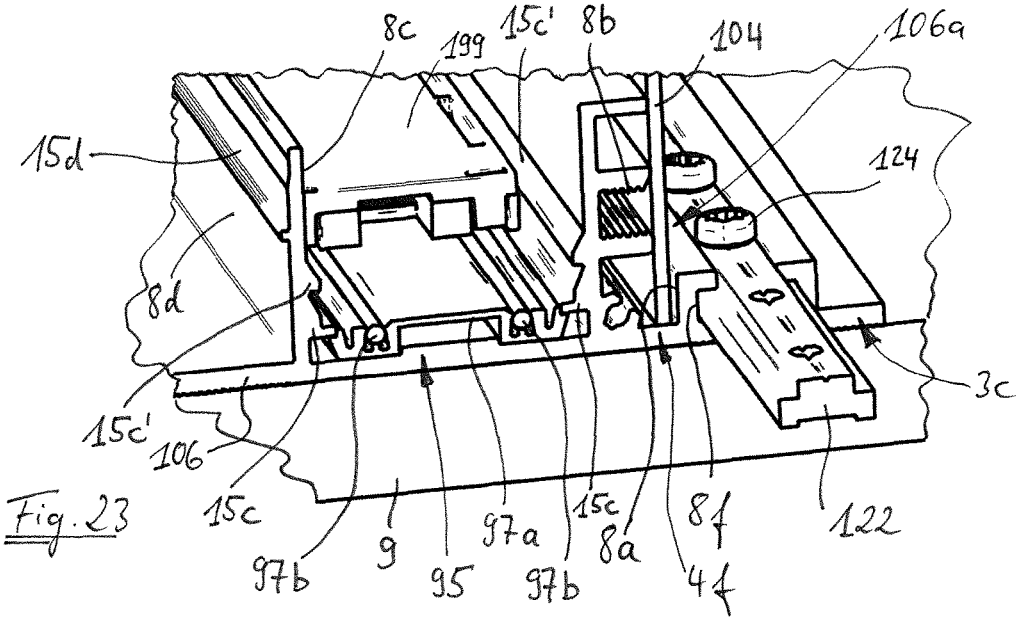
FIG. 23 shows an enlarged excerpt from FIG. 22.
Figure 24:
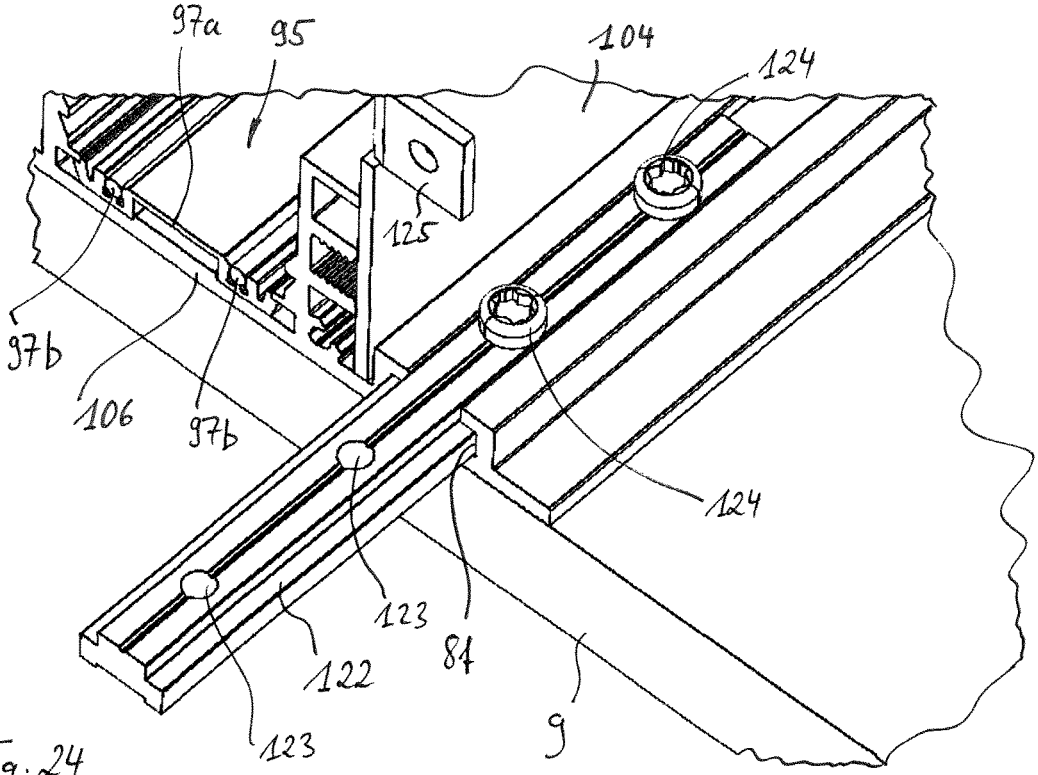
FIG. 24 shows a connecting component for mechanically connecting adjacent units, inserted into a profiled component, in the lighting arrangement in accordance with the second exemplary embodiment, as seen in perspective view from the opposite side of the intermediate ceiling relative to the visible side thereof.

The groove 8*c* receives a busbar 95 and thus forms a receptacle region 96 for the latter, see in particular FIGS. 20A and 23. The busbar 95 is embodied as a two-phase busbar and designed with a main body 97*a* and two electrical conductors 97*b*. The groove 8*c* is provided with ribs 15*c* and 15*c*' along its longitudinal direction at the opposite groove walls, in the vicinity of the base of the groove 8*c*, symmetrically with respect to the center of the groove. The main body 97*a* of the busbar 95 engages behind the lower ribs 15*c* situated opposite one another in order to hold said busbar in the groove 8*c*.

Figure 19:
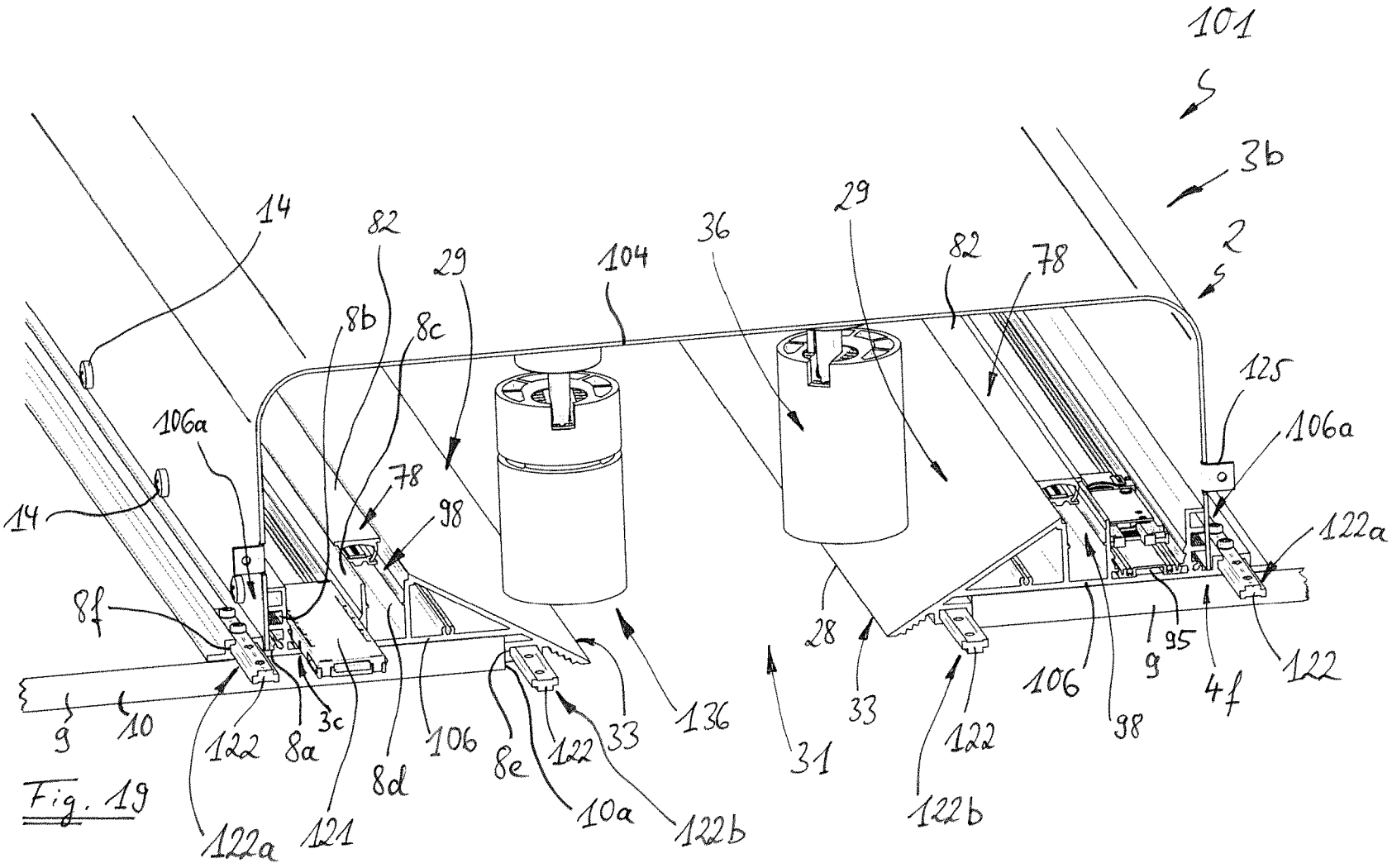
FIG. 19 shows a lighting arrangement in accordance with a second exemplary embodiment of the invention, as seen in a perspective view from the end of one unit and from an opposite side of the intermediate ceiling relative to a visible side thereof, with two different light providing devices.
Figure 20:
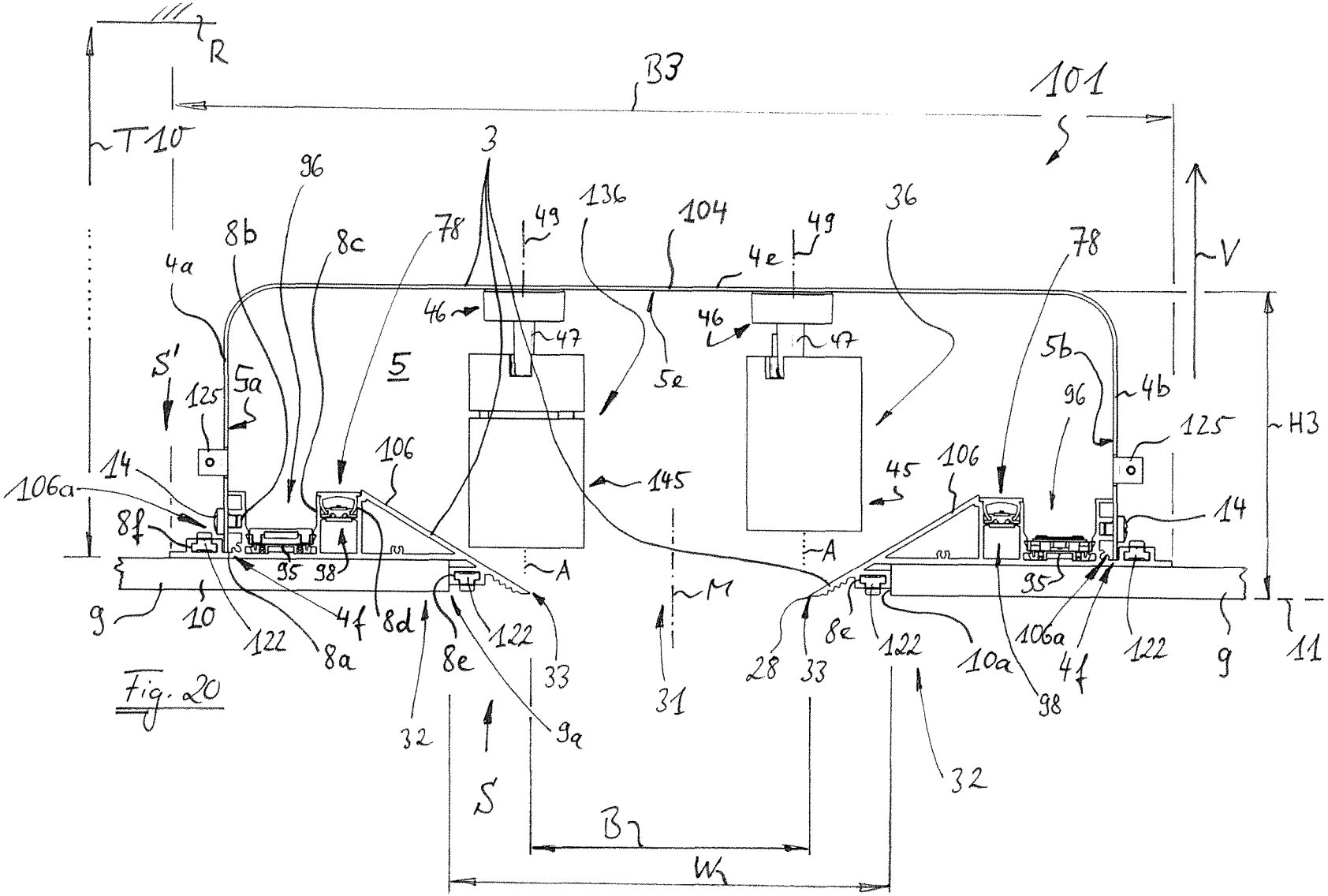
FIG. 20 shows the lighting arrangement from FIG. 19 in a cross-sectional view.
Figure 21:
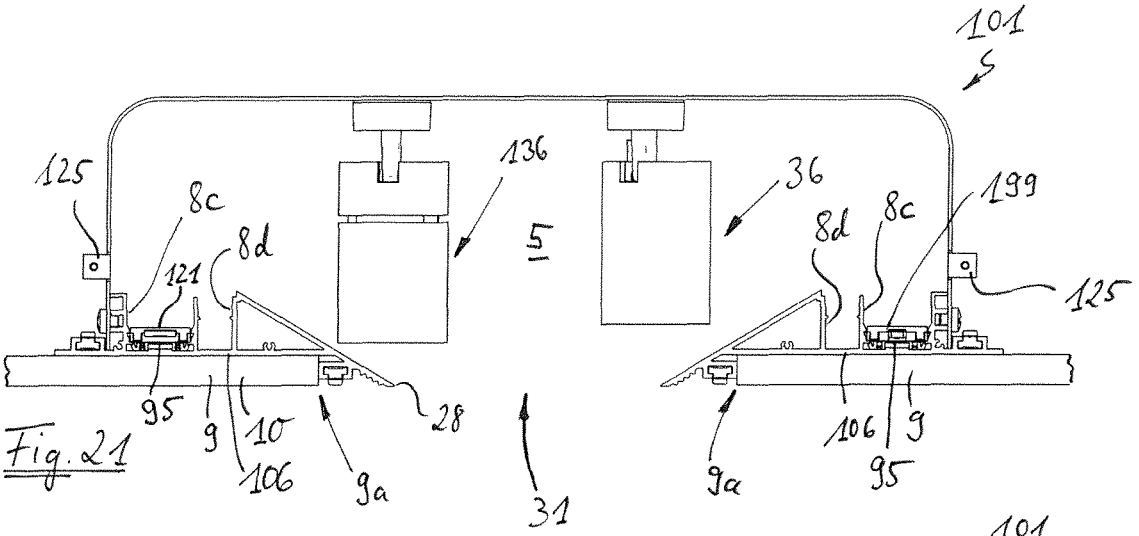
FIG. 21 shows the lighting arrangement from FIG. 19 in a cross-sectional view, wherein additional light sources for indirect backlighting are not illustrated.
Figure 22:
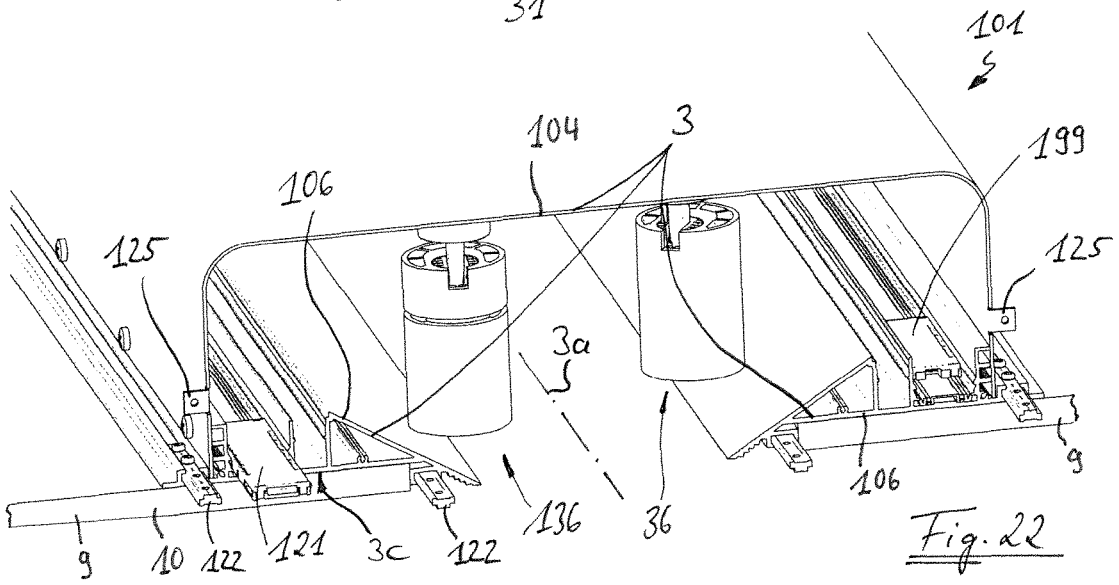
FIG. 22 shows the lighting arrangement from FIG. 19 as seen in a perspective view from the end of one unit and the opposite side of the intermediate ceiling relative to the visible side thereof, wherein additional light sources for indirect backlighting are not illustrated.

The groove 8*d* receives the additional light source 78, see for example FIGS. 19, 20, 20A, and thus forms a receptacle region 98 for the additional light source 78. In order to hold the additional light source 78 in the desired position within the groove 8*d*, the opposite groove walls of the groove 8*d* each have a rib 15*d*, wherein the ribs 15*d* are arranged symmetrically with respect to the center of the groove 8*d*, in such a way that in the mounted state a covering 82 of the additional light source 78, see the explanations further below concerning FIGS. 33-35, bears on upper edges of the groove walls of the groove 8*d*, see FIG. 20A.

Figure 33:
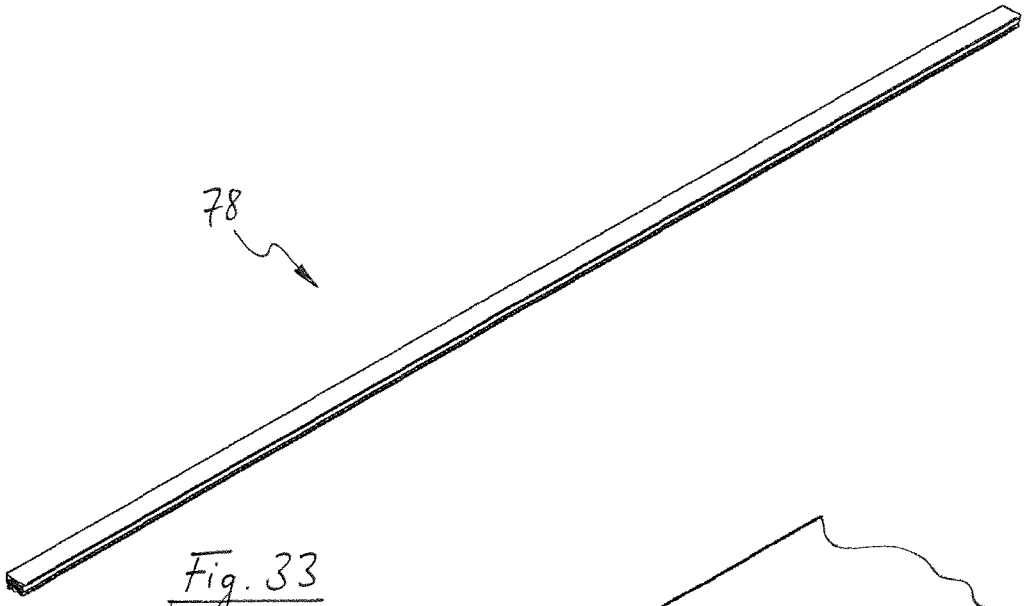
FIG. 33 shows an assembly that forms an additional light source for indirect backlighting, for the lighting arrangement in accordance with the first or second exemplary embodiment.
Figure 34:
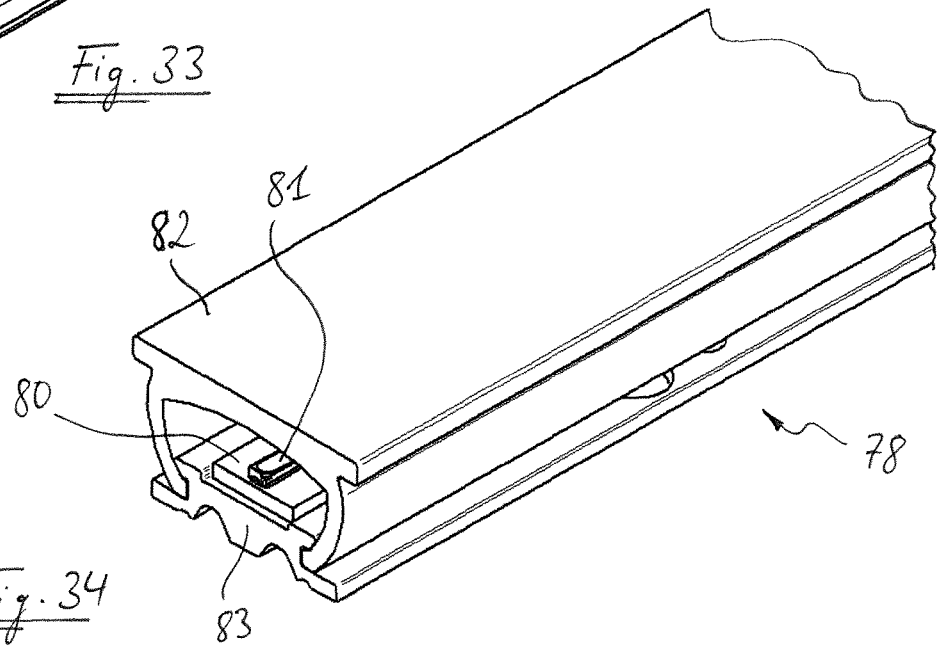
FIG. 34 shows the assembly from FIG. 33 in an enlarged view in the region of one end thereof.
Figure 35:
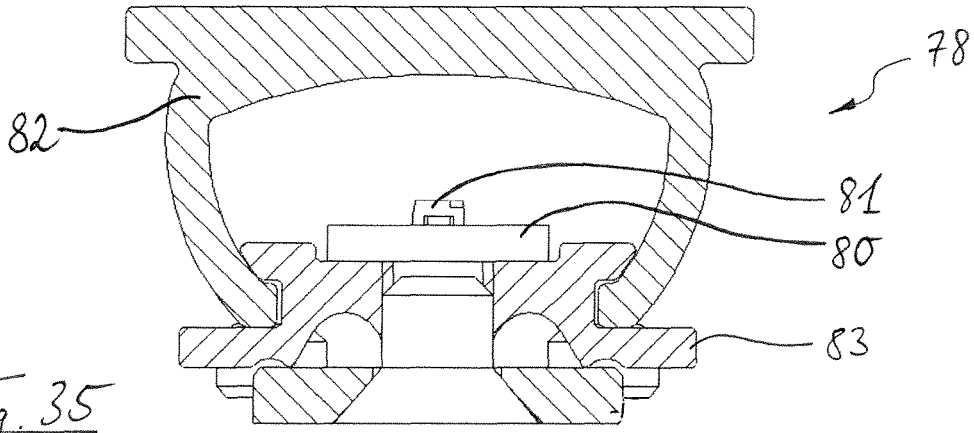
FIG. 35 shows a cross-sectional view of the assembly from FIG. 33.

The additional light source 78, which can be used both in the first and in the second exemplary embodiments of the present invention, is shown in greater detail in FIGS. 33-35. The additional light source 78 is designed as an elongated insert in order to be inserted into the groove 8*d*. The additional light source 78 comprises a circuit board 80, which is secured on a basic profile 83. Light emitting diodes (LEDs) 81 are arranged on the circuit board 80, only one of which diodes is visible in FIGS. 34, 35. Moreover, conductor tracks and possibly required further electronic components for the operation of the LEDs 81 can be arranged on the circuit board 80. The circuit board 80 is connected to a suitable current source in a manner not illustrated in specific detail in the figures.

The circuit board 80 and the LEDs 81 are covered, see FIGS. 34 and 35, using an opalescent covering 82, wherein the opalescent covering is designed by way of example as a profile composed of a suitable plastic, for example satin-finished PMMA. The opalescent covering 82 engages over the circuit board 80 and engages on both sides thereof into lateral longitudinal grooves of the basic profile 83.

FIG. 20 shows that, in the case of the second exemplary embodiment, two additional light sources 78 are provided, which are arranged in each case facing the interior 5 in the groove 8*d* of a profiled component 106. The light sources 78 can bear on the ribs 15*d* and/or be configured to snap in place behind the latter. Consequently, in the case of the second exemplary embodiment, additional light sources 78 are arranged on both longitudinal sides 32 of the light exit region 31. Between the light exit region 31 and each of the additional light sources 78 there is situated a section of the profiled component 106 whose groove 8*d* receives the light source 78, as a result of which the additional light source 78 cannot be seen from the visible side S.

The additional light sources 78 emit light into the interior 5 during operation, as a result of which the channel 3 is illuminated. As in the case of the first exemplary embodiment, however, direct light emission through the light exit region 31 toward the outside is not effected by the light sources 78, rather the light emitted by the light sources 78 passes to the observer only indirectly by virtue of the channel 3 being backlit. The interior 5 thereby itself gives the impression of being luminous ("glowing"). The aesthetically appealing impression of a luminous light exit slot can be achieved thereby, wherein from the luminous slot the light providing devices 36, 136 can then directionally irradiate an object situated in a space.

As in the case of the first exemplary embodiment, in the case of the second exemplary embodiment, too, in one variant thereof, the "glowing" and hence the indirect illumination of the interior 5 can be dispensed with, that is to say that the additional light sources 78 can be omitted in the case of such a variant. With regard to the coloration of the inner surface regions 5*a*, 5*b*, 5*e* and the profiled component 6, in particular in the region 29, reference is made to the above explanations concerning the first exemplary embodiment.

The provision of additional light sources 78 on both sides of the light exit region 31 and the utilization of an opalescent covering 82 contribute to a particularly uniform, homogenous, indirect backlighting of the channel 3. The additional light sources 78 can extend parallel to the light exit region 31 along the entire longitudinal direction 3*a* of the channel 3. In order to facilitate transport and mounting, the additional light sources 78 can be divided in each case into sections succeeding one another in the longitudinal direction, for instance as shown in FIG. 33.

In the case of the second exemplary embodiment, a respective busbar 95 is moreover provided on each longitudinal side 32 of the light exit region 31 and parallel to the latter. Thus, in the case of the second exemplary embodiment, the profiled components 106 are equipped symmetrically with busbars 95 and additional light sources 78.

As in the case of the first exemplary embodiment, in the case of the second exemplary embodiment, too, electric current at a voltage of 48 volts is provided using the busbars 95. This is carried out using the two conductors 97*b*, which can be connected to a suitable transformer. In the case of the second exemplary embodiment, too, each of the light providing devices 36 and 136 is electrically connected to an assigned connection adapter 199 via an electrical line 85, in each case in the form of an electrical cable. Electric current is tapped off from the conductors 97*b* of the busbar 95 by the connection adapter 199. As explained thoroughly above with regard to the first exemplary embodiment, in the case of the second exemplary embodiment, too, the supply lines 85 are designed in such a way that they can in each case be magnetically coupled to the channel 3 and in particular to the housing component 104 with the advantages mentioned above.

The connection adapter 199 is illustrated in greater detail in FIGS. 30A-G and 3I. The connection adapter 199 of substantially parallelepipedal design comprises an adapter housing 200 formed with an adapter housing part 200*a* as upper part and an adapter housing part 200*b* as lower part. The adapter housing parts 200*a* and 200*b* are formed in each case with a plastics material. A printed circuit board 191 is clamped in between the plastic adapter housing parts 200*a* and 200*b*. In one variant of the second exemplary embodiment, a device 192 that makes it possible to wirelessly receive control signals for switching and/or controlling the light emission of the light providing device 36 or 136 can be arranged on the printed circuit board 191. Further devices can be provided on the printed circuit board 191, in particular a computing device for processing the control signals and/or a driver component in order to vary the intensity of the light emission by the light providing device 36 or 136 in accordance with the control signals. In particular, the device 192 can be a ZigBee module, or the device 192 can be part of such a module arranged on the printed circuit board 191. In one variant, however, instead of being integrated into the connection adapter 199, the device 192 could be integrated into the light providing device 36 or 136 itself.

The connection adapter 199 is equipped with two movable snap-action hooks 201 in the region of one of its ends at the opposite longitudinal sides of the connection adapter 199. Furthermore, an actuation element 203 is provided on the end face in the region of the end of the connection adapter to which the snap-action hooks 201 are adjacent. As a result of the actuation element 203 being pushed in, the snap-action hooks are withdrawn or retracted into the adapter housing 200. A suitable mechanism can be provided within the adapter housing 200. Moreover, two latching lugs 202 additionally protrude at the other end of the connection adapter 199, likewise at the opposite longitudinal sides thereof.

The snap-action hooks 201 and latching lugs 202 form latching devices that make it possible to couple the connection adapter 199 in a latching and re-releasable manner to the profiled component 106 in the region of the groove 8*c*. For this purpose, the snap-action hooks 201 and latching lugs 202 engage behind the ribs 15*c*', which are of beveled design at their top side, whereby the connection adapter 199 is held at the component 106, see e.g. FIG. 23. If the actuation element 203 is actuated for releasing the connection adapter 199 from the groove 8*c*, the snap-action hooks 201 retract into the adapter housing 200 and are disengaged from the rib 15*c*'.

The connection adapter 199 can thus be inserted into the groove 8*c* at an arbitrary, freely selected location along the channel 3, in order to tap off current from the busbar 95 and to supply a flexibly positionable light providing device 36 or 136 with current. In order to produce an electrical contact with the conductors 97*b* of the busbar 95, the connection adapter 199 comprises contact elements 204 designed in a pinlike fashion or as "tapping pins", wherein the contact elements 204 are in contact with a respective one of the conductors 97*b* after latching securing of the connection adapter 199 in the groove 8*c*.

Figure 31:
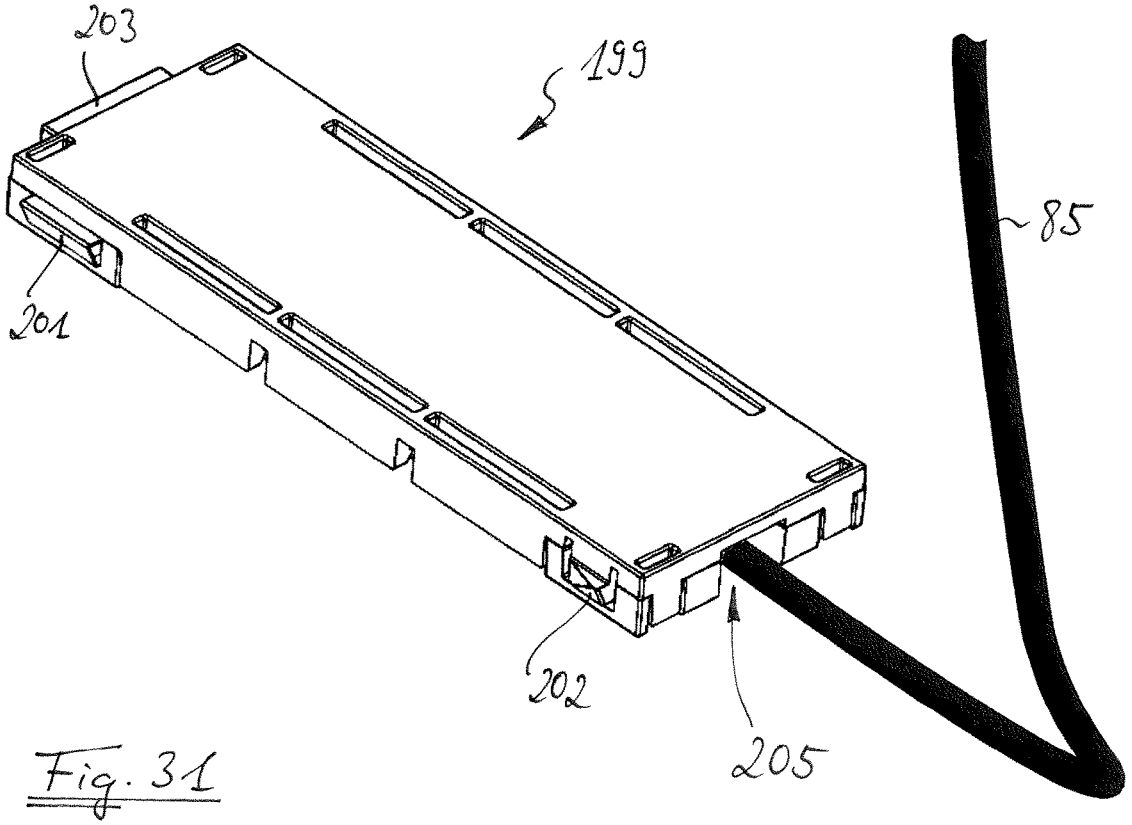
FIG. 31 shows the connection adapter from FIG. 30A in a perspective view from above as in FIG. 30F, with a line for coupling the connection adapter to a light providing device.
Figure 30G:
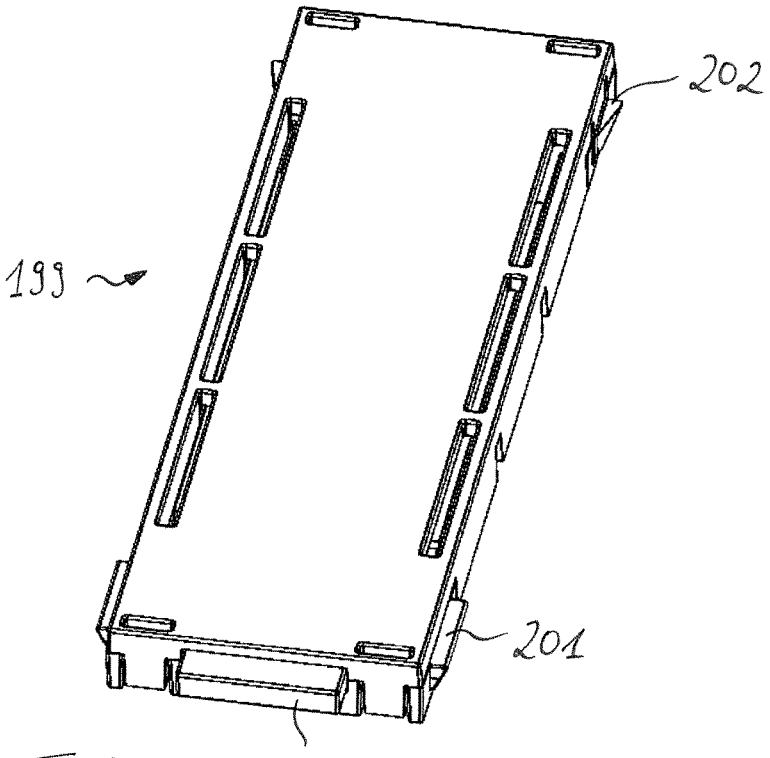
FIG. 30G shows the connection adapter from FIG. 30A in a further view perspectively from above.

FIG. 31 furthermore shows the line 85 for supplying the light providing device 36 or 136. The line 85 enters the adapter housing 200 in an entrance region 205, wherein a strain relief mechanism for the line 85 is integrated into the plastic adapter housing parts 200*a*, 200*b*.

In the case of the second exemplary embodiment, too, the lighting arrangement 101 can be formed with units 2 comprising channel sections 3*b* and busbar sections 95*b* and also additional light sources 78 or sections thereof, which extend in particular in each case over the length of the unit 2. In the case of the second exemplary embodiment, too, the units 2 are connected to one another with the aid of connecting components 121, 122, for example rectilinearly as already explained above with reference to FIGS. 2, 3.

The connecting components 121 are configured to electrically connect busbar sections 95*b* of adjacent units 2 to one another. For this purpose, at a connecting location 3*c* a connecting component 121 is inserted into the groove 8*c* in such a way that it engages over the connecting location 3*c*. See FIGS. 19 and 22, for example. The connecting component 121 is illustrated in greater detail in FIGS. 32A-F.

The connecting component 121 comprises a component housing 220 formed with two parts, for example, wherein movable snap-action hooks 221*a*, 221*b* are arranged at the four corners of the parallelepipedal connecting component 121 at the longitudinal sides thereof. Furthermore, the connecting component 121 has in each case an actuation element 223*a* and 223*b*, respectively, at opposite end faces.

For actuation purposes, the actuation elements 223*a* and 223*b* can be pressed in, in a similar manner to the actuation element 203 of the connection adapter 199, as a result of which the snap-action hooks 221*a*, 221*b*, which protrude from the component housing 220 without actuation of the actuation elements 223*a*, 223*b*, can be retracted into the component housing 220. In this case, for example, the actuation element 223*a* can act on the snap-action hooks 221*a* at one end of the component housing 220 and the actuation element 223*b* can act on the snap-action hooks 221*b* at the other end of the component housing 220.

The snap-action hooks 221*a*, 221*b* in this case form latching devices that make it possible to couple the connecting component 121 in a latching and re-releasable manner to two mutually adjoining sections of a profiled component 106 at the connecting location 3*c*. The snap-action hooks 221*a* and 221*b* in this case engage behind the ribs 15*c*', as a result of which the connecting component 121 is held at the sections of the component 106. As a result of the actuation elements 223*a,b* being actuated, the snap-action hooks 221*a,b* can retract into the component housing 220, as a result of which the snap-action hooks 221*a,b* are disengaged from the rib 15*c*' and the connecting component 121 can be removed again.

Figure 32A:
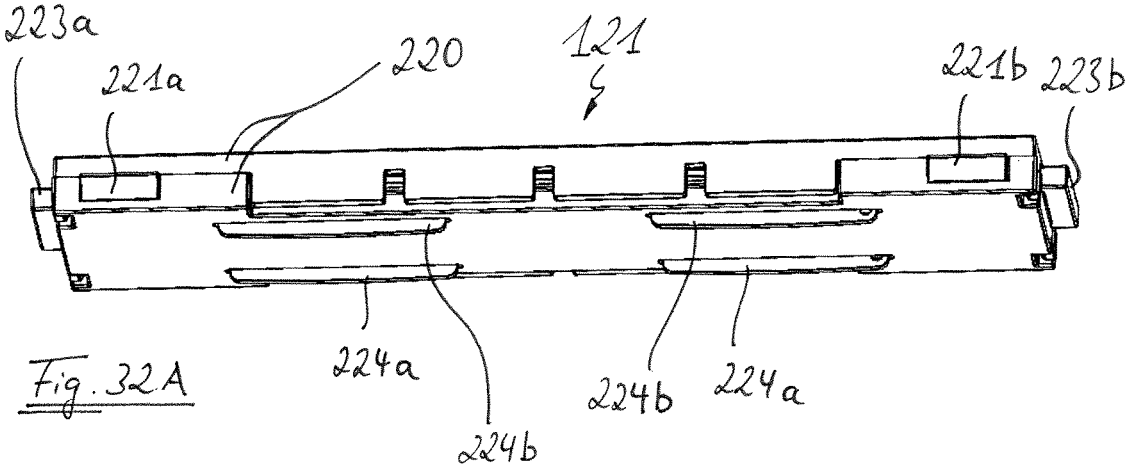
FIG. 32A shows a connecting component for electrically coupling busbar sections, for the lighting arrangement in accordance with the second exemplary embodiment, as seen in a perspective view from below.
Figure 32B:
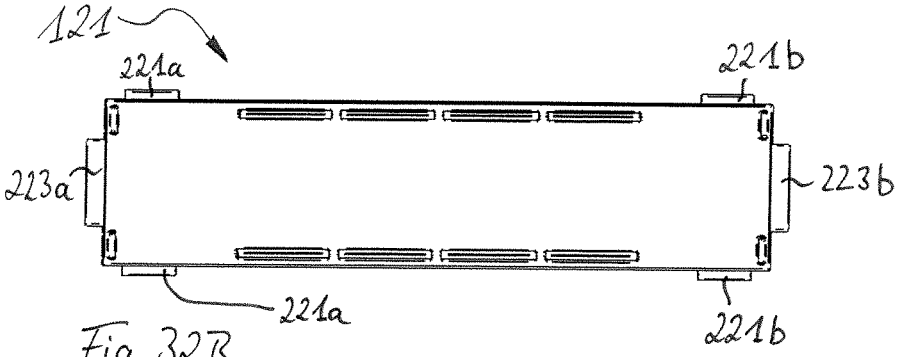
FIG. 32B shows the connecting component from FIG. 32A in a plan view.
Figure 32C:
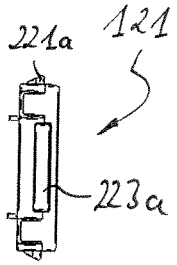
FIG. 32C shows the connecting component from FIG. 32A in an end-side view.
Figure 32D:
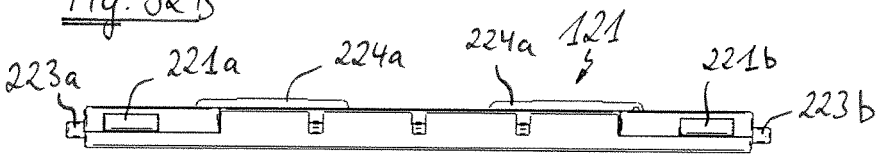
FIG. 32D shows the connecting component from FIG. 32A in a longitudinal-side view.
Figure 32E:
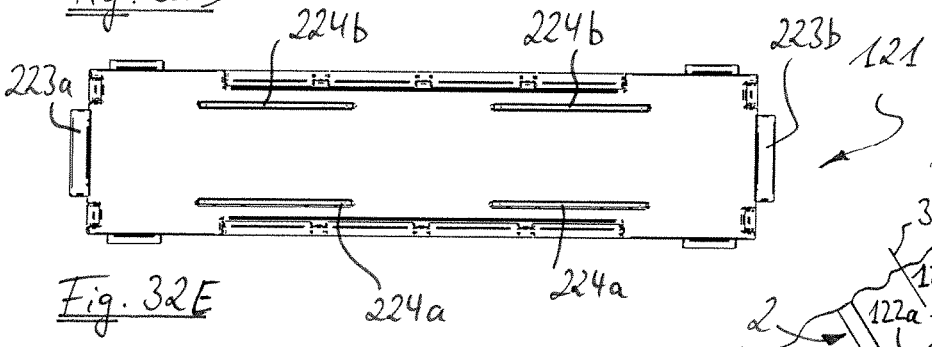
FIG. 32E shows the connecting component from FIG. 32A in a bottom view.

In order to produce an electrical coupling of the busbar sections 95*b* that meet in the connecting location 3*c*, the connecting component 121 comprises two pairs of contact elements 224*a* and 224*b*, see FIGS. 32A and 32E. The contact elements 224*a,b* make contact with the conductors 97*b* upon the insertion of the connecting component 121 into the groove 8*c* on both sides of the connecting location, in such a way that the contact elements 224*a* connect sections of one conductor 97*b* and the contact elements 224*b* connect sections of the other conductor 97*b* across the connecting location 3*c*. For this purpose, the contact elements 224*a*, on the one hand, and the contact elements 224*b*, on the other hand, are electrically connected to one another in the component housing 220.

Figure 25A:
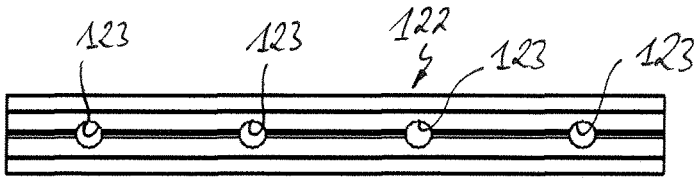
FIG. 25A shows the connecting component from FIG. 24 in a plan view.
Figure 25B:
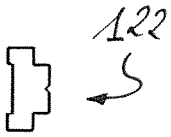
FIG. 25B shows the connecting component from FIG. 24 in an end-side view.
Figure 25C:
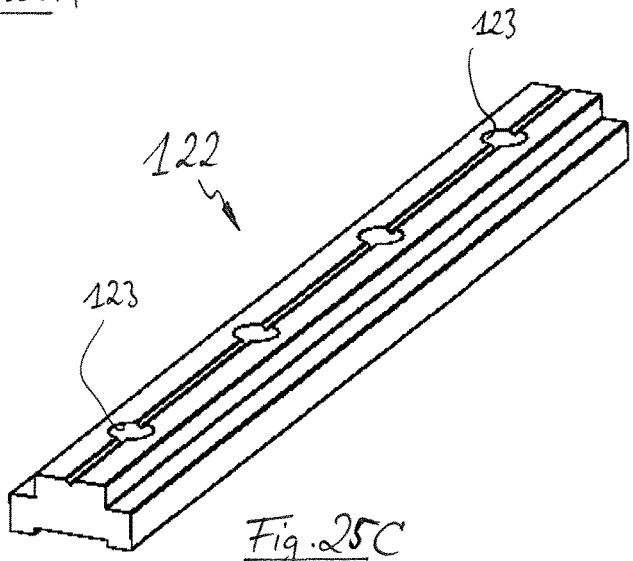
FIG. 25C shows the connecting component from FIG. 24 in a perspective view from above.

The connecting components 122 are provided for the mechanical coupling of the units 2 and are illustrated in more specific detail in FIGS. 25A-C. The utilization of the connecting components 122 is shown in FIGS. 19-24, for example. In particular, FIG. 20A clearly shows that each of the profiled components 106 is provided with two further grooves 8*e* and 8*f*, wherein the grooves 8*e*, 8*f* are embodied in each case with an undercut, that is to say that the profile of the grooves 8*f*, 8*e* is T-shaped or inverted T-shaped. Apart from the orientation, the cross section of the grooves 8*e* and 8*f* is of identical design.

The connecting component 122 is designed as a section of a profile, for example of a metal profile, having a substantially T-shaped cross section, wherein the cross section of the connecting component 122 is chosen in such a way that the connecting component can be introduced into the groove 8*e* or 8*f*. Furthermore, the connecting component 122 comprises a plurality of threaded holes 123, for example four thereof, along its longitudinal direction, into which threaded holes screws 124 can be screwed, see for example FIG. 20A, FIG. 24. In the case of the second exemplary embodiment, four connecting components 122 for mechanically coupling the units 2 are provided at each connecting location 3*c* between two units 2, see for example FIG. 20, wherein each connecting component 122 is introduced into a groove 8*e* or 8*f* of one unit 2 and into a groove 8*e* or respectively 8*f* of the other unit 2.

Of the four connecting components 122 at the connecting location 3*c*, two of the connecting components 122 are arranged in the outer area in the transverse direction of the channel 3 and are inserted into the grooves 8*f*. These outer connecting components 122 are designated by the reference sign 122*a*, see FIG. 19, for example. Two further connecting components 122 are designated by the reference sign 122*b* and are arranged in the inner area in the transverse direction of the channel 3, adjacent to the boundary 33. By the screws 124, the connecting component 122 can be secured, for example clamped, in the groove 8*e*, 8*f*. In the case of the outer connecting components 122*a*, provision can be made for the fixing of the connecting component 122 to be effected only in the corresponding groove 8*f* of one of the units 2.

Figure 6:
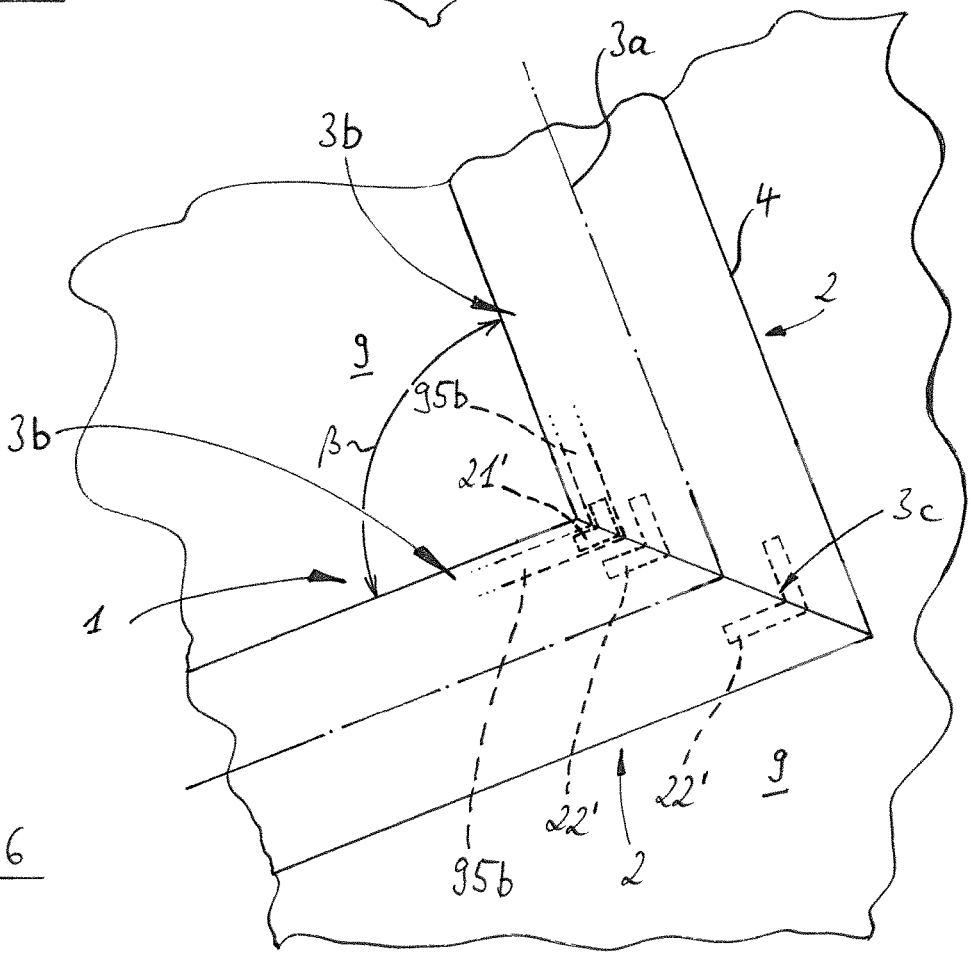
FIG. 6 shows the angled section of the lighting arrangement from FIG. 1 as illustrated in FIG. 5, as seen from an opposite side of the intermediate ceiling relative to the visible side thereof.
Figure 8:
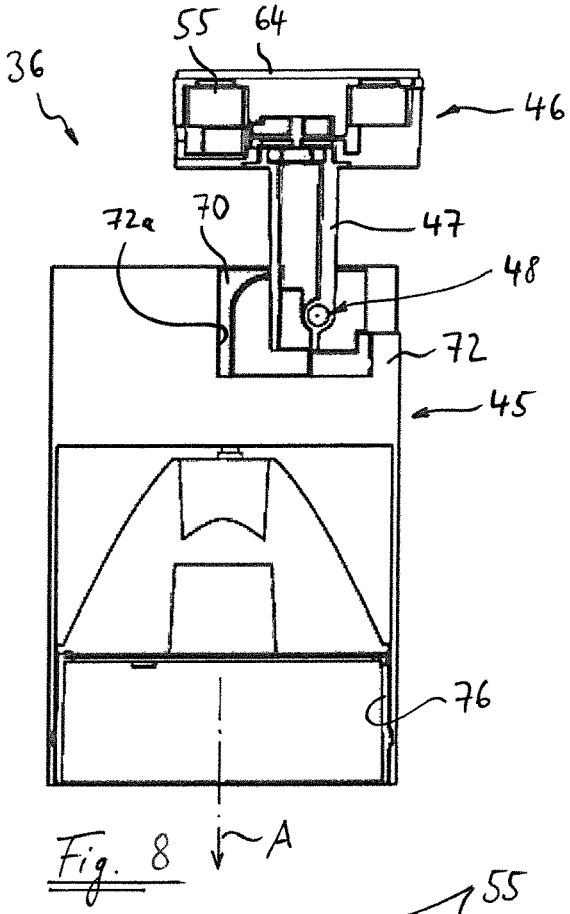
FIG. 8 shows a central section through the light providing device from FIG. 7.
Figure 7:
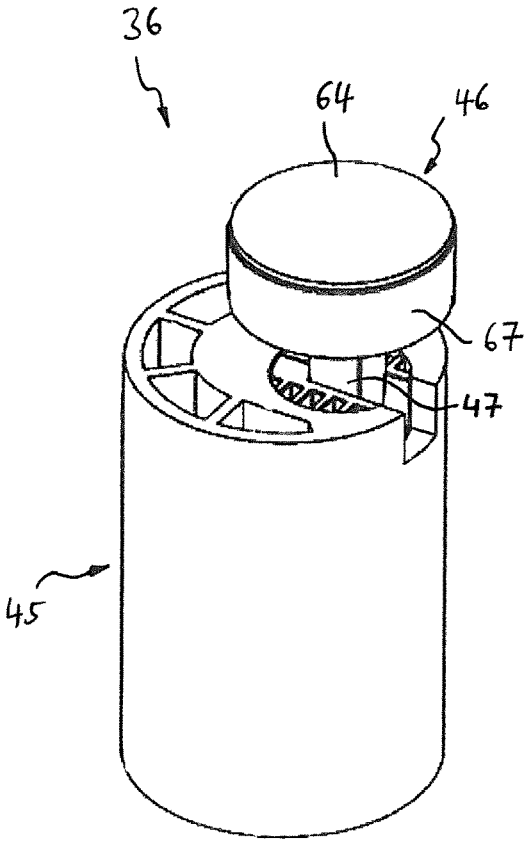
FIG. 7 shows a perspective illustration of a light providing device.
Figure 9:
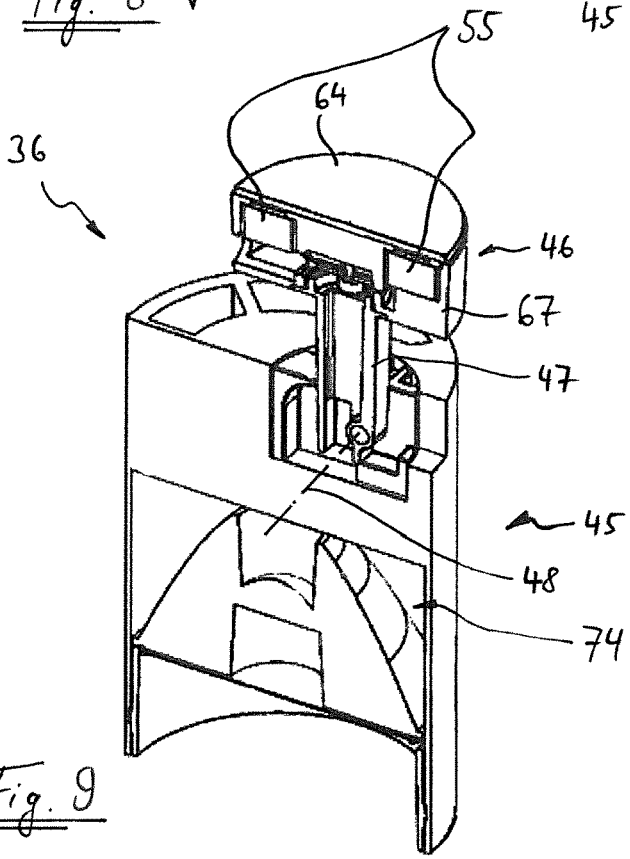
FIG. 9 shows a perspective sectional illustration of the light providing device from FIG. 7.
Figure 10:
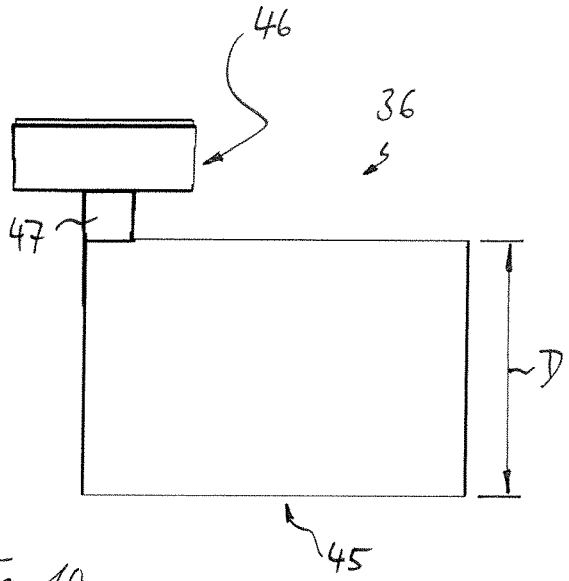
FIG. 10 shows a side view of the light providing device from FIG. 7 with a functional section in a state pivoted by 90 degrees.
Figure 12:
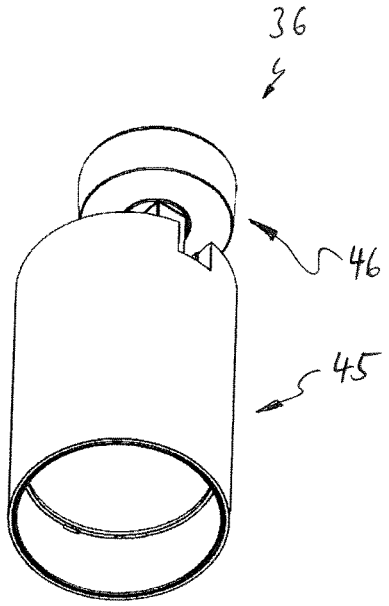
FIG. 12 shows a perspective view of the light providing device from FIG. 7 as seen from the side of a glare reducing ring.
Figure 11:
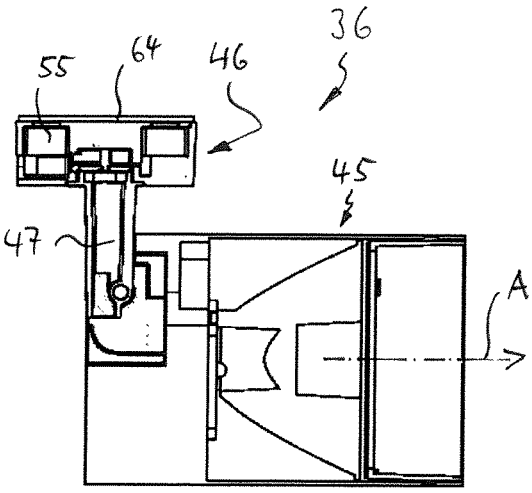
FIG. 11 shows a sectional illustration of the light providing device from FIG. 7 in the state in FIG. 10.
Figure 13:
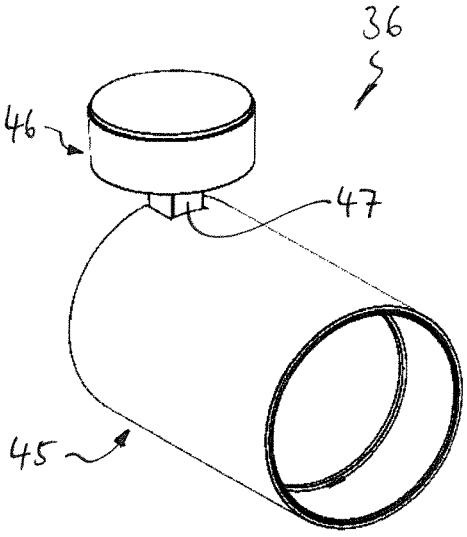
FIG. 13 shows a perspective view of the light providing device from FIG. 7 in the state in FIG. 10, from the side of the glare reducing ring.

It should be mentioned that the connecting components 122 in FIGS. 25A-C and the connecting components 121 in FIGS. 32A-F can in each case also be configured for an angular coupling of channel sections 3*b* and busbar sections 95*b*, for instance by angled configuration of the connecting components 121, 122, in a manner similar to that indicated for the connecting components 21', 22 in FIG. 6.

Figure 44:
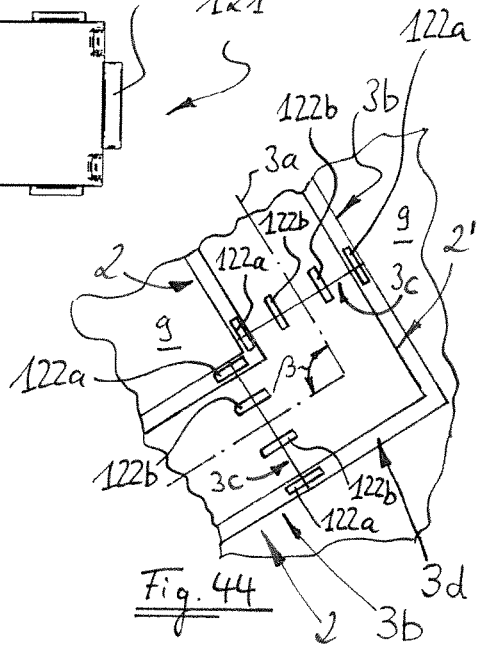
FIG. 44 shows an angled section of the lighting arrangement from FIG. 19, as seen from an opposite side of the intermediate ceiling relative to the visible side thereof.
Figure 32F:
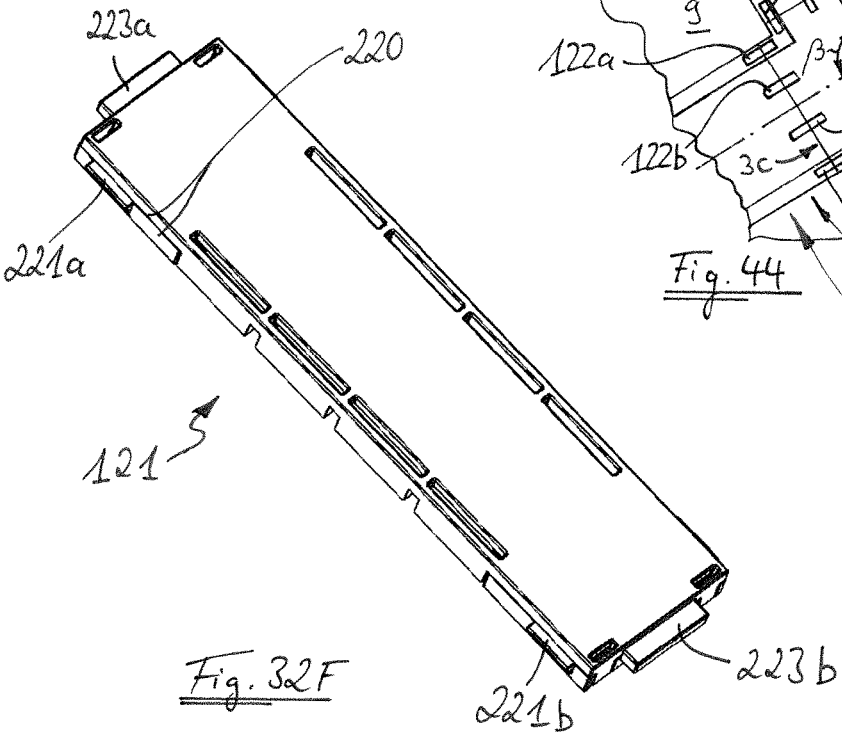
FIG. 32F shows the connecting component from FIG. 32A in a perspective view from above.

In one variant of the second exemplary embodiment, however, for implementing a course of the channel 3 angled by an angle, for instance by β=90 degrees, in addition to rectilinear units 2, provision is made of a unit 2' designed as a corner piece with a channel corner section 3*d* as a further unit, see FIG. 44. In this case, the housing component 104, the profiled components 106 and the sections—inserted into these—of the additional light source(s) 78 and of the busbar (s) 95 have been brought into the arrangement angled by the angle β already in the unit 2' designed as a corner piece. By way of example, busbar(s) 95 and also additional light source(s) 78 run through the channel corner section 3*d* around the corner.

In FIG. 44, a respective rectilinear unit 2 is coupled to the unit 2' at a respective connecting location 3*c*. This can be effected for example mechanically by the connecting components 122 from FIGS. 25A-C, said connecting components being designed as rectilinear profiles. The electrical coupling of the busbars can once again be effected with the aid of connecting components 121 (not depicted in FIG. 44 for the sake of better clarity).

It should be mentioned that the unit 2' designed as a corner piece can also be designed for a different angle β, for example an angle β of 30 degrees, 45 degrees, 60 degrees, 120 degrees, 135 degrees or 150 degrees, or any other desired angle.

Figure 36:
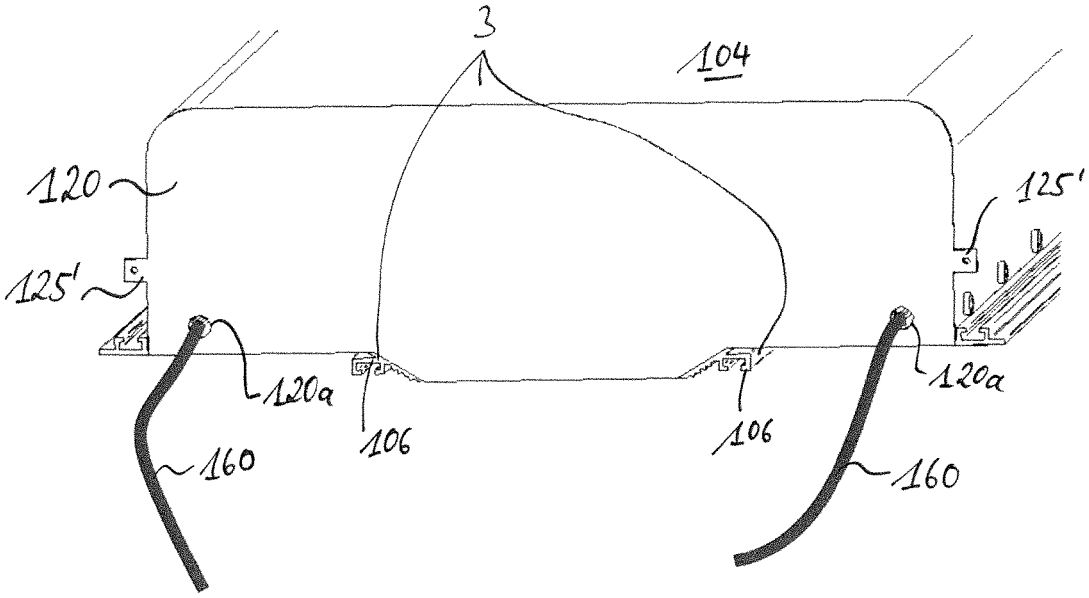
FIG. 36 shows a perspective view of an end face of a channel of the lighting arrangement in accordance with the second exemplary embodiment, wherein the end face is closed by an end terminating piece and feed-in lines are visible.
Figure 37A:
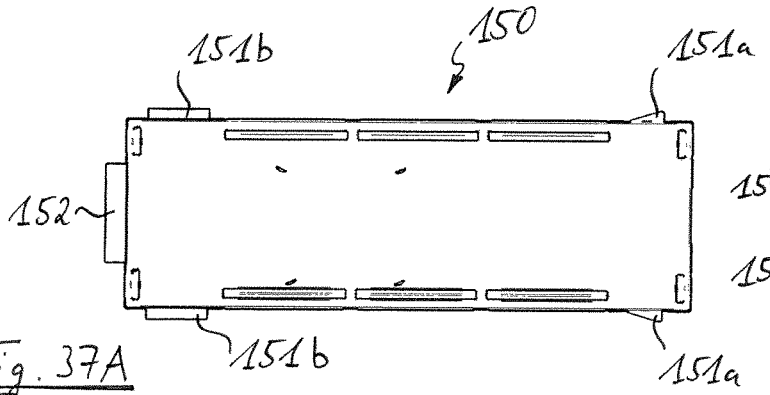
FIG. 37A shows a feed-in component of the lighting arrangement in accordance with the second exemplary embodiment, in a plan view.
Figure 37B:
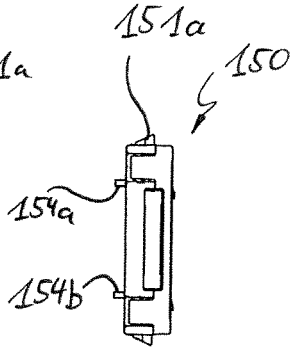
FIG. 37B shows the feed-in component from FIG. 37A in an end-side view.
Figure 37C:
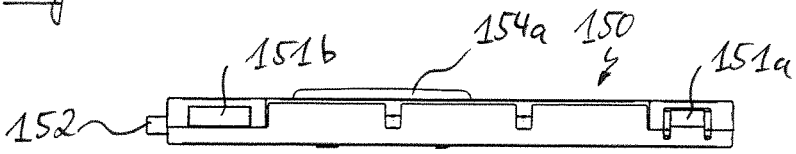
FIG. 37C shows the feed-in component from FIG. 37A in a longitudinal-side view.
Figure 37D:
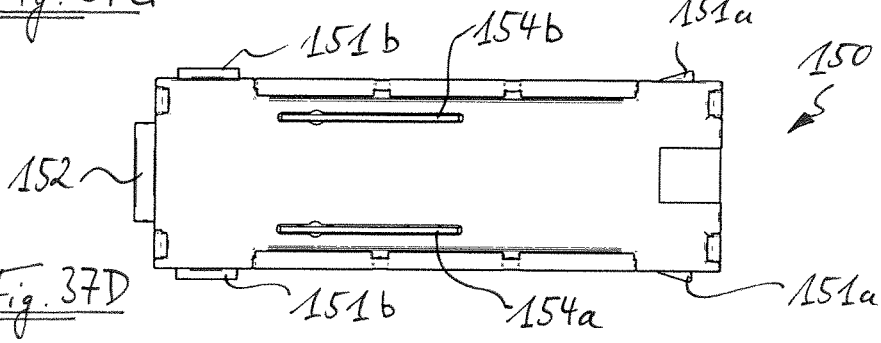
FIG. 37D shows the feed-in component from FIG. 37A in a bottom view.
Figure 37E:
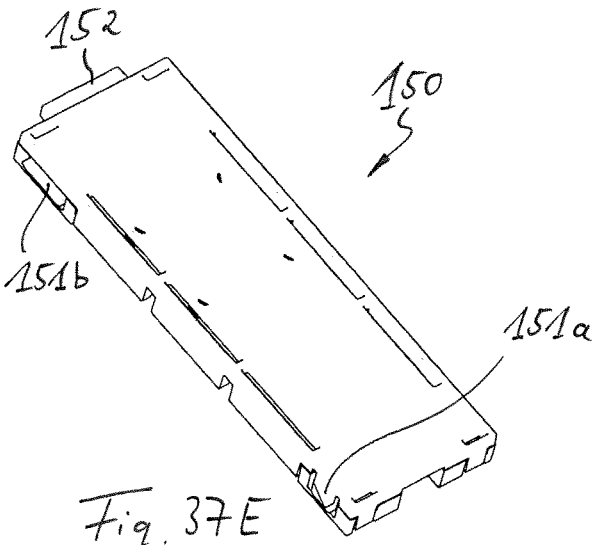
FIG. 37E shows the feed-in component from FIG. 37A in a perspective view from above.
Figure 37F:
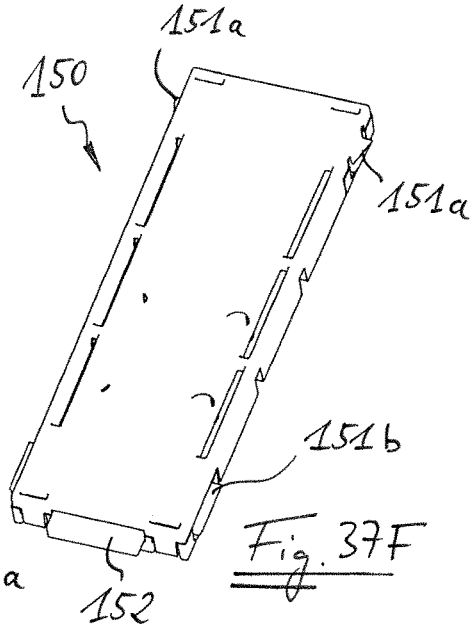
FIG. 37F shows the feed-in component from FIG. 37A in a further view perspectively from above.
Figure 37G:
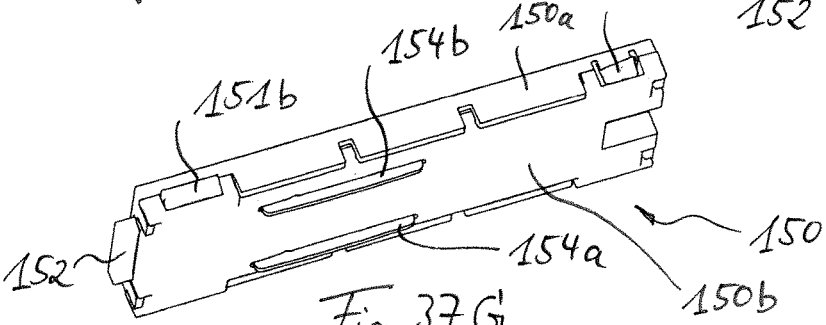
FIG. 37G shows the feed-in component from FIG. 37A in a perspective view from below.

FIG. 36 shows how, in the case of the second exemplary embodiment of the invention, the channel 3 can be closed by an end terminating piece 120 at one of the open end faces, for example at both open end faces. The channel sections 3*b* are provided with tabs 125 at their open end faces, see FIGS. 19-22, wherein the tabs 125 here are in each case part of a section of the housing component 104. The end terminating piece 120 in FIG. 36 is designed as a sheet-metal part and is manufactured from steel sheet, for example, and comprises lateral tabs 125', which are designed and arranged in a manner corresponding to the tabs 125 of the housing component 104. Using the tabs 125, 125', the end terminating piece 120 can be connected to the housing component 104, for instance using screws, in order to secure the end terminating piece 120 at the end face of the channel 3.

FIG. 36 furthermore shows that the end terminating piece 120 is equipped with passage openings 120*a*, through which feed-in lines 160 for feeding electric current into the busbars 95 can be led through the end terminating piece 120. The feed-in lines 160 can in each case be electrically coupled to a suitable current source, not illustrated in FIG. 36, for instance a suitable transformer, wherein the current source is situated outside the channel 3.

At that end of each of the feed-in lines 160 which is situated in the interior 5, the feed-in lines 160 are in each case electrically coupled to a feed-in component 150. Each of the feed-in components 150, which are not visible in FIG. 36, enables the supply of one of the two busbars 95 in the second exemplary embodiment.

A feed-in component 150 is illustrated in greater detail in FIGS. 37A to 37G and 38. Analogously to the connection adapter 199 already explained above, the feed-in component 150 is of substantially parallelepipedal design and comprises a component housing formed with a component housing part 150*a* as upper part and a component housing part 150*b* as lower part, wherein the component housing parts 150*a* and 150*b* are formed in each case with a plastics material.

Analogously to what is provided in the case of the connection adapter 199, the feed-in component 150 is equipped with two movable snap-action hooks 151*b* in the region of one of its ends at opposite longitudinal sides. An actuation element 152 is provided at the end face in the region of the end of the feed-in component 150 to which the snap-action hooks 151*b* are adjacent, wherein once again as a result of the actuation element 152 being pushed in, the snap-action hooks 151*b* can be withdrawn. As in the case of the connection adapter 199, in the case of the feed-in component 150, too, for this purpose a suitable mechanism can be provided within the component housing. At the other end of the feed-in component 150, two latching lugs 151*a* additionally protrude at the opposite longitudinal sides thereof. The snap-action hooks 151*b* and latching lugs 151*a* form latching devices in order to couple the feed-in component 150 in a latching and re-releasable manner to the profiled component 106 in the region of the groove 8*c*, wherein once again the snap-action hooks 151*b* and latching lugs 151*a* engage behind the ribs 15*c*'. If the actuation element 152 is actuated, then the snap-action hooks 151*b* are withdrawn and disengage from the ribs 15*c*', and the feed-in component 150 can be released from the groove 8*c*.

Figure 38:
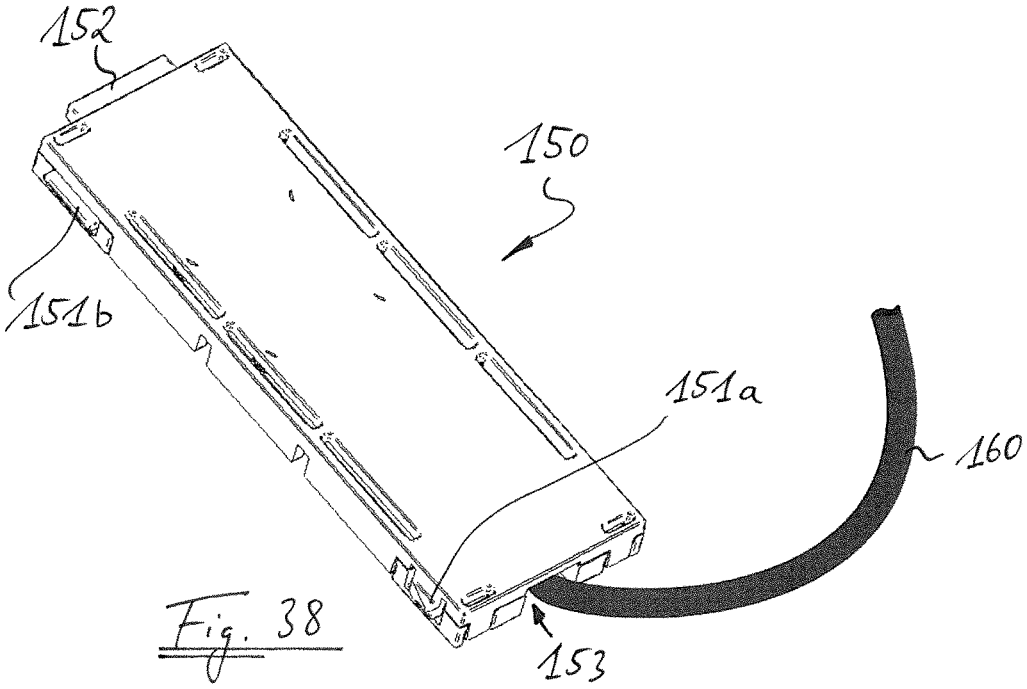
FIG. 38 shows the feed-in component from FIG. 37A in a perspective view from above as in FIG. 37E, with a feed-in line for coupling the feed-in component to a current source outside the channel.

Within the interior 5, for example in the end region of the busbar 95 and adjacent to the end terminating piece 120, the feed-in component 150 can be inserted into the groove 8*c* in order to feed current in the busbar 95. For this purpose, the feed-in component 150 comprises contact elements 154*a,b* at its underside, wherein each of the contact elements 154*a,b* makes contact with one of the conductors 97*b* of the busbar 95 after the latching of the feed-in component 150 into the groove 8*c*. The contact elements 154*a,b* are coupled to conductors of the feed-in line 160 in the interior of the feed-in component 150 in a suitable manner in order to be able to supply the busbar 95. FIG. 38 shows how the feed-in line 160 enters the feed-in component 150 in an entrance region 153, wherein a strain relief mechanism for the feed-in line 160 can be integrated into the component housing parts 150*a* and 150*b*.

A lighting arrangement 1, 101 in accordance with one of the exemplary embodiments described above can be constructed in the following manner.

Firstly—for example in the manner of a construction kit—for the formation of the lighting arrangement 1, 101 comprising a plurality of channel sections 3*b* and possibly 3*d*, provision is made of the required number of sections of the housing component 4 or 104, the required number of sections of the profiled components 6 or 106, the connecting components 21, 22, 21', 22' or 121, 122 required for the channel form to be realized, and also the desired number of light providing devices 36 and/or 136 with in each case a line 85 and a connection adapter 99 or 199.

In this case, the busbars 95 and the additional light sources 78 may already have been installed in one or both of the profiled components 6, 106. Alternatively, for example, the additional light sources 78 could be provided separately as part of the construction kit, wherein they are then also inserted into the receptacle region 98.

Channel sections 3*b* are assembled from the sections of the housing component 4 or 104 and the sections of the profiled components 6, 106, which are secured to one another, and, together with the additional light source(s) 78 and busbar(s) 95 installed in the profiled component(s) 6, 106, form a unit 2. A plurality of units 2 can be preassembled in this way. The units 2 can be provided for a customer for example already in preassembled form. If a further unit 2' having a channel corner section 3*d* or a plurality of units 2' is/are required for the desired channel form, the unit(s) 2' may likewise be provided in preassembled fashion with busbar(s) 95 and additional light source(s) 78 already installed therein.

End faces of units 2 which later are intended to be closed as end faces of the channel 3 are closed with the end terminating pieces 20 or respectively 120. Already at this point, in the case of the second exemplary embodiment, the feed-in component(s) 150 can be coupled in one of the units 2, which comprises an end terminating piece 120. The feed-in line 160 or the feed-in lines 160 is/are able to be guided through the passage openings 120*a* of the end terminating piece 120 already in this step.

The units 2 provided in this way, with the busbar(s) 95 and possibly additional light source(s) 78 arranged therein, can be brought behind the intermediate ceiling 10 and combined in the manner described below.

FIG. 20 illustrates an entire width B3 of the channel 3 for the channel 3 of the second exemplary embodiment. Furthermore, FIG. 20 illustrates a height H3 of the channel 3, which is measured from the outer side of the cover section 4*e* vertically as far as the boundary 33 of the light exit region 31. Furthermore, a width W of the slot 10*a* is depicted in FIG. 20. A distance between the bare ceiling R and the plate elements 9 of the intermediate ceiling 10 is designated by T10 and illustrated in a shortened manner in FIG. 20. FIG. 1 shows the dimensions B3, H3, T10 and W for the first exemplary embodiment, the distance T10 in turn being shown in a shortened manner.

The slot 10*a* having a suitable width W is introduced, e.g. cut, into a suspended intermediate ceiling 10, which has already been fixedly installed at a bare ceiling R, wherein the course of the slot 10*a* is chosen in a manner corresponding to the course of the desired light exit region 31. The slot 10*a* can extend e.g. in the ceiling region of a space through the entire space or a large part thereof and can be straight or singly or multiply angled. Alternatively, the slot 10*a* could run in the wall region.

Figure 43:
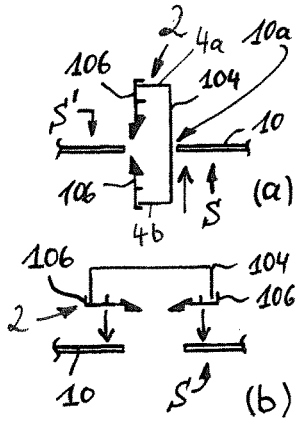
FIG. 43 shows two steps in an exemplary mounting process for a lighting arrangement in accordance with the second exemplary embodiment in schematic sectional illustration.
Figure 26:
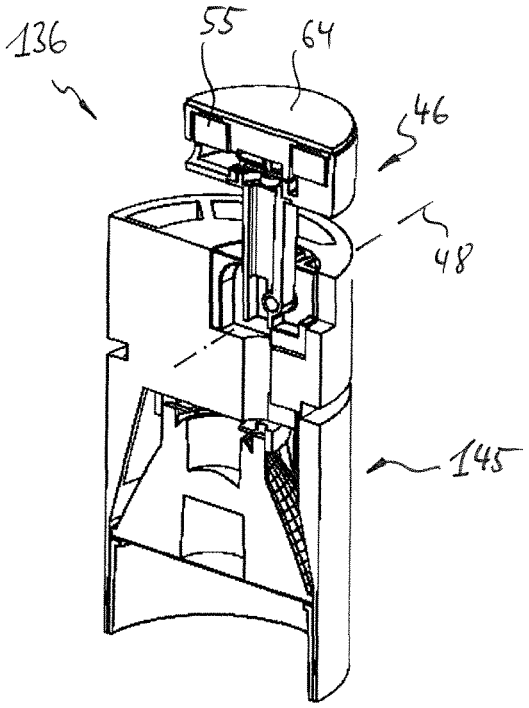
FIG. 26 shows a perspective sectional illustration of a light providing device in accordance with one variant.
Figure 28:
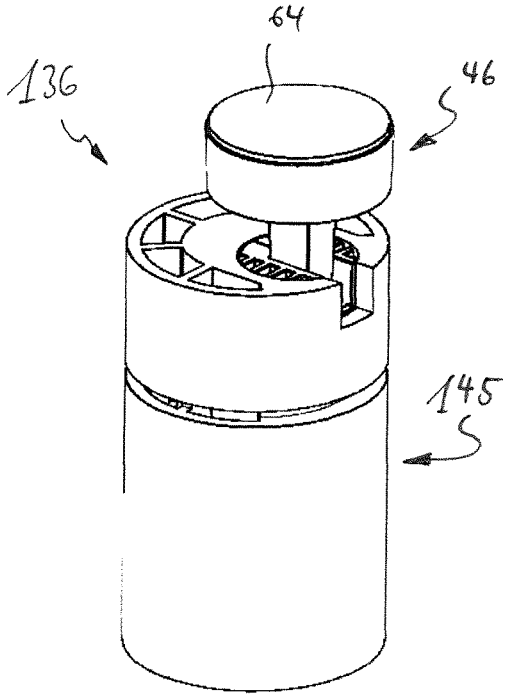
FIG. 28 shows a perspective view of the light providing device from FIG. 26.
Figure 27:
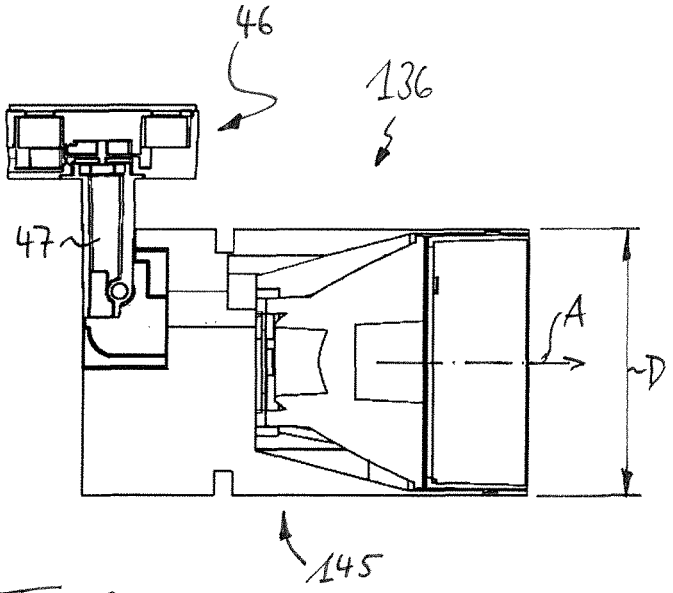
FIG. 27 shows a sectional illustration of the light providing device from FIG. 26 with a functional section in a state pivoted by 90 degrees.
Figure 29:
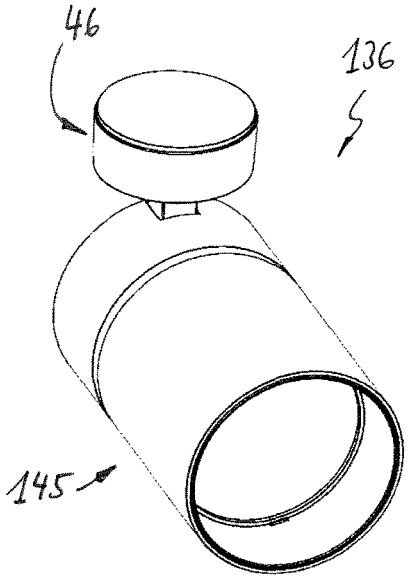
FIG. 29 shows a perspective view of the light providing device from FIG. 26 with a functional section in the state pivoted by 90 degrees, as seen from the side of a glare reducing ring.
Figure 30A:
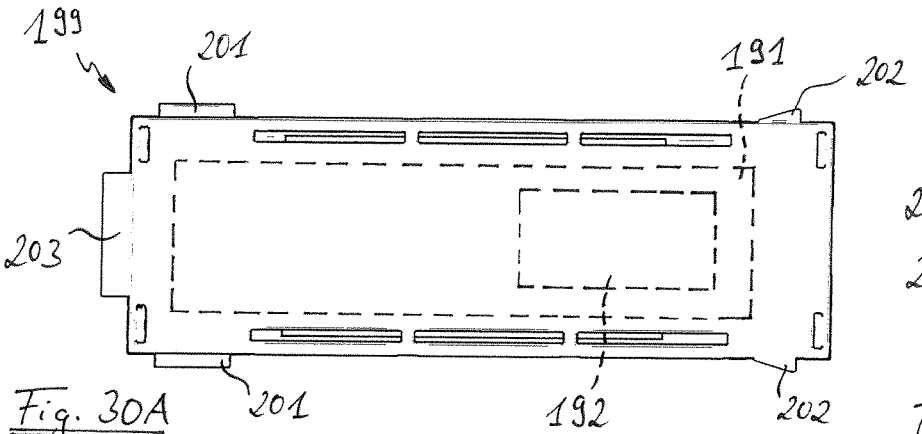
FIG. 30A shows a connection adapter of the lighting arrangement in accordance with the second exemplary embodiment, in a plan view.
Figure 30B:
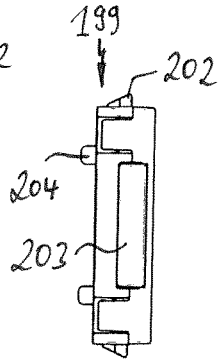
FIG. 30B shows the connection adapter from FIG. 30A in an end-side view.
Figure 30C:
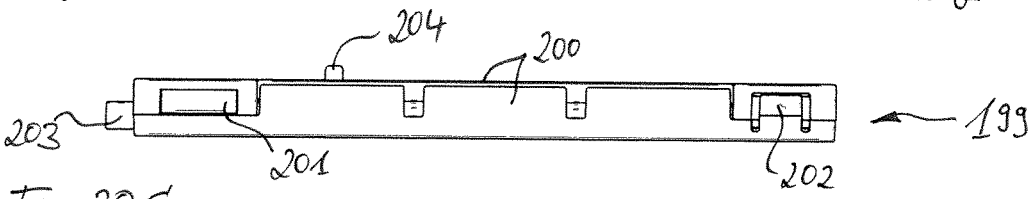
FIG. 30C shows the connection adapter from FIG. 30A in a longitudinal-side view.
Figure 30D:
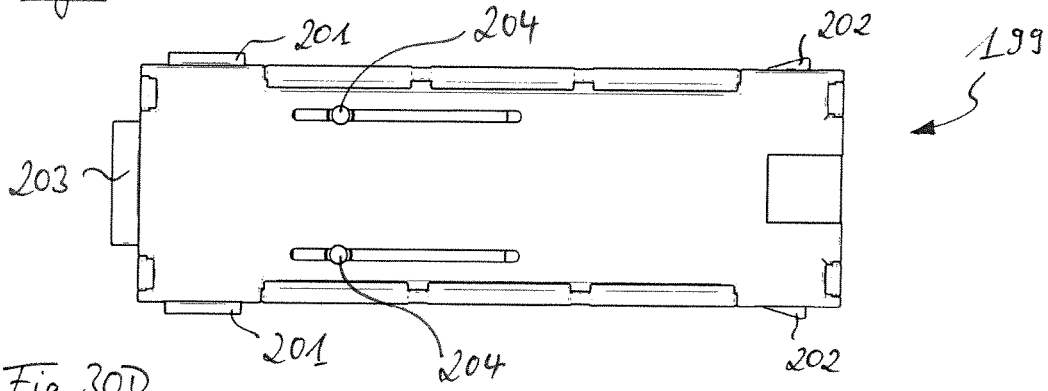
FIG. 30D shows the connection adapter from FIG. 30A in a bottom view.
Figure 30E:
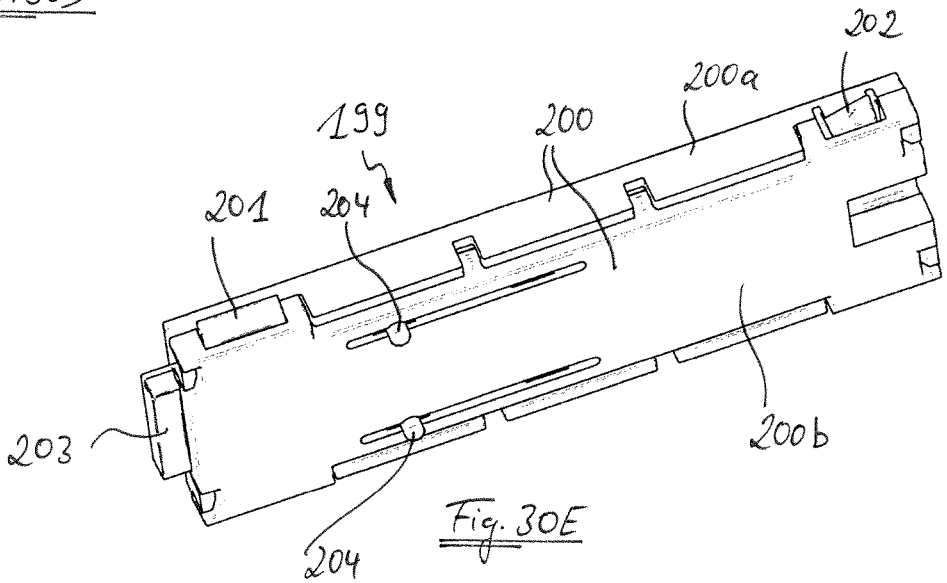
FIG. 30E shows the connection adapter from FIG. 30A in a perspective view from below.
Figure 30F:
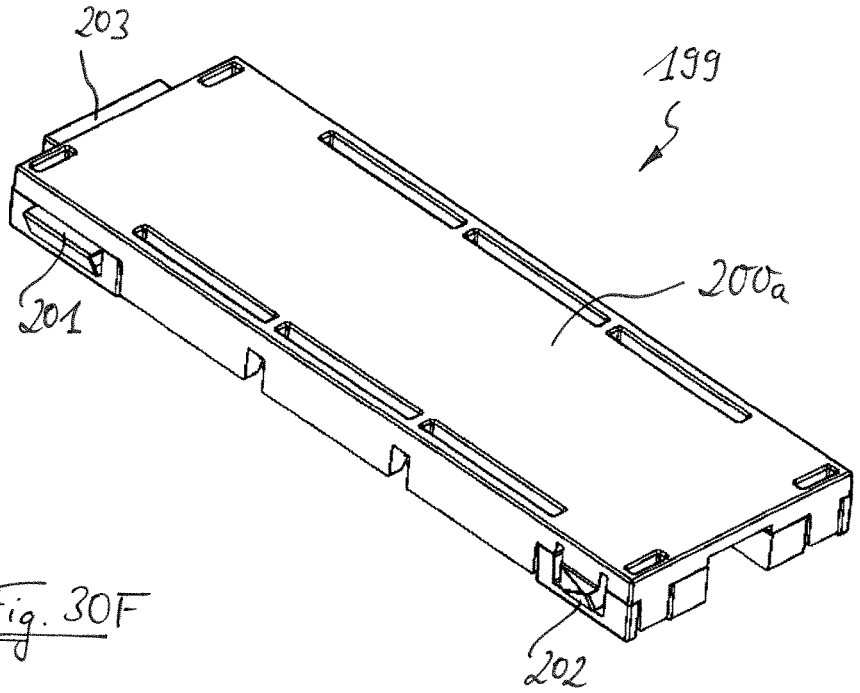
FIG. 30F shows the connection adapter from FIG. 30A in a perspective view from above.

For mounting the channel 3 behind the intermediate ceiling 10, see FIG. 43 (*a*), a for example rectilinear unit 2 with one of the wall sections 4*a*, 4*b* ahead can be introduced through the slot 10*a* in the intermediate ceiling 10 into the interspace between the latter and the bare ceiling R (not illustrated in FIG. 43), behind the intermediate ceiling 10 can be rotated about a longitudinal axis of the unit 2 by 90 degrees and can be placed onto the intermediate ceiling 10 from the rear side, that is to say from the side S', see FIG. 43 (*b*). For this purpose, the distance T10 is chosen in relation to the dimensions of the channel 3, in particular to the width B3, in such a way that the movement illustrated in FIGS. 43(*a*) and (*b*) is implementable.

Longer and angled channels 3 are placed behind the intermediate ceiling 10 in a plurality of segments. This is done in such a way that for example rectilinear units 2 are successively brought behind the intermediate ceiling 10, in the manner illustrated in FIG. 43. After the insertion of the units 2 behind the ceiling 10, these are positioned and connected in the region of the connecting location 3*c*. For this purpose, the procedure adopted can be for example such that the connecting components 122 are inserted into the groove 8*e* or the groove 8*f* before the introduction of a first one of the units 2 behind the ceiling 10 and are respectively fixed in said groove using the screws 124. A first unit 2 prepared in this way is brought behind the ceiling 10 through the slot 10*a* and is positioned on the rear side of said ceiling e.g. in the correct position along the slot 10*a*. Afterward, a unit 2 to be connected thereto is likewise brought behind the ceiling 10 through the slot 10*a*, wherein this second unit 2 was not provided with connecting components 122 at the connecting location 3*c*. By a displacement movement for example of the second unit 2 along the slot 10*a* toward the other, first unit 2, the connecting components 122 can also be introduced into the grooves 8*e*, 8*f* of the second unit 2.

For fixing the units 2 to one another at the connecting location 3*c*, the inner connecting components 122*b* are also fixed in the groove 8*e* of the second unit 2 from the visible side S using screws 124. For this purpose, the grooves 8*e* in the inserted state of the unit 2, see e.g. FIG. 20, are arranged between the edge 9*a* and the boundary 33. In this case, the outer connecting components 122*a* remain fixed only in the grooves 8*f* of the first of the units 2 and serve in particular for the improved guidance of the units 2 in relation to one another.

In the case of an angled channel 3, the unit 2' designed as a corner piece can be introduced between the bare ceiling R and the intermediate ceiling 10 in a manner analogous to that as described above for the rectilinear units 2. The dimensions of the unit 2', in particular of the channel corner section 3*d*, are chosen in relation to the distance T10 in such a way that insertion is possible analogously to FIG. 43. The mechanical connection of the unit 2' to the adjoining units 2, cf. FIG. 44, is effected analogously to the connection of two rectilinear units 2, as described above, in two connecting locations 3*c*.

The channel 3 can be fixed using holding means, not shown, at the plate elements 9 of the intermediate ceiling 10. From the visible side S, the transition region in the region of the edges 9*a* of the plate elements 9 as far as the boundary 33 of the light exit region 31, see FIG. 20, for instance, is covered with filler.

After the units have been mechanically fixed to one another, the busbars 95 can subsequently be electrically connected to one another across the connecting locations 3*c* by the connecting components 21, 21' or 121. This can be carried out through the opening 28.

The insertion and adjustment of the light providing devices 36, 136 may advantageously be carried out after the installation of the channel 3 behind the intermediate ceiling 10 from the visible side S thereof.

Once the installation of the channel 3 with the light sources 78 and busbars 95 into the ceiling 10 has been concluded, in a subsequent step, through the opening 28, the desired number of light providing devices 36 and/or 136 can be introduced into the interior 5 and in each case be coupled to the channel 3, as described above. The magnetic coupling using the permanent magnets 55 allows the introduced light providing devices 36 and/or 136 to be positioned in the interior 5 very variably and to be displaced back and forth slidingly at the channel 3 over the length thereof and additionally to be rotated until the desired lighting effect by light emission through the light exit region 31 toward the outside can be achieved. Pivoting about the pivot axis 48 enables further flexibility. For operation, the light providing devices 36, 136 are held within the interior 5 by magnetic force. The insertion of the light providing devices 36, 136 and the arrangement thereof in the interior 5, and also the coupling and adjustment can be carried out through the opening 28.

When the channel 3 is installed behind the intermediate ceiling 10, it is additionally ensured that the busbars 95 are connected or can be connected to a current source, for instance a transformer, by the feed-in lines 160. The light providing devices 36, 136 can be supplied with current particularly simply and flexibly with the aid of the busbars 95 arranged on both sides of the light exit region 31 in the case of the second exemplary embodiment. The connection adapter 199 respectively provided, after the mounting of the channel 3 with the busbar(s) 95 and possibly the additional light source(s) 78 behind the intermediate ceiling 10 through the opening 28, at a freely selectable location, can be coupled to one of the busbars 95, depending on the desired positioning of the light providing device 36 or 136 on one side or the other of the light exit region 31, for tapping off current. By way of example, in the case of a light providing device positioned rather on the left, the busbar 95 provided on the left-hand side of the center axis M can be utilized for supply and, in the case of a light providing device positioned rather on the right, the busbar 95 provided on the right-hand side of the center axis M can be utilized for supply. Consequently, even in the case of long channels 3, for example a channel 3 having a length of several meters, short paths that are bridged by the line 85 nevertheless result. The supply line 85 situated in the interior 5 is neatly arranged and guided by magnetic adhesion of the line 85 at the housing component 4 or 104 within the interior 5, without sagging or causing a disturbance. The light emission of the light providing devices 36, 136 is switched and/or controlled wirelessly with the aid of the device 192, in particular with use of the so-called Zig Bee specification. A complicated cabling for the purpose of controlling the light providing devices 36, 136 is avoided in this way and a very flexibly controllable lighting arrangement 1, 101 is provided.

Figure 45:
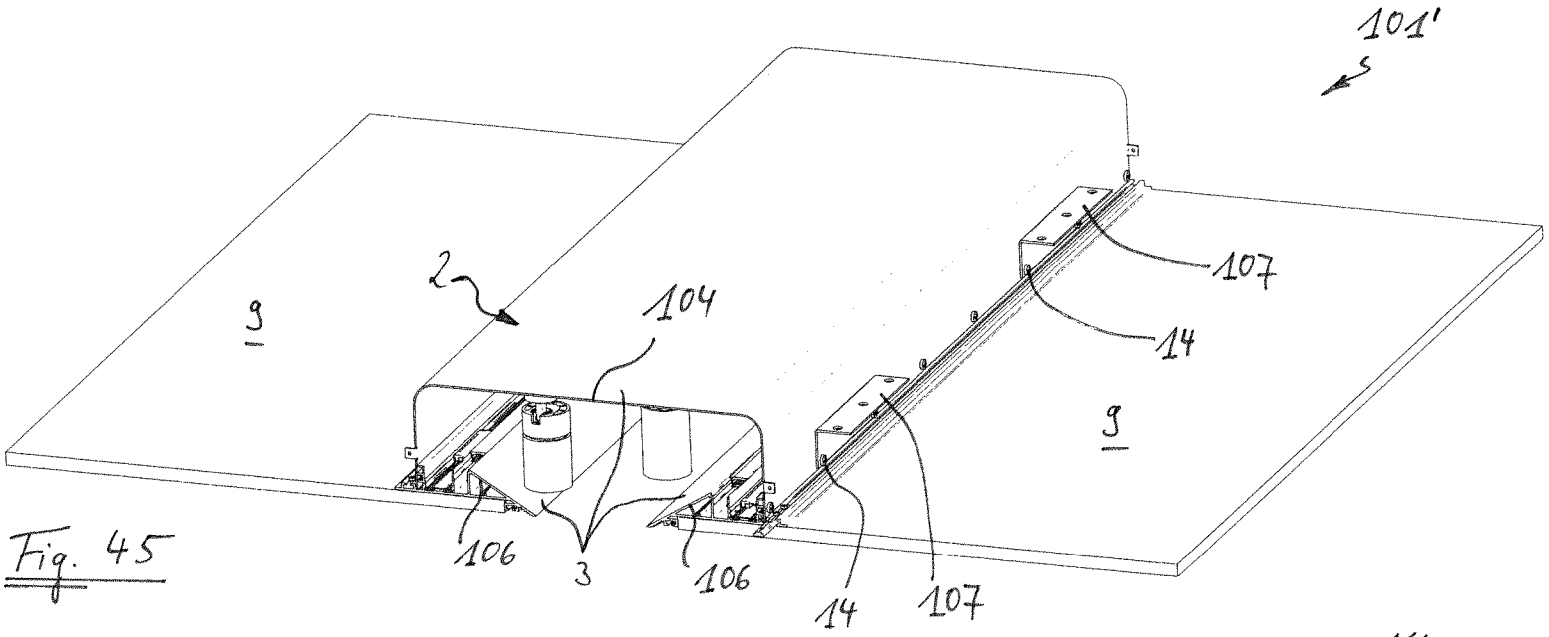
FIG. 45 shows a lighting arrangement in accordance with one variant of the second exemplary embodiment, as seen in a perspective view from the end of one unit and from an opposite side of an intermediate ceiling relative to a visible side of the intermediate ceiling.
Figure 46:
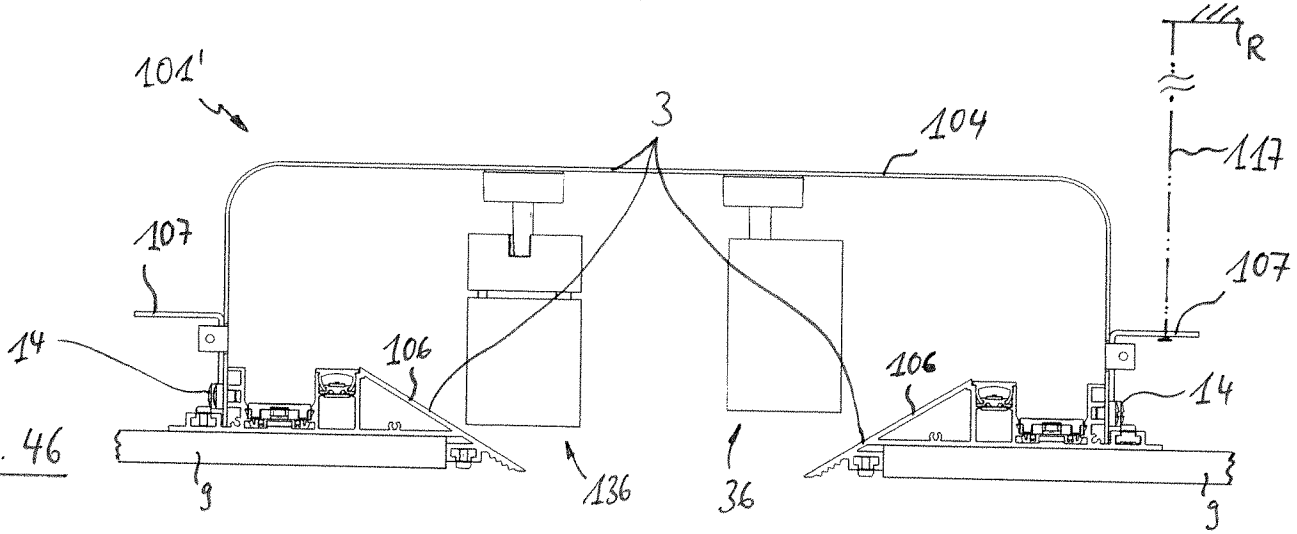
FIG. 46 shows the unit of the lighting arrangement as illustrated in FIG. 45, in an end-side view.

A lighting arrangement 101' in accordance with one variant of the second exemplary embodiment is illustrated in FIGS. 45 and 46 and differs from the lighting arrangement 101 only in the differences described below. In the case of the lighting arrangement 101', holding devices 107 are secured at the channel 3 at intervals along the latter. The holding devices 107 are provided for securing the channel 3 at the solid, load-bearing bare ceiling R. The holding devices 107 are designed as angle pieces and are fixedly connected to the channel 3 using the screws 14. For securing the channel 3 at the bare ceiling R, ropes 117 are additionally provided, see FIG. 46, only one of said ropes being shown by way of example in FIG. 46. The channel 3 is suspended from the bare ceiling R via the ropes 117 and the holding devices 107. The loading on the plate elements 9 can be relieved in this way. In this case, although the profiled components 6 can be seated on the plate elements 9, at least part of the weight of the channel 3 and of the structural elements coupled thereto is supported directly at the bare ceiling R. The holding devices 107 and ropes 117 can be provided as part of the construction kit, wherein holding devices 107 can already be secured at the channel 3.

Some further modifications of the second exemplary embodiment are illustrated schematically in FIGS. 39A-B, 40A-B, 41A-B and 42A-B.

Figure 39A:
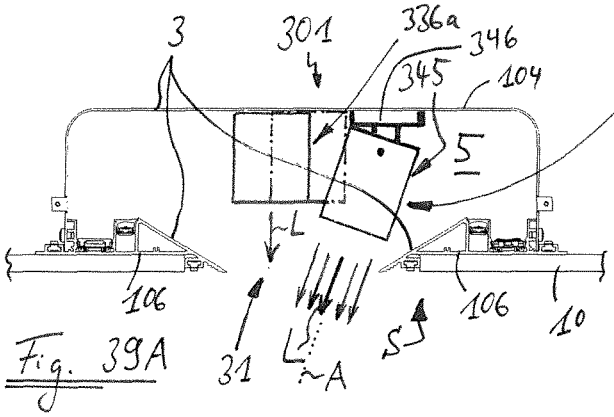
FIG. 39A shows a cross-sectional view of a lighting arrangement for elucidating a modification of the second exemplary embodiment.
Figure 39B:
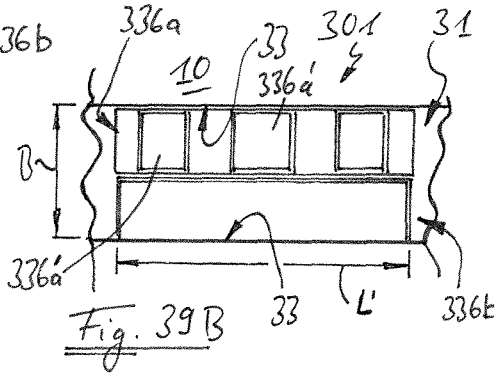
FIG. 39B shows a rectilinear section of a lighting arrangement in accordance with the modification from FIG. 39A, as seen from a visible side of an intermediate ceiling.

In the case of the lighting arrangement 301 in accordance with the modification in FIGS. 39A, 39B, instead of light providing devices 36, 136, two light providing devices 336*a*, 336*b* are provided and both are arranged in the interior 5 in order to emit light L through the light exit region 31 toward the outside. The light providing device 336*a* has overall a linearly elongated, parallelepipedal shape, wherein the light providing device 336*a* has a plurality of individual light emission regions 336*a*' on its side facing the light exit region 31 in FIG. 39A. The coupling of the light providing device 336*a* to the channel 3 and also the electric current supply and the control/switching are carried out as in the case of the light providing devices 36, 136. However, over and above the positionability using the magnetic coupling, the light providing device 336*a* is not inherently adjustable and in FIG. 39A emits light directionally vertically through the light exit region 31 downward. FIG. 39A furthermore indicates in a dash-dotted manner that the light providing device 336*a* could also be positioned centrally above the light exit region 31.

A longitudinal extent L' of the light providing device 336*a* is greater than the width B of the light exit region 31. In parallel alignment of the elongated shape of the light providing device 336*a* with respect to the light exit region 31, said light providing device can be introduced into the interior 5 from the visible side S, wherein the light providing device 336*a* in FIG. 39B, in the coupled state, likewise extends parallel to the light exit region 31 above the latter.

The light providing device 336*b* comprises a functional section 345 formed with a linearly elongated, parallelepipedal shape, wherein once again a longitudinal extent L' of the parallelepipedal shape significantly exceeds the width B of the light exit region 31. The light providing device 336*b* furthermore comprises a base section 346, which is pivotably coupled to the functional section 345, as a result of which the emission direction of the light providing device 336*b* can be adjusted in a manner similar to that in the case of the light providing devices 36 or 136.

In parallel alignment of the elongated shape with respect to the light exit region 31, the light providing device 336, too, can be introduced into the interior 5 from the visible side S. FIG. 39B shows the alignment of the elongated shape parallel to the light exit region 31 in the coupled state, wherein the functional section 345 is pivoted for the directional emission of light L through the light exit region 31 toward the outside, see FIG. 39A. The light providing device 336*b* could alternatively be coupled to the channel 3 in the wall region 5*a* or 5*b*.

The light providing devices 336*a* and/or 336*b* can also be combined with a light providing device 36 and/or 136 in the same lighting arrangement. For accurate positioning, the light providing devices 336*a*, 336*b* can also be slidingly displaced and possibly rotated at the channel 3.

Additional light providing devices 437, 537 and 637 are illustrated schematically in FIGS. 40A-B, 41A-B and 42A-B. In the modifications of the second exemplary embodiment which correspond to FIGS. 40A-B, 41A-B and 42A-B, the additional light providing devices 437, 537 and/or 637 can be provided in any desired combination in addition to at least one of the light providing devices 36, 136, 336*a* and/or 336*b* in order to supplement the lighting effects achieved. FIGS. 40A-B, 41A-B and 42A-B thus illustrate lighting arrangements 401, 501 and 601, respectively, in accordance with the corresponding modifications of the second exemplary embodiment.

The additional light providing device 437 is arranged in the interior 5 and is magnetically coupled to the housing component 104 in order to hold the additional light providing device 437 at the channel 3, analogously to the magnetic coupling described further above for the light providing devices 36 and 136. For supplying current to the additional light providing device 437, the latter likewise, like each of the light providing devices 36, 136, 336*a-b*, is electrically coupleable to one of the two busbars 95 via a line 85 and a connection adapter 199 (not illustrated in FIGS. 40A-B).

Figure 40A:
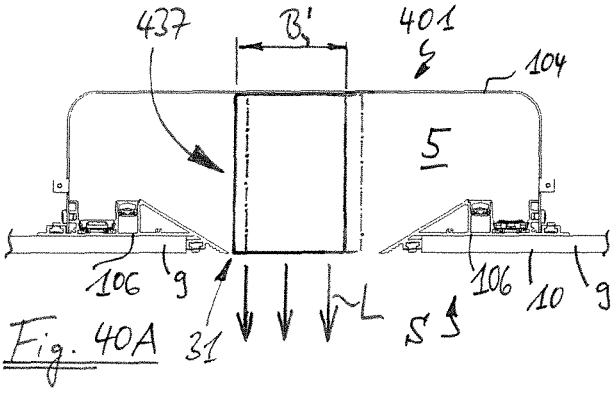
FIG. 40A shows a cross-sectional view of a lighting arrangement for elucidating a further modification of the second exemplary embodiment.
Figure 40B:
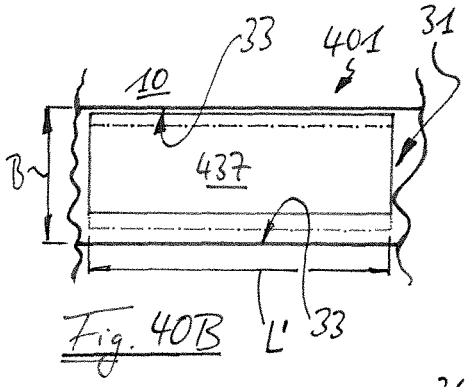
FIG. 40B shows a rectilinear section of a lighting arrangement in accordance with the modification from FIG. 40A, as seen from a visible side of an intermediate ceiling.

The additional light providing device 437 has a linearly elongated, parallelepipedal shape having a longitudinal extent L', see FIG. 40B, wherein a width B' of the additional light providing device 437 in FIGS. 40A-B is smaller than the width B of the light exit region 31, see also FIG. 20. The additional light providing device 437 can thus be positioned laterally with respect to the center of the light exit region 31 or, as shown by a dash-dotted line in FIG. 40A, centrally in relation to the width direction of the light exit region 31. The additional light providing device 437 is flush with the plate elements 9 of the ceiling 10 on the visible side S and emits light L directionally into the space. Alternatively, the width B' could substantially correspond to the width B, as a result of which the additional light providing device 437 then substantially fills the light exit region 31 over the longitudinal extent L'.

Figure 41A:
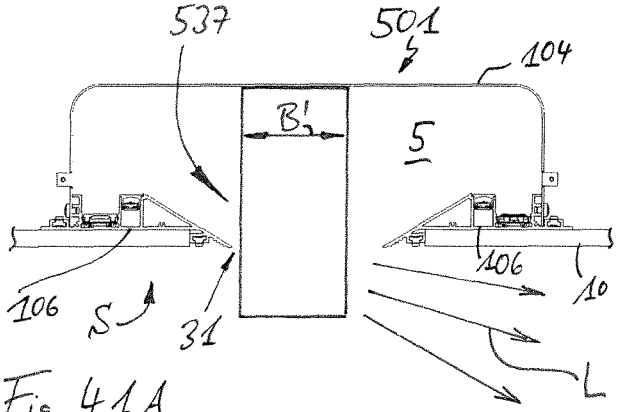
FIG. 41A shows a cross-sectional view of a lighting arrangement for elucidating yet another modification of the second exemplary embodiment.
Figure 41B:
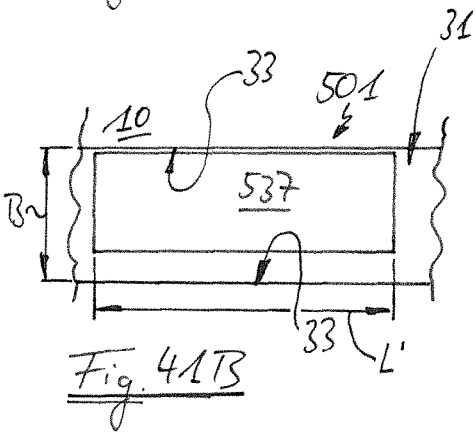
FIG. 41B shows a rectilinear section of a lighting arrangement in accordance with the modification from FIG. 41A, as seen from a visible side of an intermediate ceiling.

The additional light providing device 537 in FIGS. 41A-B is configured to irradiate a wall, and is thus embodied as a "wall washer". For this purpose, the additional light providing device 537 in the state coupled to the channel 3, as shown in FIGS. 41A-B, projects outward from the interior 5 through the light exit region 31; consequently, in this state, only the upper section of the additional light providing device 537 is received in the interior 5. FIG. 41A shows that the additional light providing device 537 emits light L outside the interior 5 directionally laterally in the direction of a wall. The additional light providing device 537 is magnetically coupleable to the channel 3 in the same way as the additional light providing device 437 and likewise, like the light providing devices 36, 136, is supplied with current via a line 85 and a connection adapter 199.

The additional light providing device 537 also has a linearly elongated, parallelepipedal shape having a longitudinal extent L'. A width B' of the additional light providing device 537 can once again correspond to the width B of the light exit region 31, wherein the additional light providing device 537 then substantially fills the light exit region 31, or can be smaller than the width B, see FIG. 41A.

Figure 42A:
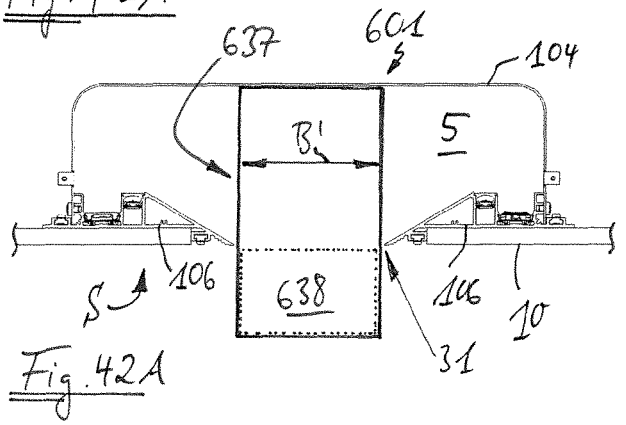
FIG. 42A shows a cross-sectional view of a lighting arrangement for elucidating yet another modification of the second exemplary embodiment.
Figure 42B:
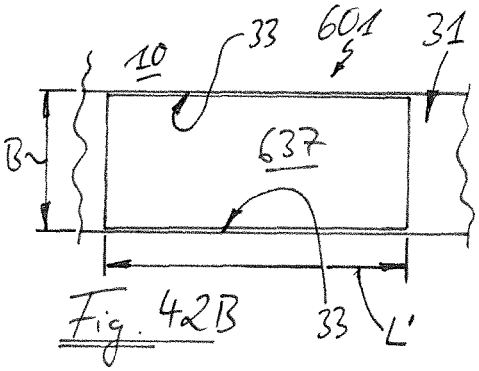
FIG. 42B shows a rectilinear section of a lighting arrangement in accordance with the modification from FIG. 42A, as seen from a visible side of an intermediate ceiling.

The additional light providing device 637 in FIGS. 42A-B is equipped with an opalescent light emission region 638, which is situated outside the interior 5 in the state in which the additional light providing device 637 is coupled to the channel 3, as illustrated in FIGS. 42A-B. Consequently, the additional light providing device 637 in the state in FIGS. 42A-B also projects from the interior 5 through the light exit region 31. The opalescent light exit region 638 supplements the light effects made possible by the light providing devices 36, 136, for example, in an aesthetic way by an element that is luminous uniformly in the ceiling region. The additional light providing device 637 is likewise magnetically coupleable to the channel 3 in the same way as the additional light providing device 437, and the electric current supply is effected via a line 85 and a connection adapter 199 as in the case of the light providing devices 36, 136.

The additional light providing device 637 likewise has a linearly elongated, parallelepipedal shape having a longitudinal extent L', wherein in FIGS. 42A-B a width B' of the additional light providing device 637 corresponds to the width B of the light exit region 31 and the latter is thus substantially filled in the width direction by the additional light providing device 637. However, widths B' smaller than the width B are also conceivable.

The additional light providing devices 437, 537 and 637 are controlled and/or switched, as described further above for the light providing devices 36 and 136, for example wirelessly with the aid of the ZigBee specification.

It goes without saying that the modifications in accordance with FIGS. 39A-B, 40A-B, 41A-B and 42A-B are analogously also applicable to the first exemplary embodiment.

Lighting arrangements 301, 401, 501 or 601 can be constructed analogously to the above explanations concerning the lighting arrangements 1, 101, wherein the construction kit respectively provided then alternatively or additionally contains the light providing device 336*a* and/or 336*b* and/or additionally contains one or a plurality of the additional light providing devices 437, 537, 637. The additional light providing devices 437, 537 and 637 can in each case likewise be introduced after completion of the channel 3 from the visible side S through the light exit region 31, wherein in these cases, too, for accurate positioning, the respective additional light providing device 437, 537, 637 can be moved slidingly at the channel 3, in particular also along the longitudinal direction 3*a*.

It should be noted that, in all the exemplary embodiments described above, each of the light providing devices 36, 136 can be designed in accordance with FIGS. 7-15 or FIGS. 26-29 and may comprise one or a plurality of LEDs as light sources. It is conceivable, however, for the light providing devices 36, 136 to generate light in a different way, wherein arbitrary illuminants can be used. Incandescent lamps and/or halogen lamps and/or other suitable illuminants or light sources could be provided, for instance, instead of LEDs. The light providing devices 336*a*, 336*b* and also the additional light providing devices 437, 537, 637 can also comprise in each case one or a plurality of LEDs as light sources, or can comprise incandescent lamps and/or halogen lamps and/or other suitable illuminants or light sources.

Although the present invention has been fully described above on the basis of exemplary embodiments, it is not restricted thereto, but rather is modifiable in diverse ways.

By way of example, the invention is not restricted to lighting arrangements in which the light exit region and/or the channel extend(s) rectilinearly or piecewise rectilinearly. In variants of the invention, the channel and/or the light exit region can extend in a curved fashion and/or be branched at least in sections in the longitudinal direction of the channel and/or of the light exit region.

By way of example, the shape of the profiled components 6 and the shape of the basic area of the housing component 4 or 104 could accordingly be curved and/or branched, in each case as necessary. Therefore, in variants, the housing component 4 or 104 could be embodied with wall surfaces curved in sections, for example. In a case in which the housing component 4 or 104 has curved wall sections, for simple coupling of the light providing devices to the channel, at least one planar inner surface region 5*e* can be provided at the cover of the housing component 4, 104.

The invention claimed is:

1. A lighting arrangement, comprising a channel having an interior and a light exit region, and comprising at least one light providing device;

wherein the light providing device is designed for arrangement thereof within the interior for the directional emission of light during operation through the light exit region toward the outside;

wherein the lighting arrangement comprises at least one busbar designed for the supply of the light providing device in the interior of the channel and the light providing device is electrically coupleable to the busbar; and wherein the light providing device, for the holding thereof, is coupleable to the channel and is freely positionable at least within a region of the interior, and wherein, for securing the light providing device at the channel at different locations within the interior, the light providing device is coupleable to a constituent of the channel by magnetic force.

2. The lighting arrangement as claimed in claim 1, wherein the busbar is not visible from outside the interior.

3. The lighting arrangement as claimed in claim 1, wherein the busbar is arranged laterally with respect to the light exit region.

4. The lighting arrangement as claimed in claim 1, wherein the light providing device, for the coupling to the channel, is securable in a magnetically adhering fashion to at least one inner surface region of the channel.

5. The lighting arrangement as claimed in claim 1, wherein the light providing device comprises at least one magnet by which the coupling of the light providing device to the channel is made possible.

6. The lighting arrangement as claimed in claim 1, wherein the channel is designed with at least one integral or multipartite housing component comprising cover and wall sections and also having an open side, wherein the light exit region transversely with respect to a longitudinal direction of the channel is designed to be smaller than the open side of the housing component.

7. The lighting arrangement as claimed in claim 6, wherein the light providing device is coupleable to the housing component by magnetic force.

8. The lighting arrangement as claimed in claim 6, wherein the channel furthermore comprises profiled components coupled to the housing component in the region of the open side of the housing component, wherein the profiled components delimit the light exit region.

9. The lighting arrangement as claimed in claim 8, wherein the profiled components of the channel are configured to be arranged at a plate element in each case in sections on a side of the plate element that faces away from a visible side, in a manner engaging over an edge of the plate element.

10. The lighting arrangement as claimed in claim 8, wherein the busbar is arranged in or at one of the profiled components or is formed in or at the profiled component in such a way that the busbar is accessible from the interior.

11. The lighting arrangement as claimed in claim 1, wherein the lighting arrangement comprises a line provided for supplying the light providing device, and also a connection adapter, which is electrically coupleable to the busbar, and the line electrically couples the connection adapter to the light providing device.

12. The lighting arrangement as claimed in claim 11, wherein the line provided for supplying the light providing device is a cable.

13. The lighting arrangement as claimed in claim 11, wherein the line is designed in such a way that it can be magnetically coupled to a constituent of the channel and thereby be at least one of held and guided within the interior.

14. The lighting arrangement as claimed in claim 1, wherein the connection adapter or the light providing device comprises a device which makes it possible to wirelessly receive control signals for at least one of switching and controlling the light emission of the light providing device.

15. The lighting arrangement as claimed in claim 1, wherein the light providing device comprises a soft component which makes contact with the channel when the light providing device is coupled to the channel.

16. The lighting arrangement as claimed in claim 1, wherein in addition to the free positionability of the light providing device the light providing device is furthermore at least one of alignable and adjustable as necessary for altering an emission direction of the light providing device.

17. The lighting arrangement as claimed in claim 1, wherein the lighting arrangement comprises at least one additional light source which is arranged and designed to emit light into the interior and thereby to illuminate the channel.

18. A construction kit for a lighting arrangement, wherein the construction kit comprises components for forming a channel having an interior and a light exit region and also at least one light providing device;

wherein the light providing device is designed for arrangement thereof within the interior for the directional emission of light during operation through the light exit region toward the outside and is furthermore configured in such a way that the light providing device, for the holding thereof, is coupleable to the channel formed and is freely positionable at least within a region of the interior; and wherein the construction kit comprises at least one busbar designed for the supply of the light providing device and situated in the interior of the channel after the formation of the channel, or sections of such a busbar, wherein the busbar or the sections is or are in each case provided as a constituent of one of the components or as a component part secured or securable at one of the components, the light providing device being electrically coupleable to the busbar in the interior of the channel.

19. A method for constructing a lighting arrangement, comprising the steps of:

providing a channel having an interior and a light exit region, and providing at least one light providing device, the light providing device being designed for arrangement thereof within the interior for the directional emission of light during operation through the light exit region toward the outside, the light providing device being electrically coupleable to a busbar designed for the supply of the light providing device in the interior of the channel, and the light providing device, for the holding thereof, being coupleable to the channel and being freely positionable at least within a region of the interior;

introducing the light providing device into the interior and coupling the light providing device to the channel in order to hold the light providing device within the interior including securing the light providing device, for the coupling to the channel, in a magnetically adhering fashion to at least one inner surface region of the channel; and positioning the light providing device in such a way that the light providing device, if necessary after additional alignment thereof, can emit light during operation through the light exit region toward the outside.

20. A lighting arrangement, comprising a channel having an interior and a light exit region, and comprising at least one light providing device;

wherein the light providing device is designed for arrangement thereof within the interior for the directional emission of light during operation through the light exit region toward the outside;

wherein the lighting arrangement comprises at least one busbar designed for the supply of the light providing device in the interior of the channel and the light providing device is electrically coupleable to the busbar;

wherein the light providing device, for the holding thereof, is coupleable to the channel and is freely positionable at least within a region of the interior; and wherein the light providing device comprises at least one magnet by which the coupling of the light providing device to the channel is made possible.

21. A lighting arrangement, comprising a channel having an interior and a light exit region, and comprising at least one light providing device;

wherein the light providing device is designed for arrangement thereof within the interior for the directional emission of light during operation through the light exit region toward the outside;

wherein the lighting arrangement comprises at least one busbar designed for the supply of the light providing device in the interior of the channel and the light providing device is electrically coupleable to the busbar; and wherein the light providing device, for the holding thereof, is coupleable to the channel and is freely positionable at least within a region of the interior;

wherein the channel is designed with at least one integral or multipartite housing component comprising cover and wall sections and also having an open side, wherein the light exit region transversely with respect to a longitudinal direction of the channel is designed to be smaller than the open side of the housing component;

wherein the channel furthermore comprises profiled components coupled to the housing component in the region of the open side of the housing component, wherein the profiled components delimit the light exit region; and wherein the profiled components of the channel are configured to be arranged at a plate element in each case in sections on a side of the plate element that faces away from a visible side, in a manner engaging over an edge of the plate element.

22. A lighting arrangement, comprising a channel having an interior and a light exit region, and comprising at least one light providing device;

wherein the light providing device is designed for arrangement thereof within the interior for the directional emission of light during operation through the light exit region toward the outside;

wherein the lighting arrangement comprises at least one busbar designed for the supply of the light providing device in the interior of the channel and the light providing device is electrically coupled to the busbar; and wherein the light providing device, for the holding thereof, is coupled to the channel and is freely positionable at least within a region of the interior;

wherein the lighting arrangement comprises a line provided for supplying the light providing device, and also a connection adapter, which is electrically coupled to the busbar, and the line electrically couples the connection adapter to the light providing device, wherein the line is magnetically coupled to a constituent of the channel and thereby at least one of held and guided within the interior.

23. A lighting arrangement, comprising a channel having an interior and a light exit region, and comprising at least one light providing device;

wherein the light providing device is designed for arrangement thereof within the interior for the directional emission of light during operation through the light exit region toward the outside;

wherein the lighting arrangement comprises at least one busbar designed for the supply of the light providing device in the interior of the channel and the light providing device is electrically coupleable to the busbar; and wherein the light providing device, for the holding thereof, is coupleable to the channel and is freely positionable at least within a region of the interior; and wherein the light providing device or a connection adapter, which is electrically coupleable to the busbar and electrically coupled to the light providing device by a line, comprises a device which makes it possible to wirelessly receive control signals for at least one of switching and controlling the light emission of the light providing device.

24. A lighting arrangement, comprising a channel having an interior and a light exit region, and comprising at least one light providing device;

wherein the light providing device is designed for arrangement thereof within the interior for the directional emission of light during operation through the light exit region toward the outside;

wherein the lighting arrangement comprises at least one busbar designed for the supply of the light providing device in the interior of the channel and the light providing device is electrically coupleable to the busbar; and wherein the light providing device, for the holding thereof, is coupleable to the channel and is freely positionable at least within a region of the interior;

wherein in addition to the free positionability of the light providing device the light providing device is furthermore at least one of alignable and adjustable as necessary for altering an emission direction of the light providing device.

25. A lighting arrangement, comprising a channel having an interior and a light exit region, and comprising at least one light providing device;

wherein the light providing device is designed for arrangement thereof within the interior for the directional emission of light during operation through the light exit region toward the outside;

wherein the lighting arrangement comprises at least one busbar designed for the supply of the light providing device in the interior of the channel and the light providing device is electrically coupleable to the busbar; and wherein the light providing device, for the holding thereof, is coupleable to the channel and is freely positionable at least within a region of the interior;

wherein the lighting arrangement comprises at least one additional light source which is arranged and designed to emit light into the interior and thereby to illuminate the channel.

* * * * *